US005485248A

United States Patent [19]

Yano et al.

[11] Patent Number: 5,485,248

[45] Date of Patent: Jan. 16, 1996

[54] IMAGE FORMING APPARATUS HAVING A CONTACT CHARGER FOR VARYING A CHARGE APPLIED TO A PHOTOSENSITIVE DRUM BASED ON A RESISTANCE OF THE PHOTOSENSITIVE LAYER

[75] Inventors: Hideyuki Yano; Junji Araya, both of Yokohama; Norio Hashimoto, Tokyo; Harumi Kugoh; Takashi Shibuya, both of Kawasaki; Tadashi Furuya, Yokohama, all of Japan

[73] Assignee: Canon Kabushiki Kaisha, Tokyo, Japan

[21] Appl. No.: 371,584

[22] Filed: Jan. 12, 1995

Related U.S. Application Data

[63] Continuation of Ser. No. 14,521, Feb. 8, 1993, abandoned.

[30] Foreign Application Priority Data

Feb. 7, 1992 [JP] Japan ..... 4-056914
Apr. 28, 1992 [JP] Japan ..... 4-137744

[51] Int. Cl.[6] ..... G03G 21/00

[52] U.S. Cl. ..... 355/206; 355/209; 355/219

[58] Field of Search ..... 355/203, 204, 355/209, 216, 219, 206; 361/225, 221

[56] References Cited

U.S. PATENT DOCUMENTS

| | | | |
|---|---|---|---|
| 3,935,517 | 1/1976 | O'Brien | 317/262 |
| 4,727,453 | 2/1988 | Ewing | 361/225 |
| 4,851,960 | 7/1989 | Nakamura et al. | 361/225 |
| 5,089,851 | 2/1992 | Tanaka et al. | 355/219 |
| 5,140,371 | 8/1992 | Ishihara et al. | 355/219 |
| 5,144,368 | 9/1992 | Ohzeki et al. | 355/219 |
| 5,160,967 | 11/1992 | Tonegawa | 355/208 |
| 5,164,779 | 11/1992 | Araya et al. | 355/219 |
| 5,184,180 | 2/1993 | Choi | 355/219 |

FOREIGN PATENT DOCUMENTS

| | | |
|---|---|---|
| 0338546 | 10/1989 | European Pat. Off. . |
| 58-90652 | 5/1983 | Japan . |
| 58-136057 | 8/1983 | Japan . |
| 59-69774 | 4/1984 | Japan . |
| 63-149669 | 6/1988 | Japan . |
| 63-167380 | 7/1988 | Japan . |
| 4-57068 | 2/1992 | Japan . |

*Primary Examiner*—R. L. Moses
*Attorney, Agent, or Firm*—Fitzpatrick, Cella, Harper & Scinto

[57] ABSTRACT

An image forming apparatus includes an image bearing member for bearing an image, a contact charger for charging the image bearing member, and a detector for detecting an electric current flowing through the charger when the charger changes a potential of a predetermined area of the image bearing member from a first potential to a second potential which is different from the first potential. In another aspect of the invention, the detector detects a flow of current through a second contact charger when a first oscillating voltage is applied by a first contact charger and a second oscillating voltage applied by the second contact charger which is different from the first oscillating voltage.

76 Claims, 40 Drawing Sheets

T0 : ONE-ROT

T1 : BTWN EXP & CHR

T2 : BTWN CHR & EXP

IMAGE FORMING APPARATUS HAVING A CONTACT CHARGER FOR VARYING A CHARGE APPLIED TO A PHOTOSENSITIVE DRUM BASED ON A RESISTANCE OF THE PHOTOSENSITIVE LAYER

This application is a continuation of application Ser. No. 08/014,521 filed Feb. 8, 1983, now abandoned.

FIELD OF THE INVENTION AND RELATED ART

The present invention relates to an image forming apparatus such as an electrophotographic copying machine or printer, more particularly to an image forming apparatus having a charging member contactable to an image bearing member such as a photosensitive member.

In an image forming apparatus such as an electrophotographic machine or electrostatic recording apparatus, an image bearing member in the form of an electrophotographic photosensitive member or electrostatic recording dielectric member or the like (the member to be charged) has been electrically charged or discharged by a corona discharger.

Recently, a contact (direct) type charging device has been input into practice in which a charging member (conductive member) of roller type (charging roller), blade type (charging blade) or the like is directly contacted to the member to be charged to charge it to a predetermined polarity and potential (Japanese Laid-Open Patent Application No. 167380/1988).

A contact type charging device is advantageous over the corona charging device in that the voltage of a power source thereof is low, that the amount of corona products such as ozone is small, or the like. As for such a charging member, a conductive roller (charging roller) is conveniently used from the standpoint of stability in the charging action.

There are two types of charging system in one of which only a DC voltage is applied to the charging member (DC charging), and in the other of which the charging member is supplied with an oscillating voltage (the voltage level periodically changes with elapse of time) (AC charging), as disclosed in Japanese Laid-Open Patent Application No. 149669/1988.

The contact type charging is such that the electric discharge from the charging member to the member to be charged is used for the charging, and therefore, the member to be charged is electrically charged by the DC voltage application which is not less than a threshold.

More particularly, when the charging roller is press-contacted to an OPC photosensitive member having a thickness of 25 microns, the surface potential of the photosensitive member starts to increase if the charging member in the form of the charging roller is supplied with a DC voltage which is not less than approximately 640 V, as shown in FIG. 5, whereafter the surface potential of the photosensitive member increases linearly with an inclination 1 relative to the applied voltage.

The DC voltage of approx. 640 V at which the surface potential of the photosensitive member starts to increase, is a charge starting voltage Vth relative to the photosensitive member.

From the foregoing, it is understood that in order to provide the surface potential of the photosensitive member (charge potential) Vd required for the image formation by the DC charging, the charging roller is supplied with a DC voltage of Vd+Vth.

In the DC charging, the charging roller is supplied with such a DC voltage to charge the member to be charged.

This is described as follows. In FIG. 6A, a photosensitive drum 2 comprising a conductive drum base member 2*b* and a photosensitive layer 2*a* (the member to be charged) thereon is contacted by the charging member in the form of a charging roller 1, in which designated by a reference numeral 8 is a charging bias applying voltage source. The electrical equivalent circuit of the charging roller, the photosensitive drum and a fine gap therebetween is as shown in FIG. 6B. The impedance of the charging roller is so small as compared with those of the photosensitive drum and the air layer that it is neglected. Therefore, the charging mechanism is simply expressed as two capacitors C1 and C2.

When a DC voltage is applied to the equivalent circuit, the voltage is proportionally divided on the basis of the impedance of the capacitor, and the voltage Vair applied across the air layer is:

$$Vair=C2/(C1+C2) \quad (1)$$

According to Paschien's Law, the air layer has a dielectric break down voltage which is expressed as follows:

$$312+6.2\ g\ (V) \quad (2)$$

where g (microns) is a thickness of the air layer.

The voltage at which the discharge starts responds to when the two order equation with respect to g ((1)=(2)) has double solutions (C1 is a function of g). The DC voltage at this time corresponds to the charge starting voltage Vth. The theoretical Vth thus obtained is very close to the experiment results.

However, in the contact charging, the resistance of the contact charging member varies due to the ambient condition change, and the member to be charged in the form of a photosensitive member is scraped (wearing) due to a long term use so that the thickness reduces with the result of change of the charge starting voltage Vth. Therefore, in the case of the DC charging system, it is difficult to correctly stabilize the surface potential of the photosensitive member to be a desired Vd value.

The AC charging is advantageous in that the contact type charging can provide more uniform charging. The charging member is supplied with an oscillating voltage ($V_{DC}+V_{AC}$) which is a superimposed AC and DC voltage in which the DC voltage has a voltage level corresponding to the desired potential level Vd, and the AC voltage has a peak-to-peak voltage Vpp not less than 2×Vth, preferably. As shown in FIG. 7, the AC voltage application is used because of its uniforming effect, and it can provide uniform charged potential. The potential of the member to be charged converges to the voltage Vd which is the center of the oscillation voltage (the center of the peak-to-peak voltage), and the level is not influenced by the ambience.

The waveform of the AC voltage is not limited to a sign wave, but may be a rectangular, triangular or pulse wave. The AC voltage includes a voltage provided by periodically actuating and deactuating a DC voltage source.

(A) The photosensitive members used in an electrophotography include inorganic photosensitive member such as ZnO, CdS, Se, A-Si or the like, and an organic photoconductive layer (OPC). Any of them is not free of a sensitivity variation due to the ambience under which it is used, the accumulation of the light exposure, scraping of the photosensitive member or the like. In addition, even if the same material is used, it is difficult to maintain a constant potential VL of the exposed area due to the manufacturing variation of the photosensitive member. An electrophotographic apparatus using a laser beam, particularly, a printer, if the sensitivity of the photosensitive member changes, the problem that the image density is not constant and that the line width changes with the result of non-uniform font, arise.

In order to prevent this, in a conventional method, the surface potential of the photosensitive member has been measured. This increases the cost and required space. Therefore, the method is not suitable for low cost machines and small size machines.

Conventionally, furthermore, in order to correct the manufacturing variation of the photosensitive member, the sensitivity of the photosensitive drum is measured beforehand, and the apparatus is adjusted to provide proper exposure amount. In another method, in the case of cartridge type, the respective cartridges are provided with an sensitivity index indicative of the peculiar drum sensitivities, and the main assembly of the printer or the like is provided with means for reading the sensitivity index to adjust the exposure to provide the proper exposure amount. This increases the complication of the apparatus with the result of cost increase.

(B) In either of the contact type AC or DC charging systems, there arise the following problems when the photosensitive member is worn or scraped with the result of thickness reduction, through long term The charge amount Q required for charging the surface of the photosensitive member to a potential Vd, is determined by the electrostatic capacity C of the photosensitive member, and the charge amount is reversely proportional to the thickness of the photosensitive member.

Therefore, in order to charge the worn photosensitive drum to the potential Vd, a larger charge (charging current) is required. However, when the charging current increases, the voltage drop by the impedance of the contact charging member becomes significant.

In order to prevent concentration of the charging current through a pin hole, if any, in the photosensitive layer, the charging roller is generally provided with a resistance layer which has a roller resistivity of $10^5$–$10^6$. When the apparatus is operated for a long period of time under low humidity and low temperature condition, the effects of the combination of the roller resistance increase and the charging current increase due to the wearing of the photosensitive member, result in the reduction of the potential Vd to 100–200 V. If this occurs, the fog is produced in the image.

From the foregoing, in order to provide a good image, the thickness of the photosensitive member is desirably not less than 15 microns approximately. If the photosensitive member thickness is reduced more, the stabilized image formation is not assured, and therefore, it is considered as the service life of the photosensitive member.

Currently, there have not been many effective methods for directly detecting a thickness of the photosensitive member, and therefore, the best conventional method is counting the total rotations of the photosensitive member and predicting therefrom the scraped amounts. However, because the amount of scraping changes due to this condition and the state of the cleaning device, this method is not reliable.

(C) Japanese Laid-Open Patent Application No. 57068/1992 discloses a method of detecting the state of the photosensitive member such as the thickness of the photosensitive layer and hysteresis of exposure or the like on the basis of a DC current when the photosensitive member is charged by a corona charger. However, since it uses a corona charger as a charging device, and therefore, it measures the current flowing to the ground from the photosensitive member. In this case, the current to the ground is not always contributable to the charging, but it also includes a shield current and the current from the developing means, transfer means or the like, simultaneously.

When the toner is removed from the photosensitive member, the current corresponding to the toner charge retained in the conductive layer of the photosensitive member, also flows to the ground, and thereby adding to the error.

In order to solve the problem in the corona charging device, it is desired to correctly detect only the DC current contributable to the actual charging action without including the other current. In order to accomplish this, it is required to determine the wire current of a scorotron charger reduced by a shield current, grid current or the like. This is not advantageous in that error tends to occur and that the structure is not simple.

SUMMARY OF THE INVENTION

Accordingly, it is a principal object of the present invention to provide an image forming apparatus in which a thickness of an image bearing member is correctly determined with stability.

It is another object of the present invention to provide an image forming apparatus in which a service life of an image bearing member can be detected.

It is a further object of the present invention to provide an image forming apparatus capable of providing good images in which the foggy background or another improper factors are removed beforehand.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 23A end 21B show measured current before and after use of a frequency filter.

DESCRIPTION OF THE PREFERRED EMBODIMENTS

Referring to the accompanying drawings, the description will be made as to the embodiments of the present invention.

(1) Exemplary Image Forming Apparatus

Figure 1:
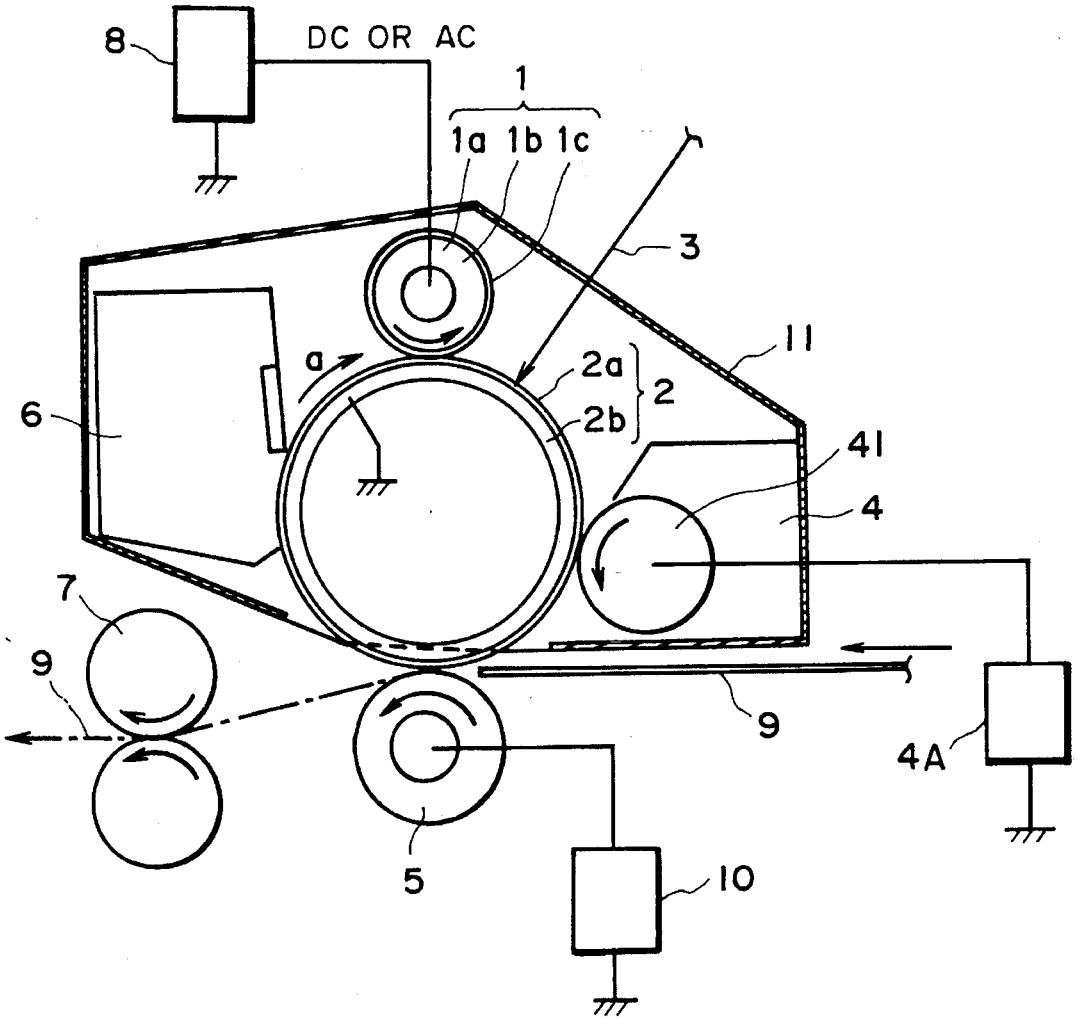
FIG. 1 is a schematic view of a printer according to a first embodiment of the present invention.

FIG. 1 schematically shows an image forming apparatus according to an embodiment of the present invention. The exemplary image forming apparatus is in the form of a laser beam printer using an image transfer type electrophotographic process.

Designated by a reference numeral 2 is an electrophotographic photosensitive member functioning as an image bearing member, and is rotated at a process speed (peripheral speed) of 95 mm/sec.

The photosensitive drum 2 of this embodiment comprises an aluminum drum 2*b* (conductive drum base) having a diameter of 30 mm and a photosensitive layer 2*a* of negatively chargeable OPC photosensitive member applied thereon. The photosensitive layer 2*a* has a carrier generating layer and a carrier transfer layer (CT layer) having a thickness of d=25 microns thereon. In this embodiment, the CT layer is of polycarbonate resin and hydrazone CT material as a binder. With the use of the apparatus, the CT layer is gradually scraped with the result of reduction of the thickness. Designated by a reference numeral 1 is a charging roller as a primary charging member for the photosensitive layer 2. It comprises a core metal 1*a*, a conductive elastic layer (conductive rubber layer) 1*b* thereon and a high resistance layer 1*c* thereon which has a volume resistivity larger than that of the conductive elastic layer 1*b*.

The core metal 1*a* is supported by bearings at the opposite ends thereof, and are disposed substantially in parallel with the photosensitive drum 2. The charging member is press-contacted to the photosensitive drum 2. In this embodiment, the charging roller is driven by the photosensitive drum 2.

A charging bias applying voltage source 8 for the charging roller 1 is effective to supply a predetermined charging bias through a core metal 1*a* to the charging roller 1 from the voltage source 8, so that the outer peripheral surface of the photosensitive layer 2a of the rotating photosensitive drum 2 is charged through contact charging process to a predetermined polarity and potential.

The high resistance layer 1c on the outer peripheral surface of the charging roller 1, when low durability defect such as a pin hole is produced in the photosensitive layer 2a, is effective to prevent the improper charging in the form of a lateral stripe due to the potential reduction of the charging roller surface by concentration of the charging current through the defect.

Subsequently, the charged surface of the rotating photosensitive drum 2 is exposed to and scanned by a laser beam emitted from an unshown laser beam scanner, the laser beam being modulated in the intensity thereof in accordance with a time series pixel signal in the form of electric digital signal representative of the object image information. The exposed portion of the photosensitive drum 2 is electrically discharged so that an electrostatic latent image is formed thereon. The laser beam 3 has a wavelength of 780 nm.

Then, the latent image is developed through a reverse jumping development process by a developing device 4 with a one component magnetic toner, and the exposed portion of the surface of the photosensitive layer 2a is visualized.

The toner image is transferred by a transfer roller 5 onto a surface of a transfer material 9 which has been fed at the predetermined timing from an unshown transfer material feeding mechanism into a transfer nip formed between the photosensitive member 2 and the transfer roller 5. In this embodiment, the transfer roller 5 is supplied with a transfer bias voltage of 3 KV from a transfer bias application voltage source.

The transfer material having passed through a transfer nip is then separated from the surface of the photosensitive drum 2, and is conveyed to an image fixing device where the toner image is fixed thereon by heat and pressure. Subsequently, it is discharged as an image print or copy.

After the image transfer operation onto the transfer material 9, the surface of the photosensitive member 2 is cleaned by a blade type cleaning device so that the untransferred residual toner, paper dust or other contamination are removed therefrom. Then, the photosensitive member is used for repetitive image forming operation.

The cleaning blade is in the form of a counter blade made of urethane rubber.

The printer of this embodiment is in the form of a cartridge type, wherein a cartridge is detachably mountable as a unit to a printer main assembly and contains process means, namely, photosensitive drum 2, the charging roller 1, the developing device 4 and the cleaning device 6. The process cartridge 11 may contain at least the photosensitive drum 2 and the charging roller 1.

(2) Detection of the Thickness of the Photosensitive Member

Figure 5:
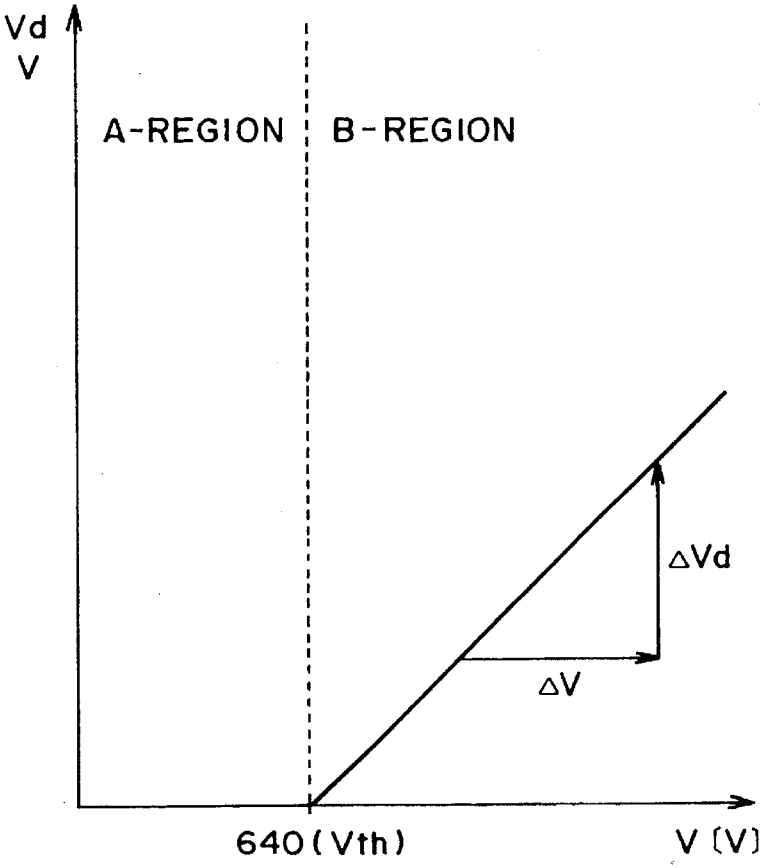
FIG. 5 shows an interrelation between a voltage applied to the charging member and a charged potential.

As described in conjunction with FIG. 5, when the DC voltage is applied to the charging roller 1, the charging of the photosensitive member 2a starts when the DC voltage is Vth, and thereafter, the surface potential of the photosensitive member increases (ΔVD) linearly at the same rate as the increase ΔV of the applied voltage. Here, the region in which The applied voltage V is less than Vth is called "A region", and a region in which it is not less than Vth is called "B region". In the A region, the applied voltage is small, and the voltage divided by the air layer is unable to exceed the dielectric break down voltage determined by the Paschien's Law, and therefore, the charging action does not occur. Therefore, the A region is not pertinent to the present invention.

In the B region, the electric discharge occurs from the charging roller 1 to the photosensitive layer 2a, and the applied voltage V and the surface potential Vd increase linearly at inclination 1 irrespective of the thickness of the photosensitive layer or ambient condition, and therefore, ΔV=ΔVd.

Figure 2:
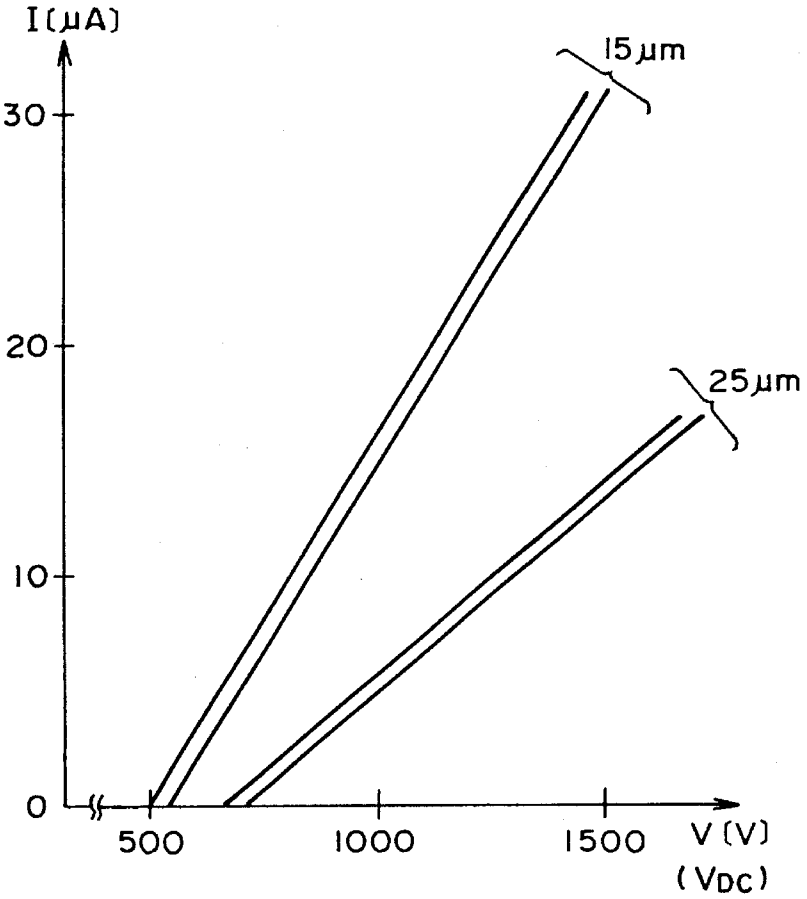
FIG. 2 shows V-I characteristics when a thickness of the photosensitive member is changed.

On the contrary, as shown in FIG. 2, the graph of a relation between the applied voltage V and the charging current I is the same in that the charging does not occur in the A region, but the inclination changes in the B region, depending on the thickness d of the photosensitive layer 2a.

This exhibits that depending on the thickness of the photosensitive layer, the charge current I required to charge the same potential Vd, is different. As regards the surface potential Vd of the photosensitive member and the charge current I, the following calculation applies, When the photosensitive layer 2a has a thickness d, a specific dielectric constant ϵ, a dielectric content in vacuum ϵO, and an effective charging width of the contact charging member is L, and the process speed is Vp, then the electrostatic capacity C of the photosensitive member 2a is as follows:

Charge quantity $Q=\int I\times dt=C\times Vd$

Charging current $I=d/dt(C\times Vd)$ where $dC/dt=\epsilon\times\epsilon O\times L\times Vp/d,$ Vd=Const.

Charging current $I=\epsilon\times\epsilon O\times L\times Vp\times Vd/d$ (3)

In equation (3), ϵ, ϵO, L, Vp and d are constant, and in the B region ΔV=ΔVd, and therefore, $$\begin{aligned}\underline{\Delta I} &= \epsilon\times\epsilon 0\times L\times Vp\times\Delta Vd/d \\ &= \underline{\epsilon\times\epsilon 0\times L\times Vp\times\Delta V/d}\end{aligned} \quad (4)$$

Accordingly, in the B region, the inclination of the line in V-I graph is expressed as follows:

ϵ×ϵO×L×Vp/d

Therefore, in this embodiment, the charging roller 1 functioning as a primary charging member for the photosensitive drum 2 is also used as an electrode member for detection of the thickness of the photosensitive layer. In the B region, the voltage V applied to the charging roller 1 and the charging current I at that time are detected at two points, and from the detections, the inclination of the V-I characteristic line is calculated, thus detecting the thickness of the photosensitive layer 2a.

In this embodiment, the photosensitive layer 2a has an initial thickness of 25 microns, and therefore, the initial Vth is 640 V. With the reduction of the thickness of the photosensitive layer 2a, the voltage Vth reduces, and therefore, the region where the applied voltage is not less than 640 V, the region is deemed as the B region.

As will be understood from the above equation (3), by detecting the current I and the voltage Vd, it is also possible to obtain the photosensitive layer thickness. However, for the purpose of detecting Vd, the main assembly of the printer is provided with means for detecting a surface potential of the photosensitive member. In addition, another hardware such as a voltage source is required.

As for the condition of the above control, unless the potential of the photosensitive layer is a predetermined value at the time of detection, the relation between the charged potential and the charging current is not known. Therefore, image exposure is carried out, and the potential is made 0, and the measurement is performed. The time periods in which the voltages are applied are for one drum rotation, respectively, in order to remove the noise influence or the like. The current measured in the period is averaged.

According to this embodiment, the thickness measurement for the photosensitive layer 2*a* is carried out during a pre-rotation period for the photosensitive drum 2, and therefore, the image forming process is not influenced.

In order to carry out the control of this embodiment, it is required that the relationship between the inclination of the V-I characteristic and the film thickness d of the photosensitive layer 2*a* is predetermined. Therefore, the measurements are carried out for the photosensitive drums 2 having photosensitive layer thicknesses d of 15 microns, 17 microns, 21 microns and 25 microns, respectively. FIG. 2 shows the V-I characteristics when the thickness is 15 microns and 25 microns, as representative examples.

The following ambient conditions are considered:

Normal ambient condition (N/N ambient condition): 25° C.×60% RH.

High temperature and high humidity ambient condition (H/M condition): 32.5° C.×85% RH Low temperature and low humidity condition (L/L condition); 15° C.×10% RH Although the level of the line changes with the change of the conditions, the inclination is constant, and therefore, it depends only on the thickness of the photosensitive layer 2*a*, as empirically exhibited.

Figure 3:
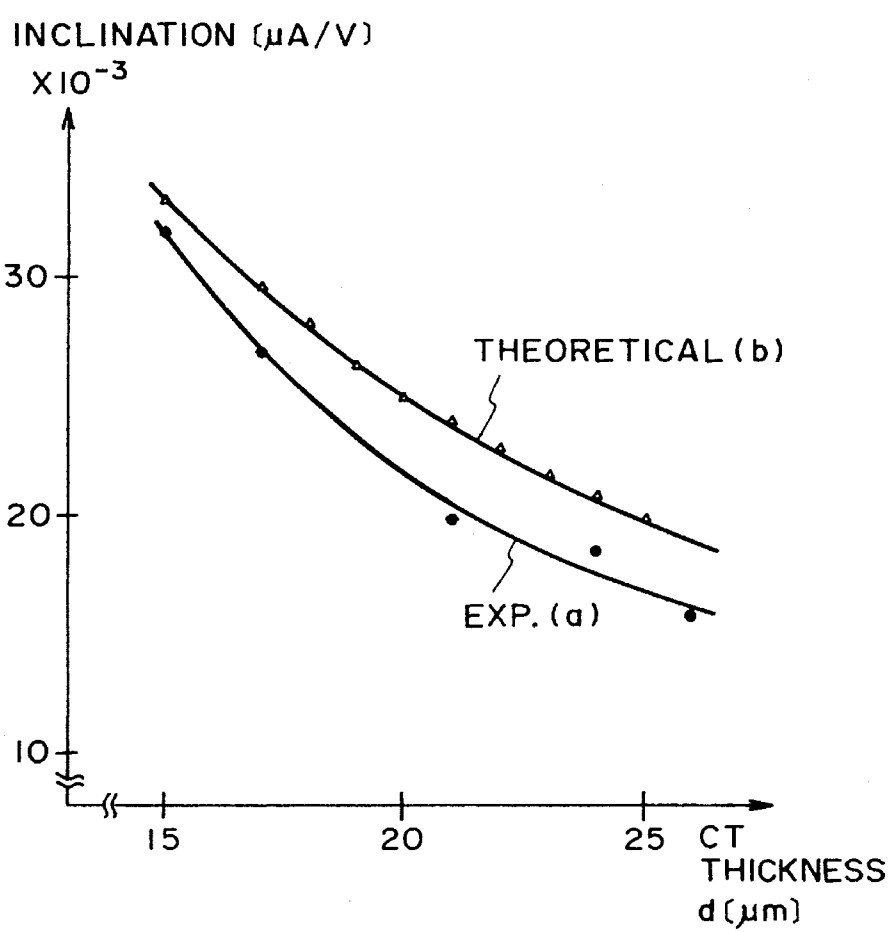
FIG. 3 shows an interrelation between the photosensitive layer thickness and the V-I characteristics.

On the basis of the inclination of the five film thicknesses, the relation between the thickness d and the inclination is shown as a graph (a) (experimental) in FIG. 3.

Theoretical values are plotted as a line (b), which have been obtained by the above equation (4), with $\epsilon=3$, $\epsilon O=8.85\times10^{-12}$, L=20 cm, Vp=95 mm/sec, as the figures corresponding to the printer of this embodiment. As will be understood, they are in accord with the experimental values, although there are slight references. In this embodiment, the control operation based on the graph (a) (experimental) rather than the theoretical graph (b).

In this embodiment, the relationship between the photosensitive layer thickness d and the inclination of the V-I characteristic in the graph (a) of FIG. 3 is stored in a printer controller (not shown) at a ROM. From the inclination of the V-I characteristic, the photosensitive layer thickness d can be calculated. When the inclination exceeds $32\times10^{-3}$ μA/V which corresponds to 15 microns which is the lower limit of the film thickness d of the photosensitive member to provide good images, a warning lamp (not shown) on the front panel of the printer is actuated, and in addition the end of the service life of the photosensitive member is transmitted to a host computer (not shown). By the warning display or the incapability of the printing operation, the operator recognizes that the photosensitive member (photosensitive drum) has reached its service life end, and the process cartridge 11 is exchanged in this embodiment. In this manner, the improper charging and therefore the improper image formation resulting from the use of the photosensitive member over the service life, can be prevented on the basis of the correct detection of the end of the service life of the photosensitive member.

(3) Printer Durability Tests

Figure 4:
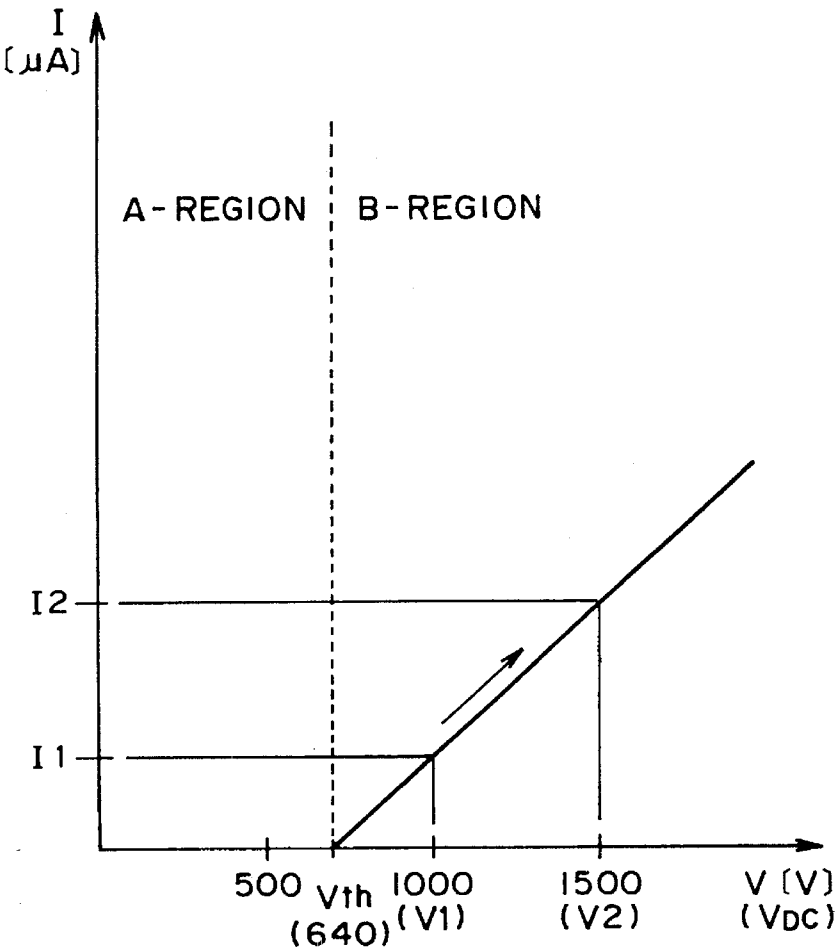
FIG. 4 shows control of V-I characteristics.

During the pre-rotation of the printer, as shown in FIG. 4, two voltages V1 and V2 which is not less than the charge starting voltage Vth are applied to the charging roller 1, and the electric current I1 and I2 are measured. In this embodiment, the voltages V1 and V2 are in the B region, and therefore, the voltages are not less than 640 V. In the tests, the following was selected:

V1=1000 (V)

V2=1500 (V)

In the B region the inclination of V-I characteristic is calculated as follows:

$$(I2-I1)/(V2-V1)$$

At the initial state of the test run the thickness of the photosensitive member d was 25 microns, and therefore:

I1=5.5μA

I2=14 μA

The inclination was $17\times10^{-3}$ μA/V.

Under the N/N condition, 15000 sheets were processed, and then the control operation of this embodiment was carried out. The detections were as follows:

I1=16 μA

I2=32 μA

The inclination was $32\times10^{-3}$ μA/V, which exceeds the predetermined level. Therefore, the printer actuated the warning lamp, and also red the warning signal to the host computer, and the printer was stopped.

At this time, the thickness d of the photosensitive layer was measured, and it was approx. 15 microns. Thus, the properness of this control was proved to be appropriate.

In this manner, according to this embodiment, the voltage applied to the contact type charging member and the charging current I are detected to determine the inclination of the V-I characteristic, by which the thickness d of the photosensitive member 2*a* can be detected.

Accordingly, the detection of the photosensitive layer 2*a* thickness (service life) which has not been effectively detected, can be accomplished with simple structure without addition of particular structures.

In this embodiment, the charging roller 1 (the primary charging member) is used as an electrode member for detection of the thickness of the film, but it is possible to use an electrically conductive transfer roller 5 as an electrode member for detection of the thickness of the transfer roller.

As will be understood from a second embodiment of the present invention which will be described below, an electrode member for the photosensitive layer film thickness detection may be used.

Second Embodiment (FIG. 8)

In this embodiment, there is provided an electrode member addicted for the detection of the photosensitive layer thickness.

When the charging roller 1 is used for detecting the photosensitive layer thickness as in the first embodiment, two voltages V1 and V2 are to be applied as described. Because there exists a problem of detecting the film thickness during the image formation period, the problem can be avoided if an addicted electrode member is used.

Figure 8A:
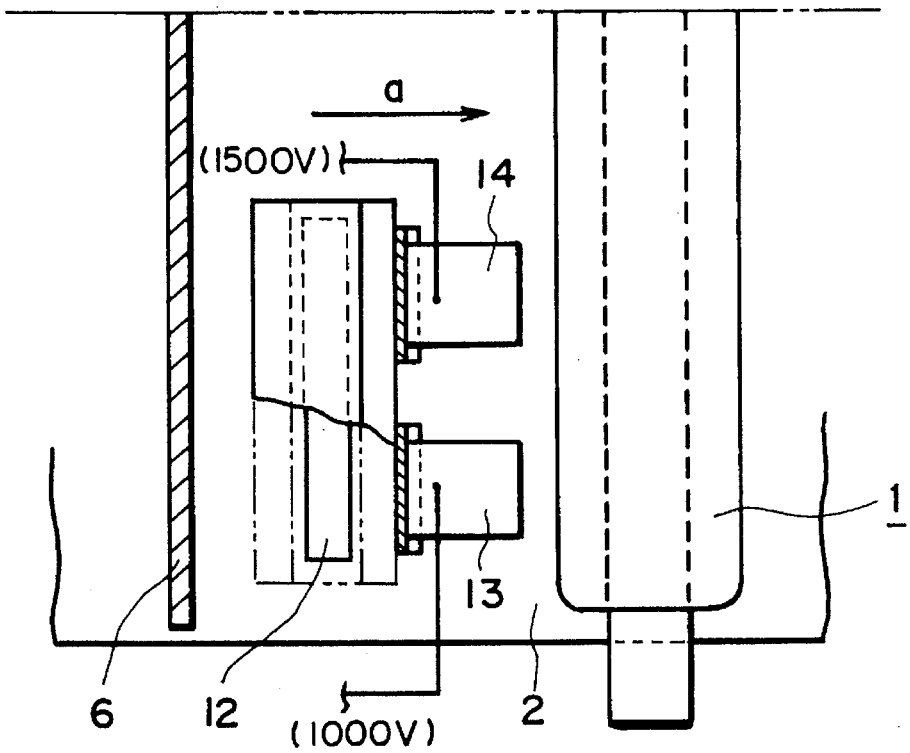
FIG. 8A is a top plan view of a part of a photosensitive layer thickness measuring means according to a second embodiment of the present invention.
Figure 8B:
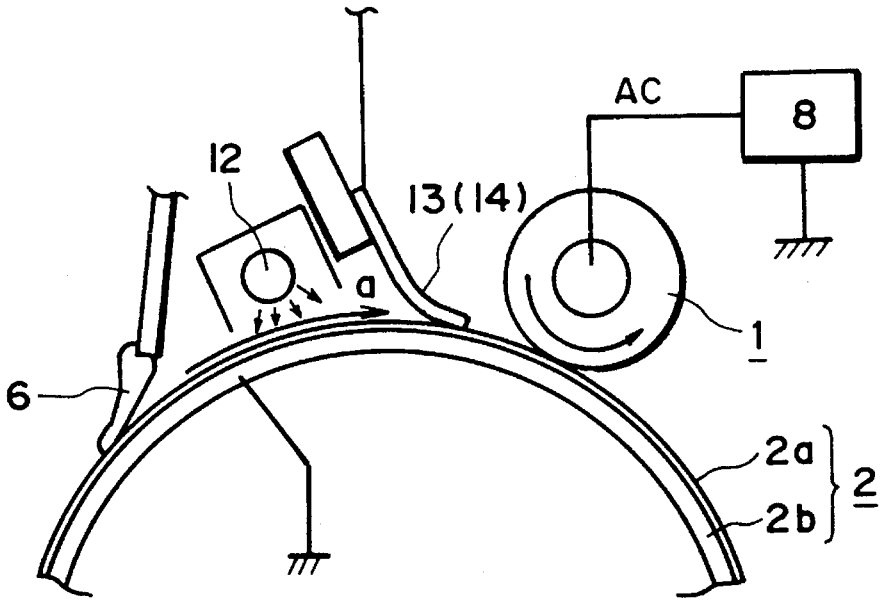
FIG. 8B is a side view of the means of FIG. 8A.

The second embodiment is the one avoiding this. FIG. 8A is a partly sectional top plan view of a major part of an apparatus of this embodiment, and FIG. 8B is a side view thereof.

At a position between the cleaning device 6 and the charging roller 1, there are disposed an exposure lamp 12 functioning as a means for discharging the photosensitive member, and a pair of contact members 13 and 14 (contact electrodes) contacted to the surface of the photosensitive member 2*a*, wherein the exposure lamp 12 is upstream of the contact members 13 and 14 with respect to the rotational direction of the photosensitive dry.

The first and second contact members 13 and 14 are disposed with an interval therebetween in the direction of the generating line of the photosensitive drum 2. In this embodiment, each of the contact members is a conductive member in the form of a blade having a width of 1 cm. It is urethane rubber material coated with electroconductive urethane paint (Emraron available from Nippon Achison Kabushiki Kaisha) in a thickness of 20 microns.

As for the means for discharging the photosensitive member 12, an AC charger in which a DC bias voltage is 0 V. The contact members 13 and 14 may be in the form of a roller or pad or the like.

Figure 6A:
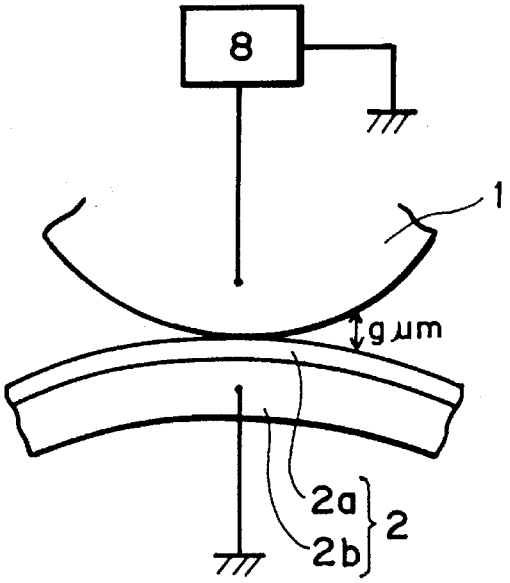
FIG. 6A is an enlarged schematic view of a photosensitive drum and a charging roller which are contacted to each other.
Figure 6B:
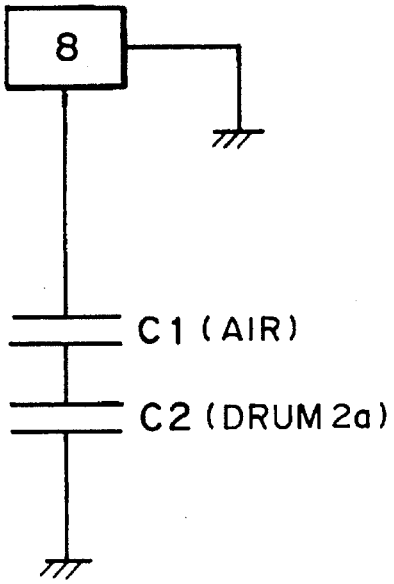
FIG. 6B shows an equivalent electrical circuit of the discharge.
Figure 7:
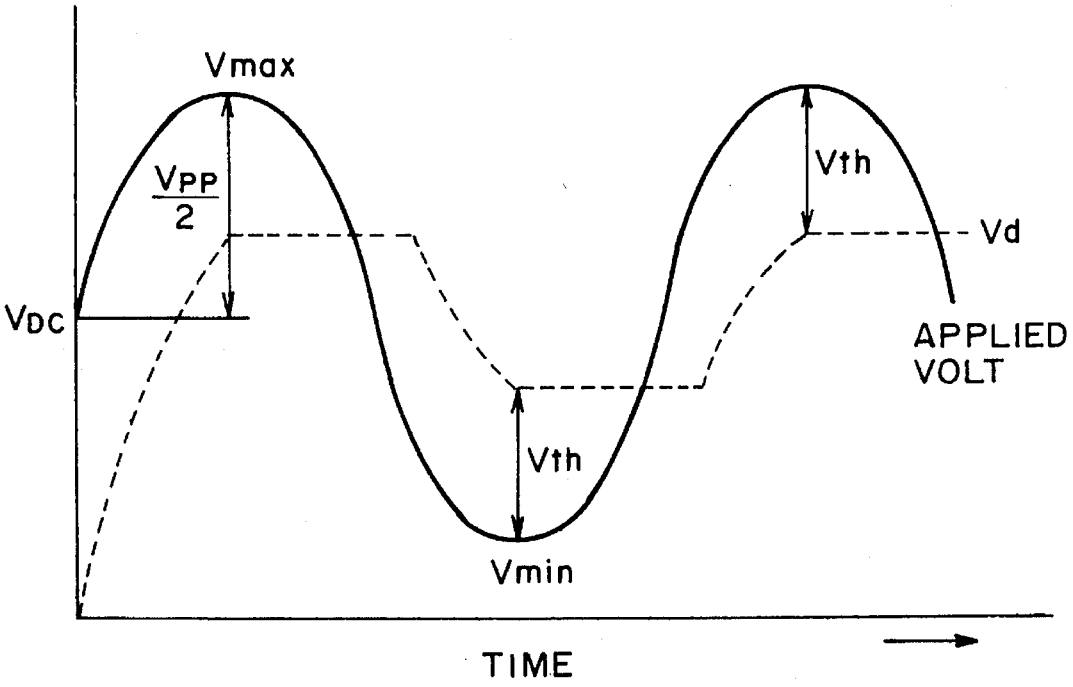
FIG. 7 shows an interrelation between the voltage applied to the charging mender and a surface potential of the photosensitive member in the case of the AC charging.

The first and second contact members 13 and are supplied with different voltages, and the electric currents are detected. The applied voltages are within the B range shown in FIG. 6. In this embodiment, it was 1000 V for the first contact member 13, and was 1500 V for the second contact member 14.

The structures of the printer of this embodiment is similar to that of the first embodiment, but the charging roller 1 was supplied with the following voltages were applied:

DC voltage: −700 V (corresponding to Vd)

AC voltage: peak-to-peak voltage Vpp=1900 V frequency f=550 Hz Sine wave

The film thickness d of the photosensitive member 2*a* is known as being 15 microns. During the measuring operation, the exposure lamp 12 is energized, and the surface potential of the photosensitive layer 2*a* was approximately 0 V when it passes by the first and second contact members 13 and for the thickness detection.

The electric current of 0.8 μA flows through the first contact member 13 supplied with a DC voltage of 1000 V, and an electric current of 1.6 μA flows through the second contact member 14 supplied with a DC voltage of 1500 V. From these currents, the calculated inclination of the V-I characteristic is $1.6\times10^{-3}$ μA/V.

As indicated by equation (4), the inclination of the V-I characteristic is proportional to the effective charging width L, and therefore, corresponds to 1/20 of the inclination of $32\times10^{-3}$ μA/V obtained in, the first embodiment under the same conditions.

From the foregoing, the end of the service life which is 15 microns thickness is discriminated when the calculated inclination is $1.6\times10^{-3}$ μA/V, and therefore, the warning signal is produced, in this embodiment.

Actually, when 12000 sheets were processed under the M/M conditions, the inclination exceeded $1.6\times10^{-3}$ μA/V, and therefore the warning signal is produced, and the operation of the printer is stopped. The thickness of the photosensitive layer was measured, and it was 15 microns. Thus, the properness of this method is effective.

As described, in this embodiment, the contact electrode members 13 and 14 are used exclusively for the photosensitive layer thickness detection. Therefore, the thickness of the photosensitive layer can be detected even during the image forming operation. Unlike the first embodiment, wherein the charging roller 1 for the primary charging is also used as the electrode for the thickness measurement, it is not necessary to supply two different voltages.

Third Embodiment (FIGS. 9–12)

(1) The structure of the printer as the image forming apparatus is the same as that of the first embodiment (FIG. 1)

However, the photosensitive member 2*a* is charged through AC charging. Since the AC charging is used in this embodiment, the charging roller 1 is supplied with an oscillating voltage in the form of a DC biased AC voltage. The use is made for the DC voltage, voltage V2=−700 V corresponding to the dark portion potential of the photosensitive member. The AC voltage has a peak-to-peak voltage which is not less than twice as high as the charge starting voltage Vth for the purpose of converting the potential level, In this embodiment, the peak-to-peak voltage was 1800 V (constant). For the purpose of avoiding the influence of an impedance change of the charging roller 1 (charging member), a control is possible to provide a constant AC current by which the AC current supplied to the charging roller is at a predetermined level.

(2) Detection of the thickness of the photosensitive layer 2*a*

In a usual electrophotographic process, the photosensitive member is electrically discharged during a pre-rotation period before start of the image forming operation in order to remove the electrical hysteresis of the photosensitive member. The discharging means for this purpose may be a pre-exposure means. However, in the apparatus using a contact type AC charging for charging the photosensitive member 2*a*, the potential of 0 V for the photosensitive member can be provided by the contact type charger with the DC voltage V1 of 0, using the potential converging effect, in which an AC voltage is superposed with a DC voltage of 0 V.

Figure 9:
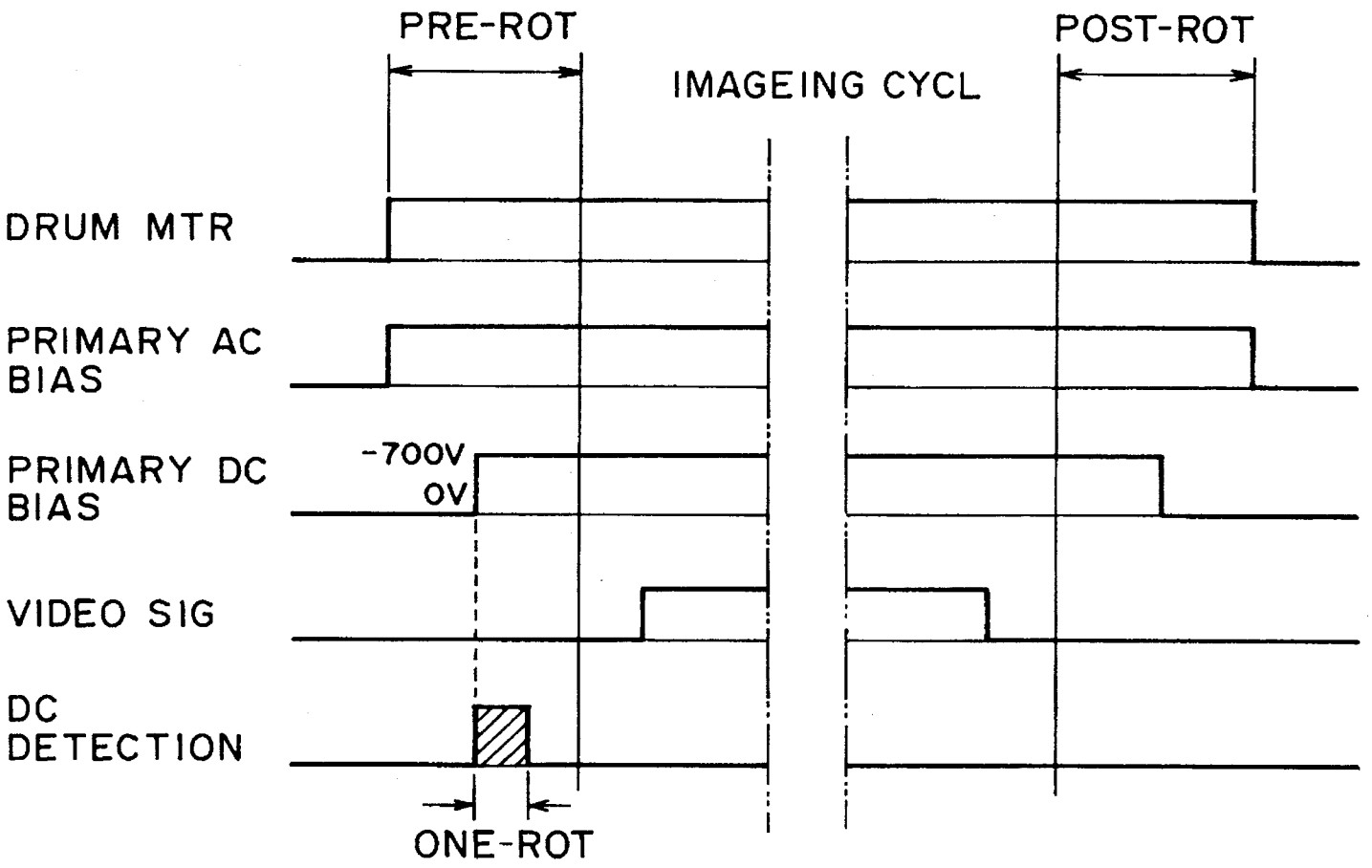
FIG. 9 shows a control sequential operations of a printer according to a third embodiment of the present invention.
Figure 10:
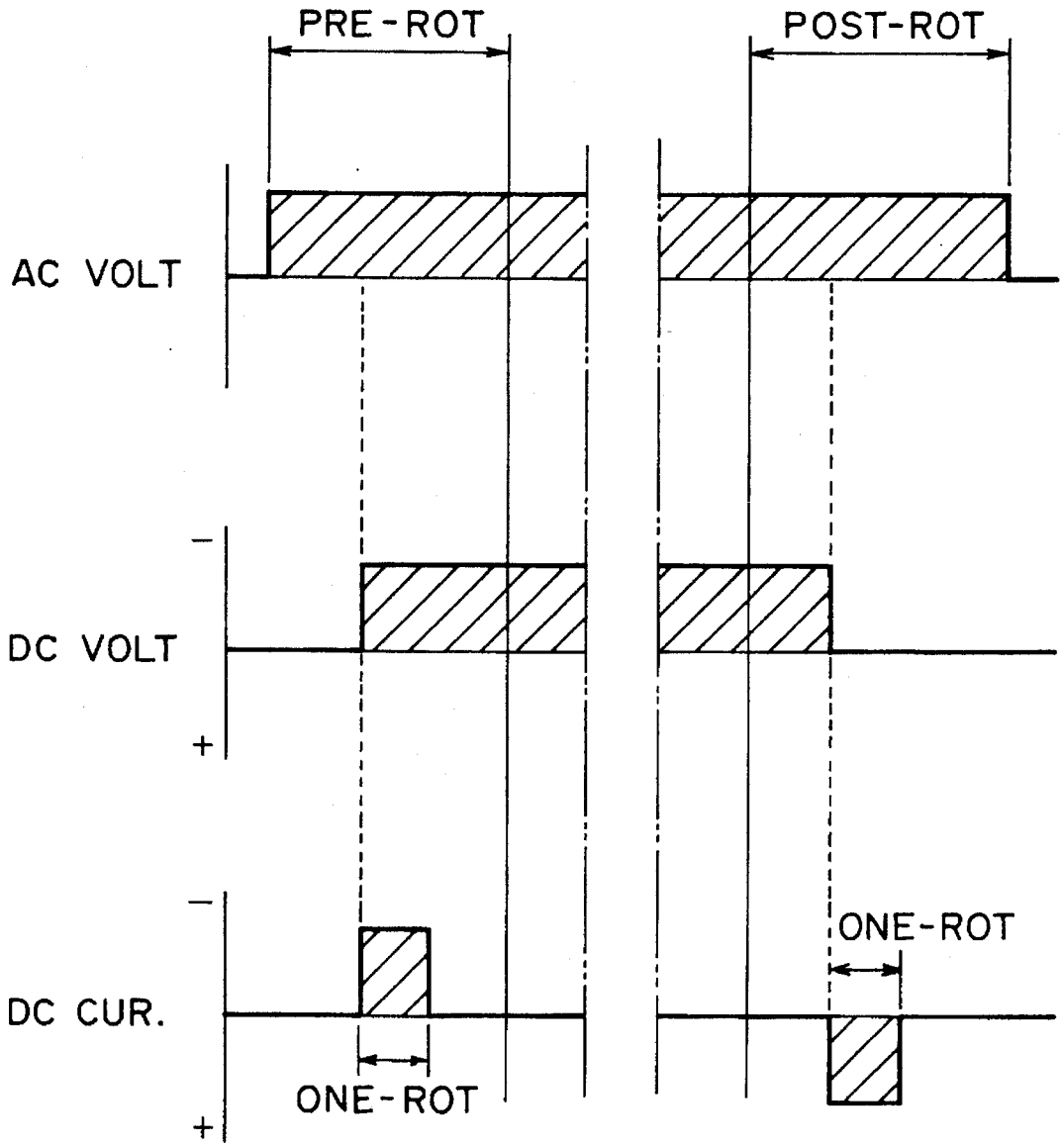
FIG. 10 shows interrelation among AC voltage, DC voltage and DC current.

For the purpose of image formation, as shown In FIG. 9, the DC bias voltage V2 is −700 V in this embodiment. As shown in FIG. 10, at this time, a DC current required for increasing the photosensitive member surface potential to Vcontrast, flows during one rotation of the photosensitive drum. Once it is charged to −700 V, the charging DC current does not flow unless the surface potential of the photosensitive member changes (without image exposure and with dark decay or the like neglected).

The charging DC current flowing at this time is theoretically calculated as follows.

When a thickness of the photosensitive layer 2*a* is d, a specific dielectric constant is ϵ, a dielectric constant in vacuum is ϵO, an effective charging width of the contact charging roller 1 is L, a process speed is Vp, initial photosensitive layer potential is 0 V, and the target potential is Vd, electrostatic capacity C is calculated, and the following equations result:

Amount of charge: $Q=\int I\times dt=C\times v\text{contrast}$

Charging current: $I=d/dt(C\times V\text{contrast})$ since dC/dt=ϵ×ϵO×L×Vp/d, and Vcontrast are Vd;

Charging current $I=\epsilon\times\epsilon O\times L\times Vp\times Vd/d$ (5)

Since ϵ, ϵO, L, Vp, d and Vd are deemed constant, one charging current I required for charging it from 0–Vd, is reversely proportional to d.

In this embodiment, ϵ=3, ϵO=$8.85\times10^{-2}$ (F/m), n=230 mm, Vp=95 mm/sec, Vd=700 (V), and therefore, I=16 μA when d=25 microns.

Figure 11:
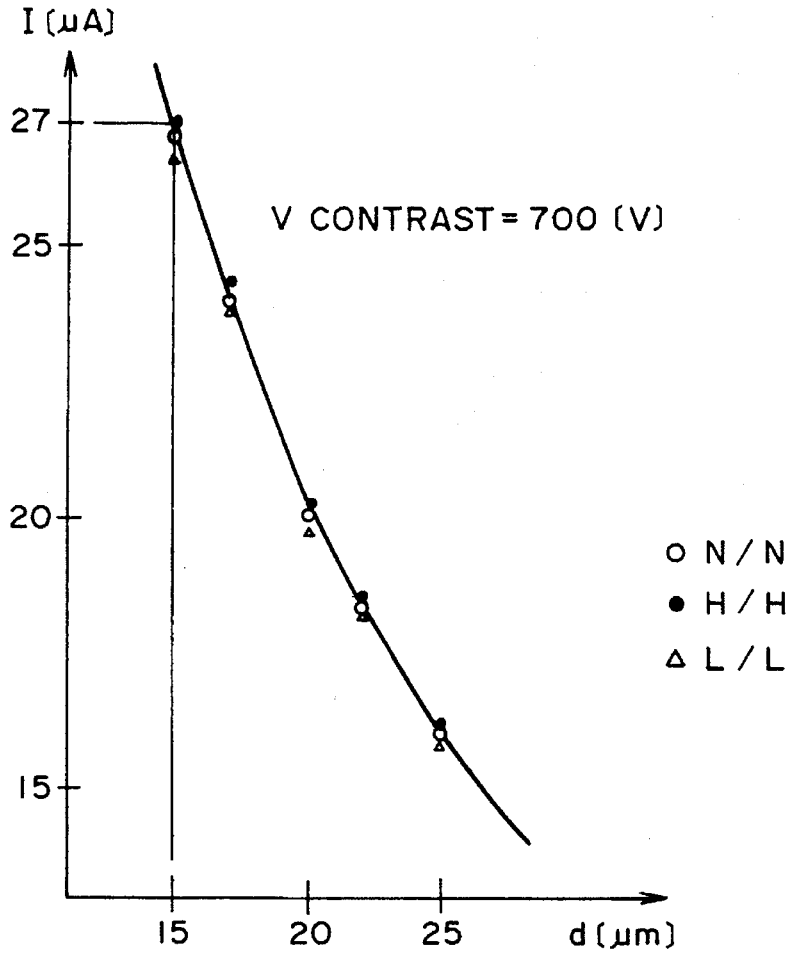
FIG. 11 shows an interrelation between the photosensitive layer thickness d and a DC current I.

FIG. 11 shows results of the relation d/I under the H/H condition, N/N condition and L/L condition, using photosensitive drums 2 having different thicknesses d of the photosensitive layer 2*a*. As be understood from this Figure, the relation d/I does not depend on the ambient conditions, theoretically.

On the basis of this results, the warning means for the service life of the photosensitive drum is actuated when the electric current exceeds to that corresponding to the CT film thickness of 15 microns which corresponds to the end of the service life of the photosensitive member 2*a*.

As shown in FIG. 11, the current I required for charging when the film thickness is 15 microns under any of the above ambient conditions, is 27 μA. As shown in the current detecting circuit 100 (thickness detecting circuit) shown in FIG. 12, the warning lamp 20 is energized when the voltage V between the ends of the resistor 16 having a resistance of 10 KΩ exceeds 0.27 V which corresponds to 27 μA.

More particularly the voltage V across a protection resistor 16 of 10 kΩ for the voltage source 8 is compared with a reference voltage 17 (Vref=0.27 V) by a comparator. When the comparator 18 produces a signal, the DC controller 19 actuates the warning lamp 20 indicative of the end of the service life. In this embodiment, the use is made with a value obtained by averaging the signals during one rotation of the drum after the DC bias voltage is increased from 0 V to Vd in synchronism with the sequential operation of the main assembly of the printer (FIG. 9).

In the axial test run, the voltage V increased with the number of test runs, and after 10000 sheets were processed, the CT layer was scraped by 10 microns so that the rest became 15 microns, at this time, the warning signal is proceed, and the improper image formation could be prevented beforehand.

Figure 13:
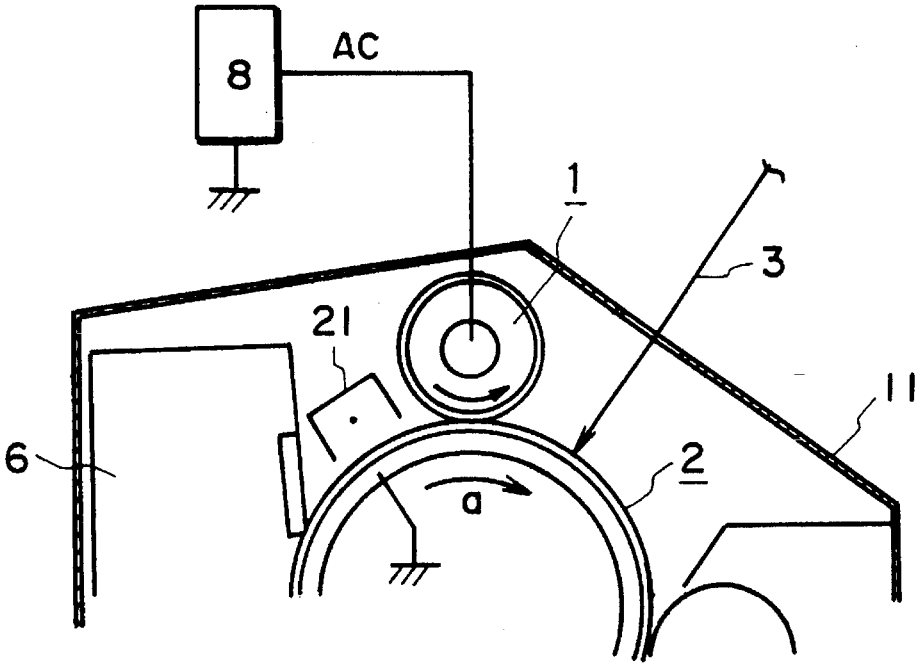
FIG. 13 shows a printer according to a fourth embodiment of the present invention.
Figure 14:
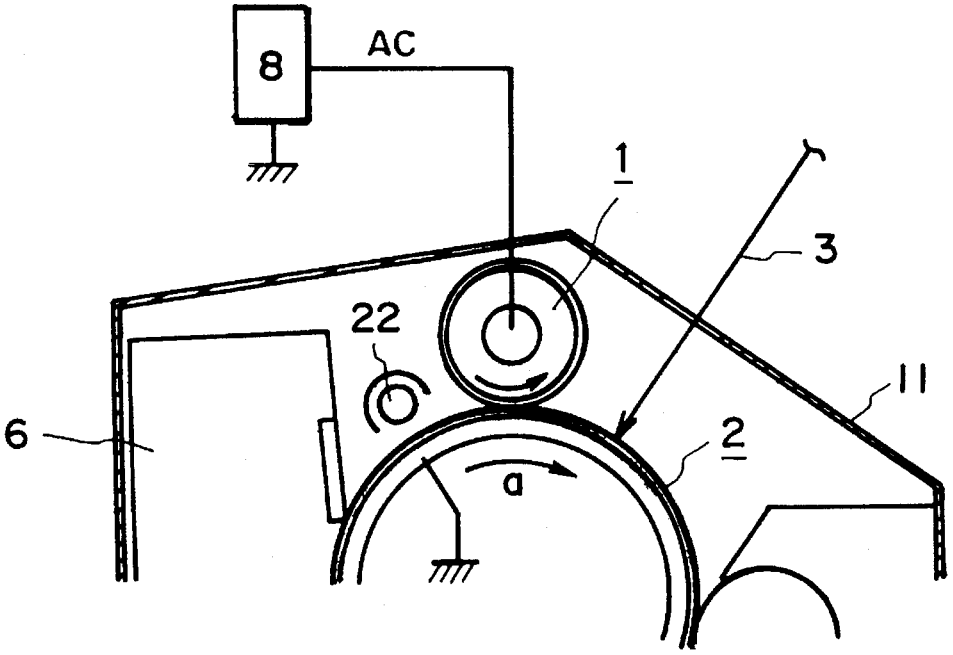
FIG. 14 shows a major part of another structure.
Figure 15:
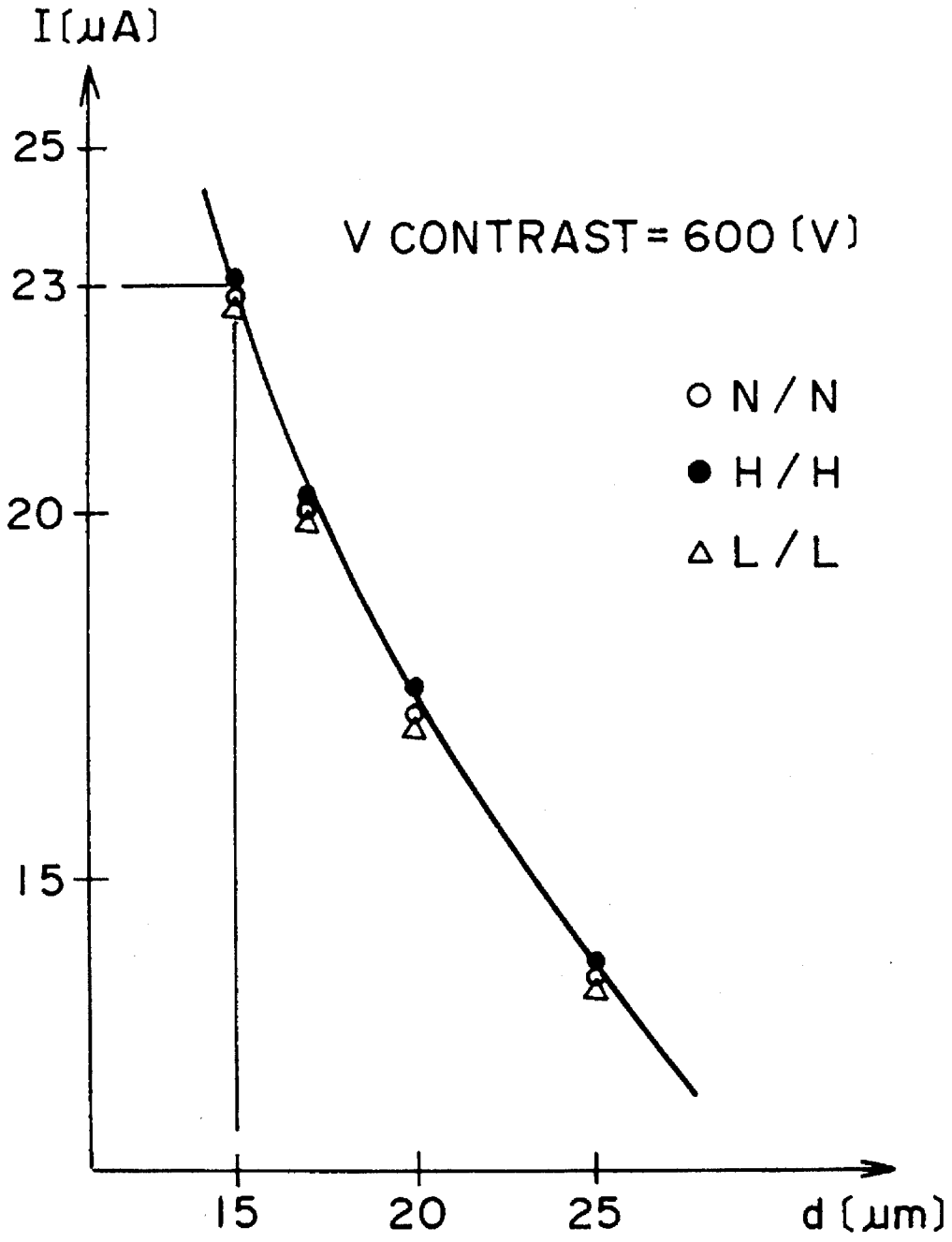
FIG. 15 shows an interrelation between a photosensitive layer thickness d and a DC current I.

Fourth Embodiment (FIGS. 13–15)

In this embodiment, before the AC charging operation for the photosensitive layer 2*a* by the charging roller 1, the surface potential of the photosensitive member is decreased by discharging means by pre-exposure AC corona charger or discharger. Then, the electric current flowing when photosensitive layer is charged by the contact charging roller 1 through AC charging process to a predetermined potential Vd.

As described in the third embodiment, in the method for determining the potentials V1 and V2 to be applied to the charging current, it is advantageous from the standpoint of the potential converging that the DC voltage is changed from V1 to V2 in the AC charging, but in the case of the apparatus not provided with the means for changing the DC voltage, can not do this. In the case that the discharging means is provided in addition to the charging roller 1, it is not necessary to change the DC voltage. Thus, in such a system, it is possible to provide the potential V1 by the discharger or pre-exposure means. More particularly, when the discharging means is in the form of an AC corona charger, the surface potential of the photosensitive member can be converged to 0 V approximately. Therefore, similarly to the third embodiment, the following voltages are selected:

V1=0

V2=−700

The electric current I flowing to charge to 700 V, it is possible to detect the thickness d of the photosensitive layer. In this embodiment, as shown in FIG. 13, an AC corona discharger 21 is disposed upstream of the charging roller 1 with respect to the rotational direction of the photosensitive drum as the discharging means. Simply by providing the discharging device 21, the same advantageous effects as in the first embodiment can be provided.

In FIG. 14, the pre-exposure device 21 is used in place of the above-described AC corona discharger 21. If the electric discharge is carried out by the pre-exposure, it is possible to always converge the before-charging potential to a predetermined level V1 by the exposure of the photosensitive layer before the charging operation. At this time, the photosensitive layer has a residual potential, and therefore, it is difficult to provide V1=0, and therefore, the exposure amount of the pre-exposure is such that the potential V1 is saturated to a certain extent so that it does not vary depending on the ambient or use conditions.

In this embodiment, the exposure amount is 0.5 μJ/cm$^2$, and the residual potential V1 was −100. Therefore, the electric current for charging from V1 to V2 always flows through the charging roller 1. In this case, Vcontrast=600 V, and therefore, the relation between the film thickness d of the photosensitive layer 2*a* and the DC current I for the charging, is as shown in FIG. 15, which is different from the case of the third embodiment. In this embodiment, the warning signal for the service life of the photosensitive drum is produced when the electric current exceeds 23 μA corresponding to the film thickness of 15 microns.

With this structure, the test run was carried out, and it has been confirmed that the warning signal is produced after 10000 sheets are processed irrespective of the ambient conditions.

Figure 16A:
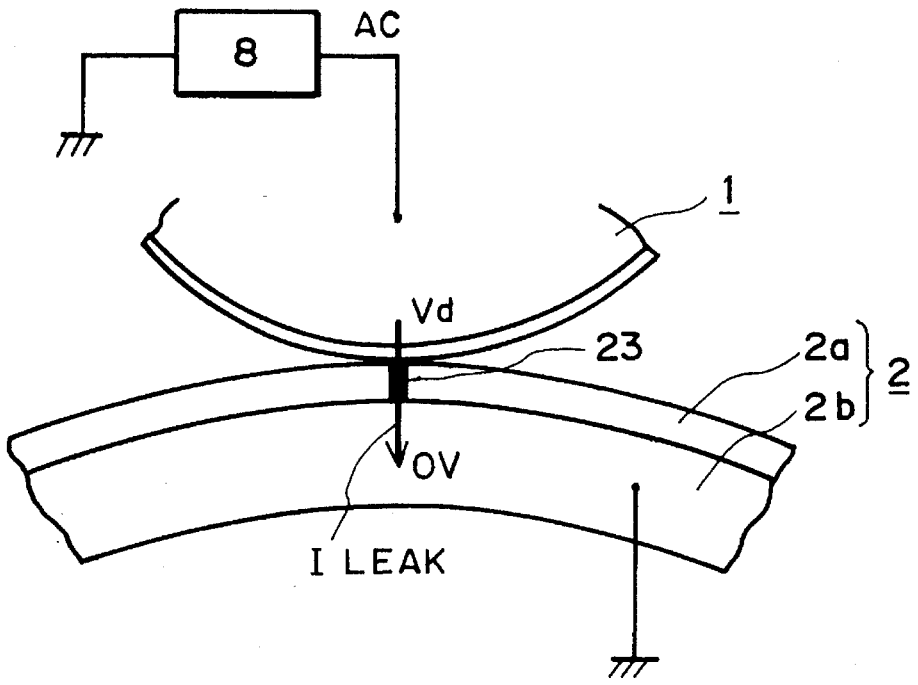
FIGS. 16A and 16B show occurrence and prevention of leakage current attributable to a pin hole in a printer according to a fifth embodiment of the present invention.
Figure 16B:
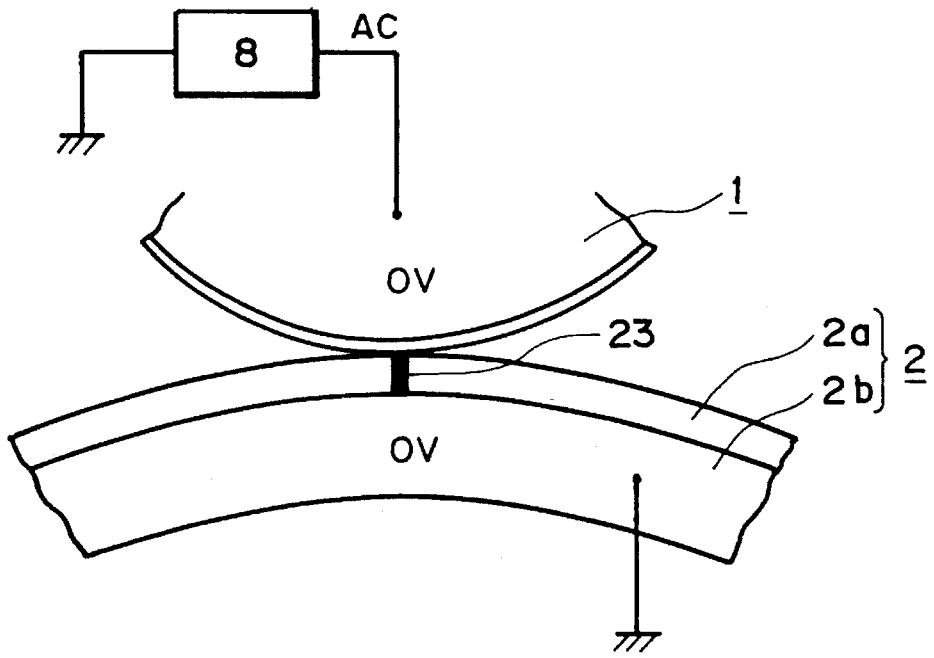
Figure 17:
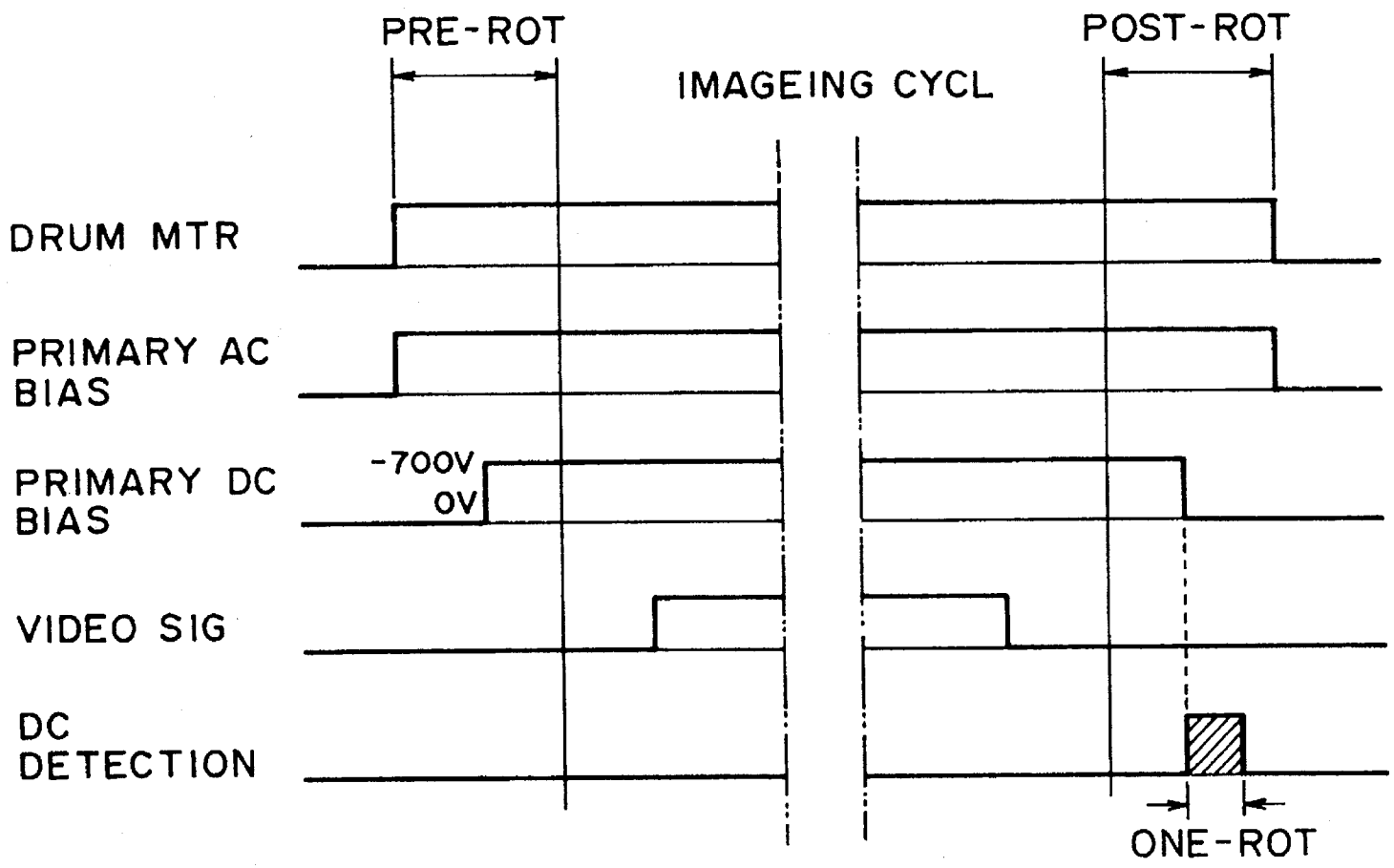
FIG. 17 shows sequential control operations.
Figure 18:
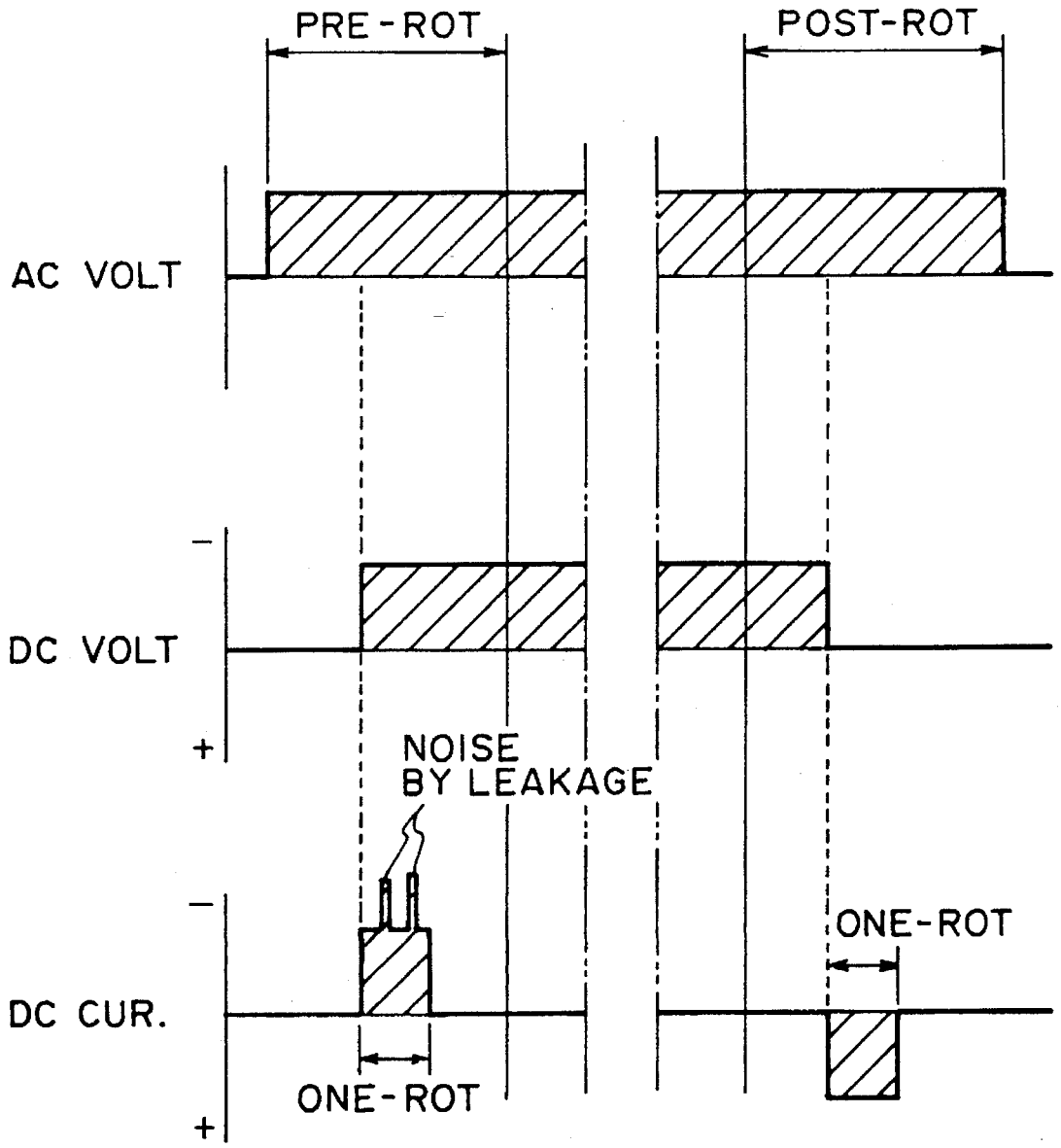
FIG. 18 shows an interrelation among an AC voltage, a DC voltage and a DC current.

Fifth Embodiment (FIGS. 16–18)

In this embodiment, similarly to the third embodiment, the photosensitive member 2*a* is charged through an AC charging process. The DC voltage is switched, and the flowing current I is measured to detect the film thickness of the photosensitive layer. The selected voltages are different from the third embodiment, and are:

V1=−700

V2=0.

With these voltages, the DC current flowing at the time of discharging is detected to detect the film thickness detection.

Theoretically, the electric current during the charging from 0 V–Vd V is the same as the current flowing during the discharging from Vd to 0. However when the photosensitive layer has a low durability defect 23 (FIG. 16) such as pin hole or the like, the possible erroneous measurement can be substantially avoided according to this embodiment.

In the case that the electric current is measured during the charging operation as in the third embodiment, if there is a pin hole in the photosensitive layer 2*a*, a leakage current I leak not contributable to the actual charging flows too much through this portion 23 (FIG. 16A) with the result of erroneous detection. In order to prevent this, in the third embodiment, the measurements during one rotation of the photosensitive drum are averaged after the start of the charging operation.

However, as in this embodiment, if the electric current during the discharging (from Vd to 0) is detected, the potential of the in hole portion 23 is 0 V which is the same as the voltage of the base plate 2*b* of the photosensitive member, and during the discharging, it is the same as the potential of the charging roller 1, and therefore, the DC current does not flow through the pin hole 23 (FIG. 16B). Then, it is possible to use the maximum measurement without averaging operation.

More particularly, as shown in FIG. 17, the electric current during one post-rotation for rendering the drum potential to 0 V to eliminate the potential hysteresis after the image formation. At this time, it is not required to consider the noise current through the pin hole 23, an averaging circuit is not required. The measuring circuit may be provided with a comparator circuit for comparing the maximum current in one direction (negative direction because the current is detected in the discharging operation in this embodiment) with a reference voltage Vref, and therefore, the cost can be reduced.

Actual image forming operation will be described. According to this embodiment, the photosensitive drum 1 having a pin hole 23 in the photosensitive layer 2*a* was subjected to the measuring operation. At the time of the starting of the charging in the pre-rotation, the current flows into the pin hole, and therefore, as shown in FIG. 18, the DC current waveform contains noise, and the measurement on the basis of the maximum involves error. However, the DC current waveform during the discharging in the post-rotation, the current does not flow through the pin hole, and therefore, no noise is produced. Thus, the sufficient measurement accuracy can be provided even on the basis of the maximum level measurement.

In the third, fourth and fifth embodiments, the photosensitive layer 2*a* is charged through AC charging process, and the DC current flowing when the photosensitive layer 2*a* is charged or discharged to a constant Vcontrast level, is measured, by which the thickness d of the photosensitive layer 2*a* is determined. When the determined thickness reduces beyond a predetermined level, the warning signal is produced to prevent improper image formation beforehand in an electrophotographic operation.

By doing so, the high accuracy film thickness detection is permitted only by measurement of a DC current without the necessity for particular means for measuring the film thickness, and therefore, a highly reliable operation is possible at low cost.

Figure 19:
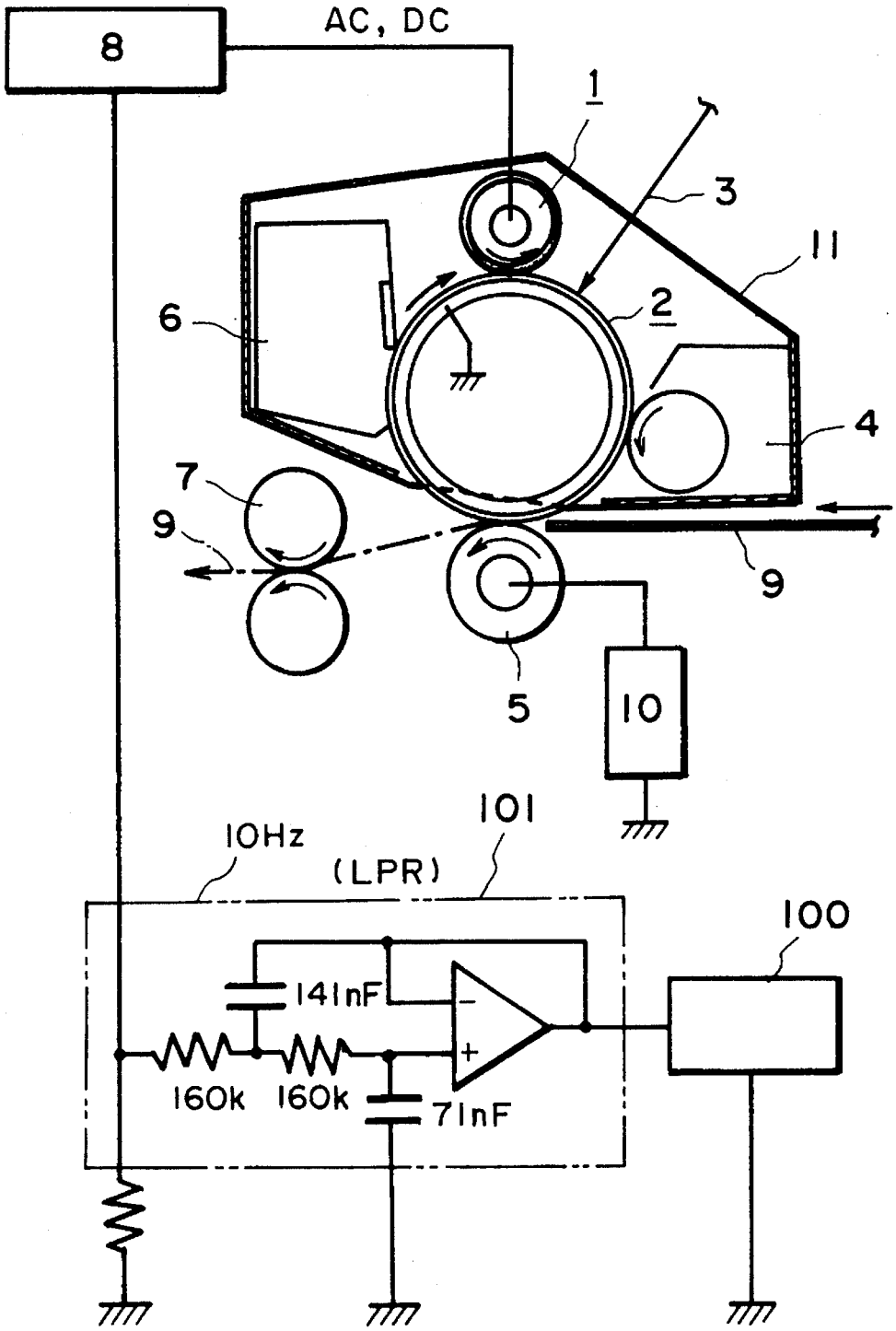
FIG. 19 shows a printer according to a sixth and seventh embodiment of the present invention.

Sixth Embodiment (FIGS. 19–21)

This embodiment is similar to the fifth embodiment in that the reduction of the accuracy of the photosensitive layer film thickness is prevented when the photosensitive layer 2*a* has low durability defect 23 such as pin hole.

In this embodiment, the charging roller 1 is supplied with the following voltage from a charging bias application voltage source 8 (FIG. 19):

DC voltage: −700 V

AC voltage: 200 Vpp, 550 Hz, sine wave

The rotating photosensitive drum 1 is charged (primary charging) to the potential Vd=−700 V through the Ac charging process.

The relationship between the film thickness d of the photosensitive layer 2*a* and the charging current I as provided by the following equations. When the thickness of the photosensitive layer is d, the specific dielectric constant thereof is ϵ, the dielectric constant In the vacuum is ϵO, the effective charging width of the contact charging member is L, and the process speed is Vp, then the electrostatic capacity C of the photosensitive member is calculated as follows:

Charging quantity: $Q=\int I\times dt=C\times Vd$ (Vd: charge difference amount)

Therefore,

Charging current: $I=d(C\times Vd)/dt$

Since dc/dt=ϵ×ϵO×L×Vp/d, Vd=constant Therefore,

Charging current: $I=\epsilon\times\epsilon O\times L\times Vp\times Vd/d$ (6)

In the equation (6), ϵ, ϵO, L, Vp and d are constant, and Vd=ΔV, and therefore:

$\Delta I=\epsilon\times\epsilon O\times L\times Vp\times Vd/d$ (7)

The value ϵ×ϵO×L×Vp×Vd/d is the inclination of the line V-I.

The applied DC voltages V to the charging roller 1 and the charging currents I flowing with such voltages applied, are measured at two points. From the measurements, the inclination of the V-I characteristic curve is calculated, and the thickness d of the photosensitive layer 2*a*.

In such a thickness detection for the photosensitive film, the measurement of the charging current I is required. If, however, the photosensitive layer 2*a* has a pin hole 23, the electric current is concentrated into the pin whole 23, as described in the fifth embodiment, since the charging operation is contact type. If this occurs, over current flows which is different from the actual charging current, and therefore, the film thickness d is not correctly detected.

The maximum electric current can not be used because of the particular current in the charging current detection for film thickness detection circuit 100. In this embodiment, however, the circuit is provided with a frequency filter, by which the particular current to permit the determination on the basis of the maximum level of the charging current to determine the film thickness.

The actual circuit is constructed as shown in FIG. 19 (low pass filter LPR (101)).

The time period for measuring the current for the film thickness detection corresponds to one rotation of the photosensitive drum so as to be free from the influence of noise, and therefore:

$\pi\times$drum diameter/Vp=$\pi\times30/95=1$ sec.

Figure 20A:
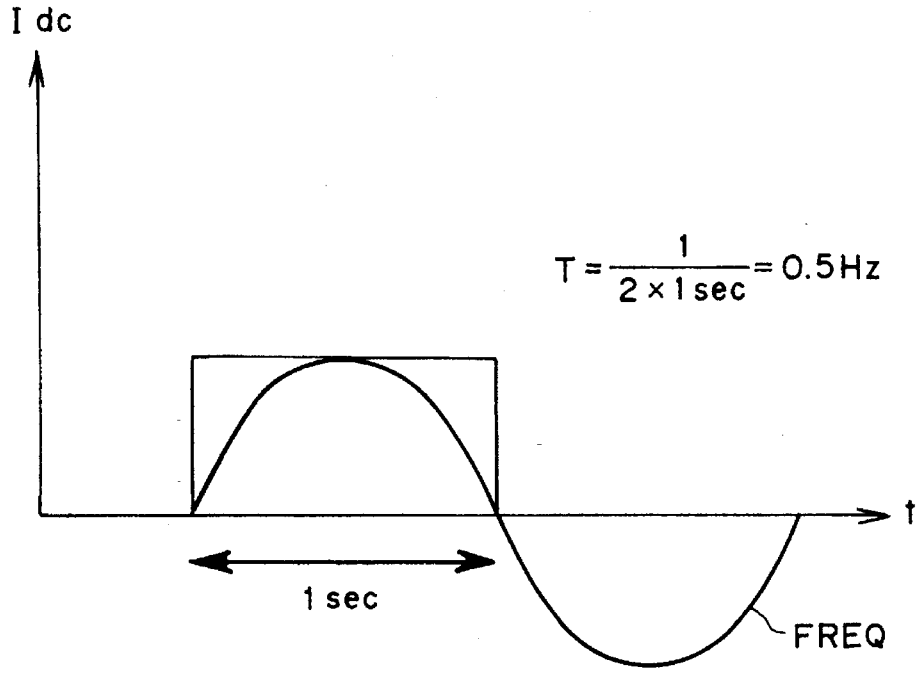
FIG. 20A and 20B show period and time elapse of the measuring current.
Figure 20B:
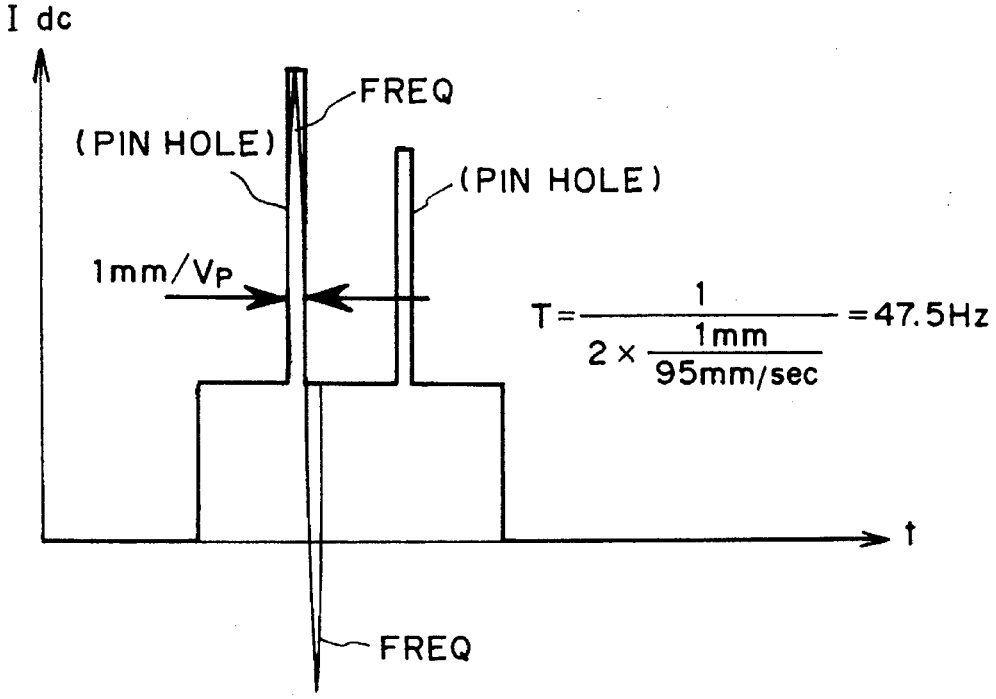

Since the electric current is theoretically rectangular wave, the frequency is as shown in FIG. 20A, that is, 0.5 Hz. For example, when the photosensitive layer 2*a* has a pin hole of 1 mm in diameter, for example, it is as shown in FIG. 20B. The frequency at this time is 47.5 Hz. Therefore in this case, at least the frequency component of 47.5 Hz is removed, and 0.5 Hz is passed by the frequency filter. Actually, there is a possibility that a larger pin hole is formed, and therefore, a margin is provided so that the filter LPF 101 shown in FIG. 19 removes the frequency component not less than 10 Hz.

In this embodiment, the low path filter LPF 101 is used, but it may be replaced with a BPF (band path filter). The current measuring circuit having the low path filter 101 is connected to a ground side of the voltage source 8 for applying the charging bias voltage to the charging roller for the purpose of avoiding a high voltage lead, influence to the charging and introduction of electric current other than the charging current.

Figure 21A:
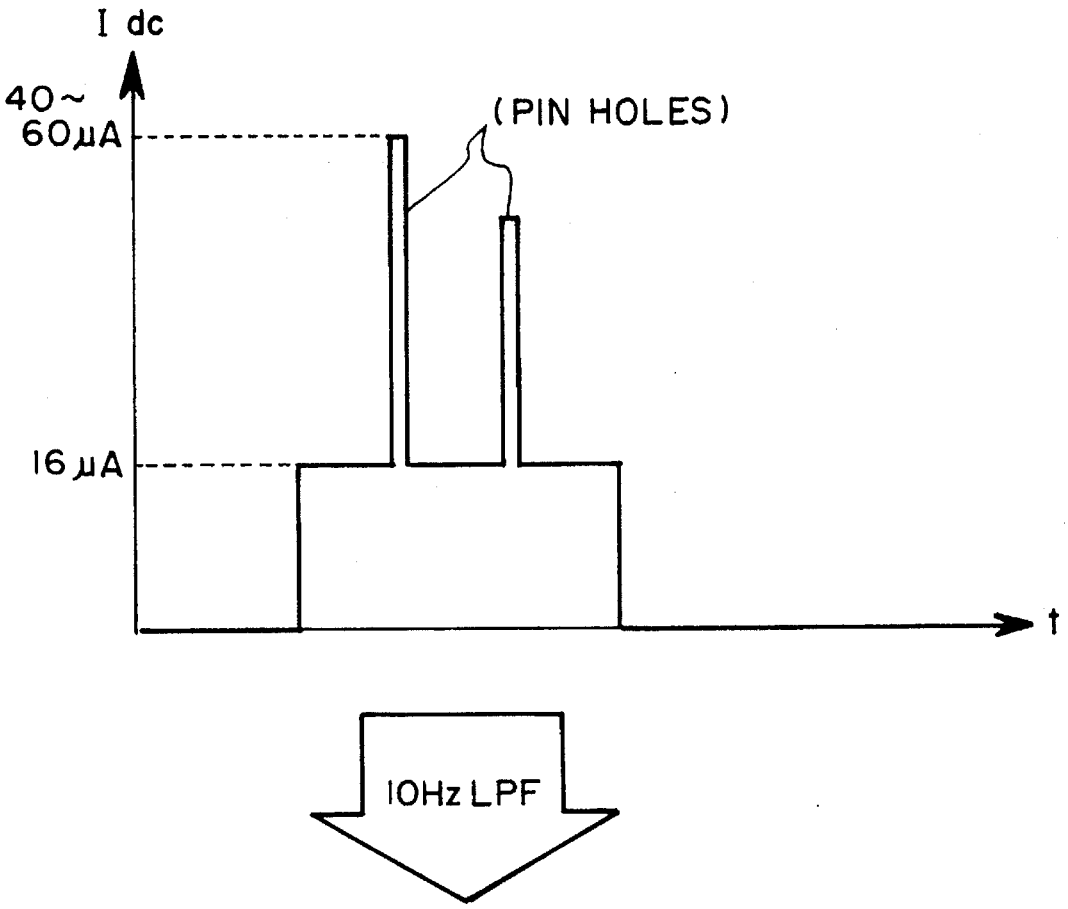
Figure 21B:
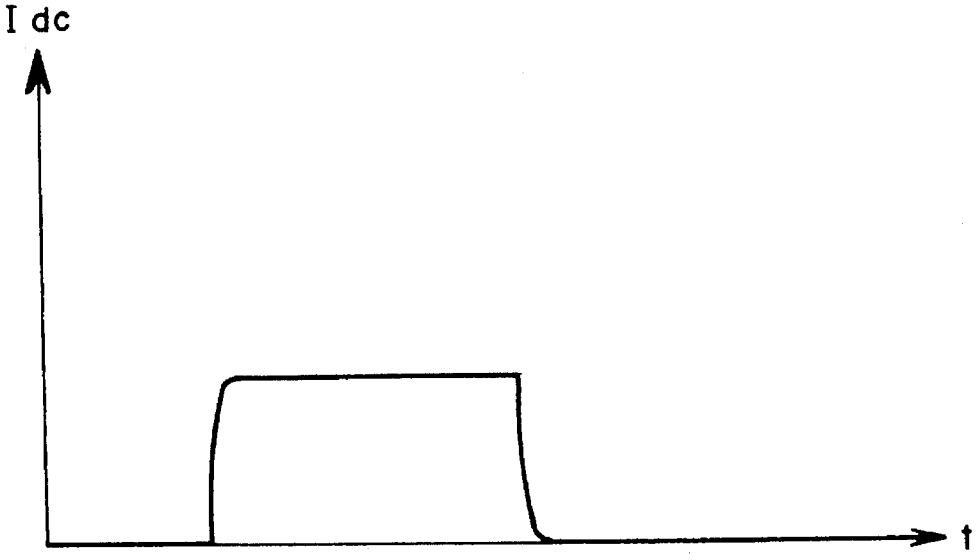

When the charging current is actually detected, the current I was 16 μA when a photosensitive layer having a film thickness of 25 microns is charged from 0 V to 700 V. As shown in FIG. 21A, approximately 40–60 μA was detected at the position of the pin hole when this embodiment is not used. However, using this embodiment, such a peculiar current is not detected, as shown in FIG. 21B.

Thus, when the charging current for the film thickness measurement is carried out, the influence of the pin hole or the like can be avoided.

Seventh Embodiment

In this embodiment, is similar to the sixth embodiment printer (FIG. 19), but the primary charging process for the photosensitive member by the charging roller 1 is carried out through a DC process.

As described hereinbefore, in the DC charging, the charging roller 1 is supplied with a voltage of Vd+Vth to provide the surface potential Vd on the photosensitive member. For this reason, the DC current through the pin hole becomes larger than that at the time of AC charging in the sixth embodiment. This means increase of error in the film thickness detection and more requires insertion of the filtering circuit.

The relation between the charging current and the film thickness d in the DC charging in the region above the Vth, and therefore, it is expressed by the equation (7) in the sixth embodiment. In other words, in the DC charging, the value ϵ×ϵO×L×Vp/d is the inclination of the V-I line in a graph in the region above the threshold Vth.

Therefore, in the region above the threshold Vth, the voltage V applied to the charging roller 1 and the charging current I at this time is detected at each of two points, and from the relation therebetween, the inclination of the V-I line is calculated so as to detect or predict the thickness d of the photosensitive member 2*a*.

Since the charging current measuring time and the frequency of the particular current through the pin hole are the same, and therefore, the same filter as in the sixth embodiment is usable.

The charging current was actually detected. When the photosensitive layer has a thickness of 25 microns, the electric current flowing when the surface potential is increased from Vd to 0 V (700 V), is 16 μA as in the sixth embodiment. The photosensitive layer surface was discharged to 0 V by a discharger before the charging, and the charging roller 1 was supplied with the following voltage:

$$Vth+Vd=640+700=1340\ V$$

The current flowing through the pin hole was approx, 170 ||A, but according to this embodiment, the peculiar current is not detected.

By doing so, the photosensitive layer thickness can be detected correctly even in the DC charging process in which the detection is significantly influenced by the pin hole or the like.

Thus, according to the sixth and seventh embodiments, the filter 101 is used so that the peculiar current into the DC current detecting circuit for the photosensitive layer thickness detection, can be prevented. This permits erroneous detection of the film thickness to accomplish the high reliability.

Figure 22:
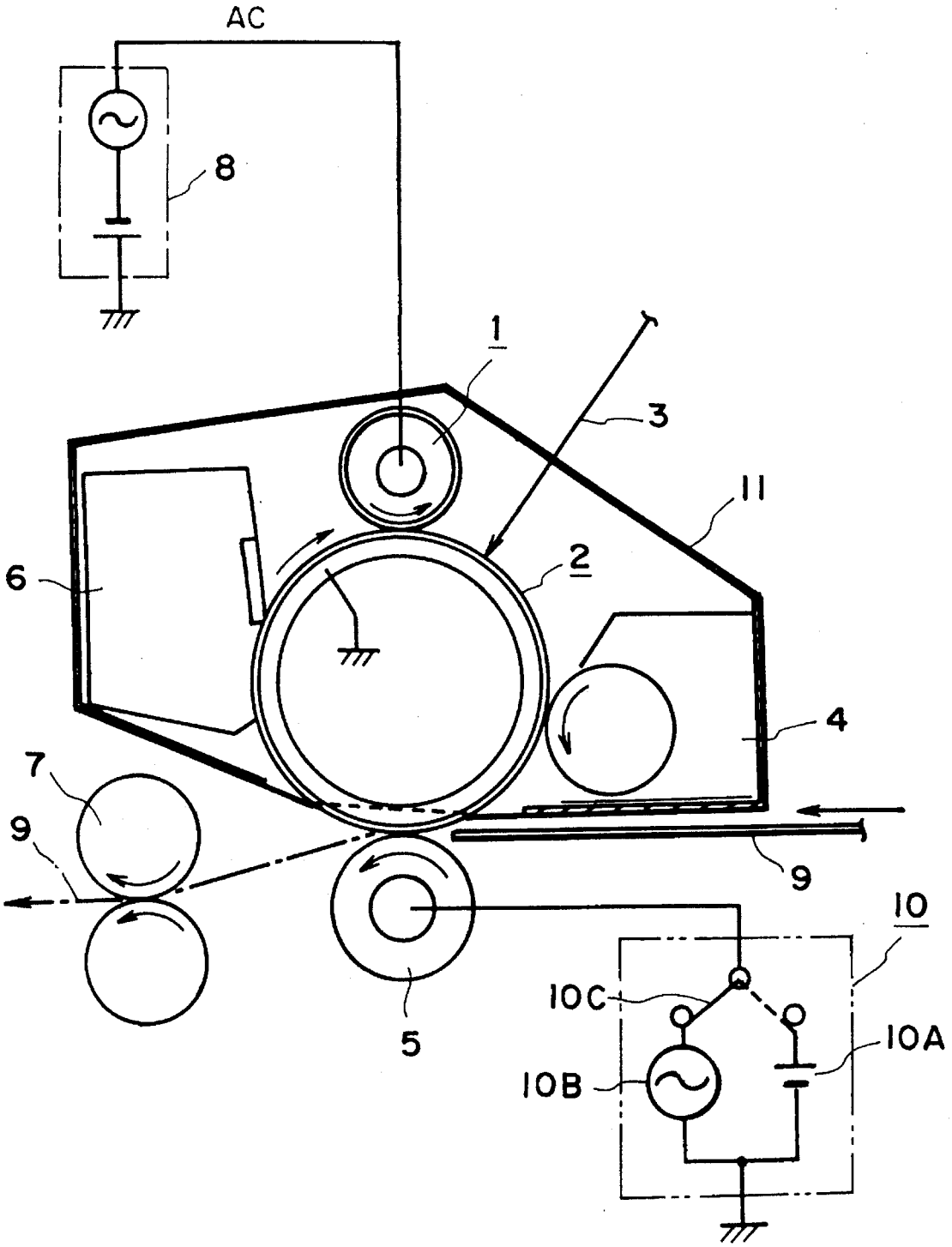
FIG. 22 is a schematic view of a printer according to an eighth embodiment of the present invention.
Figure 23:
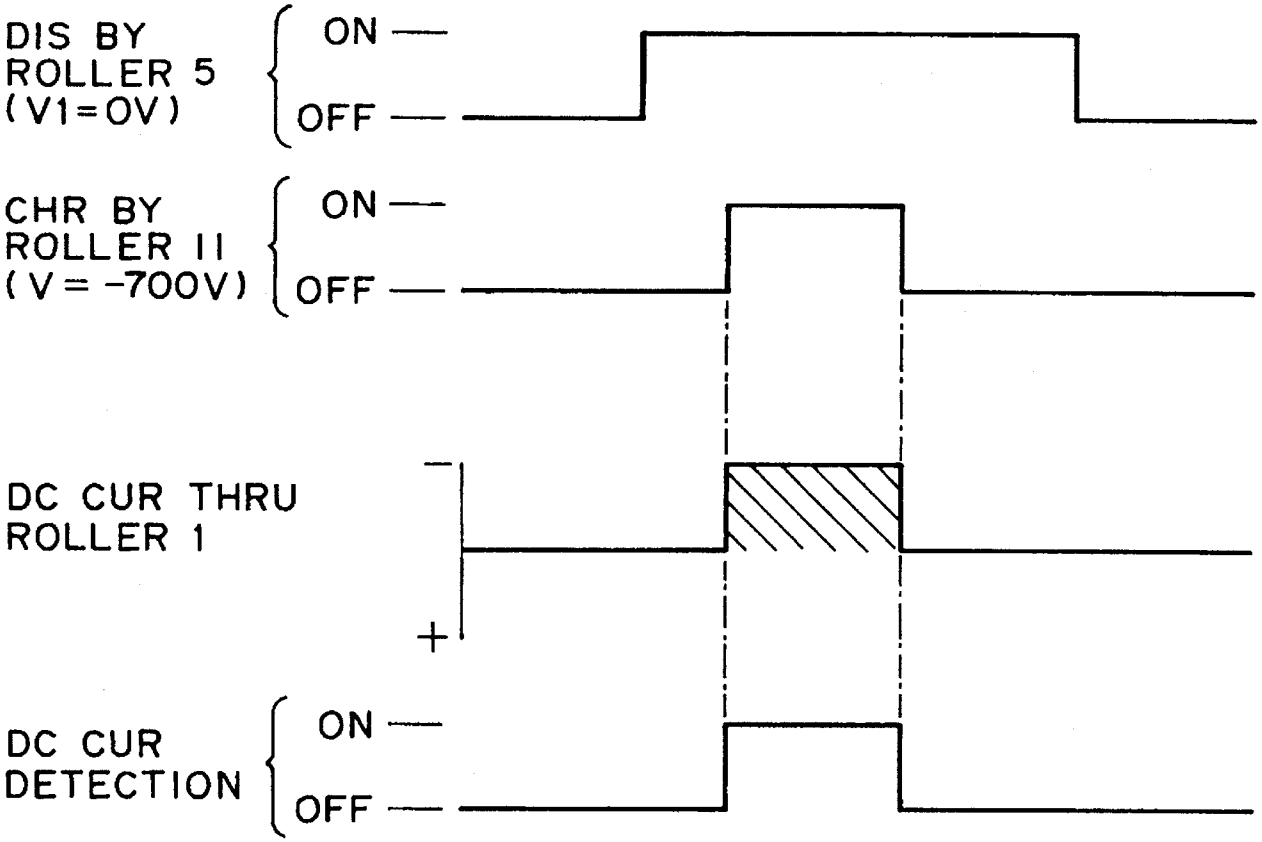
FIG. 23 shows an operational sequence for detecting a thickness of the photosensitive member.
Figure 24:
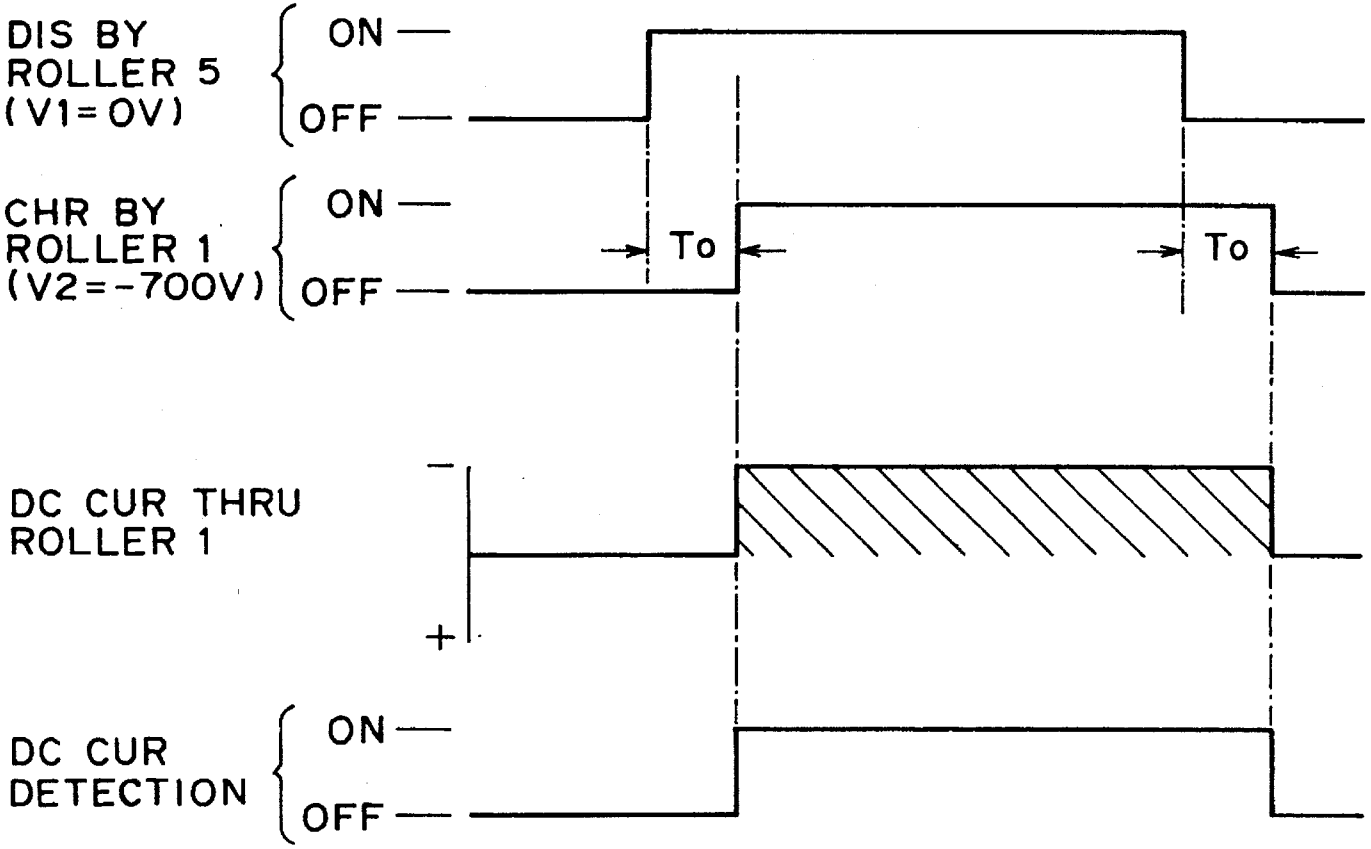
FIG. 24 shows an expanded sequential operations thereof.

Eighth Embodiment (FIGS. 22–24)

(1) Image forming apparatus

FIG. 22 shows the structure of the image forming apparatus used in this embodiment. The image forming apparatus of this embodiment has the same structure has the laser beam printer of the first embodiment (FIG. 1).

However, in this embodiment, the primary charging of the charging roller 1 to the photosensitive layer 2*a* is carried out through an AC process. A transfer bias applying voltage source 10 to a transfer roller 5 comprises a DC voltage source 10A and an AC voltage source 10B, and a switching circuit 10C for selectively switching the voltage sources 10A and 10B for the charging roller 1.

In the AC charging for the photosensitive layer 2*a*, the voltage source 8 applied to the charging roller 1 an oscillating voltage which is a superposed DC and AC voltage, that is, the DC voltage (V2=−700 V) corresponding to the dark portion potential of the photosensitive member and an AC voltage having a peak-to-peak voltage of constant 1800 V which is not less than twice as high as the charge starting voltage Vth for the conversion of the potential. In order to prevent influence by an impedance change to a charging roller 1, it is possible to control the voltage application under the condition that the AC current is constant.

The switching circuit 10C for the transfer bias application voltage source 10 is switched DC voltage source 101A during the transfer operation. To the transfer roller 5, a transfer DC voltage of 3 KV is applied from the DC voltage source 10A, so that the transfer operation is carried out. When a switching circuit 10C is switched to the voltage source 10B side, an AC voltage having 2000 Vpp is supplied from an AC voltage source 10B to the transfer roller 5, so that the transfer roller 5 functions as a discharge means to discharge the photosensitive layer 2*a* of the rotating photosensitive drum to V1=0 V.

In the other respects, the image forming process is the same as described with FIG. 1.

(2) Thickness detection of a photosensitive layer 2*a*

FIG. 23 shows a timing chart of thickness detecting operation for the photosensitive member 2*a*.

First, a switching circuit 10C of the transfer bias application voltage source 10 is switched to the AC voltage source 10B, so that the photosensitive member of the rotating photosensitive drum 2 is electrically discharged by a transfer roller 5 (V1=0 V). Then, the transfer layer 2*a* thus discharged is then charged to a potential V2=−700 V by a charging roller 2. At this time, to the charging roller 1, a DC current required to increase the surface potential of the photosensitive member from 0 V to −700 V (FIG. 23, the hatched portion). Except for this, no charging DC current flows unless the surface potential of the photosensitive member changes. Theoretical calculation for the DC charging is made by equation (5) described with the third embodiment.

More particularly, when the thickness of the photosensitive member is d, the specific dielectric constant thereof is ϵ, the dielectric constant in the vacuum is ϵO, the effective charging width of the contact charging roller 1 is L, the initial surface potential of the photosensitive layer is 0, and the target potential is Vd, then the electrostatic capacity of the photosensitive member is calculated, and the following equations result:

The quantity of charge: $Q=\int I\times dt=C\times V\text{contrast}$

Charging current: $I=d/dt\ (C\times V\text{contrast})\ dC/dt=\epsilon\times\epsilon O\times L\times Vp/d,\ V\ \text{constant}=Vd$ Charging current: $I=\epsilon\times\epsilon O\times L\times Vp\times Vd/d$ (5)

Since, ϵ, ϵO, L, Vp, d, Vd are deemed constant, the charging current I for charging from 0–Vd, is reversely proportional to d.

In this embodiment, ϵ=3, ϵO=$8.85\times10^{-12}$ (f/m), L=230 mm, Vp=95 mm/sec, Vd=700 V, and therefore I–16 μA when d=25 microns.

Actually, photosensitive drums 2 having different film thicknesses d of the photosensitive layer 2*a* are used, and d-I relations are measured under H/H, N/N and L/L conditions. The results are the same as in FIG. 11, and therefore, it is understood that the d-I relations does not depend on the ambient condition, as has been expected on the basis of theory.

In accordance with the results, photosensitive drum end of service life warning is sent when the electric current exceeds the level corresponding to the CT film thickness of 15 microns which is considered as being the end of the service life of the photosensitive layer 2*a*.

In FIG. 11, the electric current I required for the charging when the film thickness is 15 microns under any of the ambient conditions, is 27 μA. Similarly to the detection circuit 100 of FIG. 12, the warning lamp 20 on the front panel of the printer is turned on when the voltage V across the register (10 kΩ) exceeds 0.27 V corresponding to 27 μA.

More particularly, a voltage V across a protection register 16 (10 kΩ) of the voltage source 8 is compared with Vref=0.27 V which is a reference voltage. When an output of the comparator 18 is produced, the end of service life of the drum signal is supplied to the DC controller 19, and the warning lamp is turned on.

The detection of the DC current, as shown in FIG. 23, is carried out during the period corresponding to the hatched line portion in which the DC current flows.

In this embodiment, the charging period the charging roller 1 corresponds to one rotation of the photosensitive drum 1, and the DC current measured during this period is averaged.

In the actual test run, the voltage increased with increase of the number of the sheets processed, and the CT layer was worn by 10 microns, when 10000 sheets were processed under any of the above conditions. When it becomes 15 microns, the warning is produced, and therefore, the improper image formation due to the scraping of the CT layer can be prevented beforehand.

The above-described sequential operation is carried out after the main switch of the image forming apparatus is actuated in the pre-rotation period or post-rotation period in the image forming process.

As shown in FIG. 24, the on-off timing of the charging roller 1 can be expanded from the discharging on-off timing by the transfer roller 5 to a point shifted by T0 which is the time period in which the portion of the photosensitive member 2*a* discharged at the charging position by the charging roller 1. Similarly, the current detection flowing through the charging roller 1 can be expanded in the same manner.

The discharge on period of the transfer roller 5 is selectable.

Figure 25:
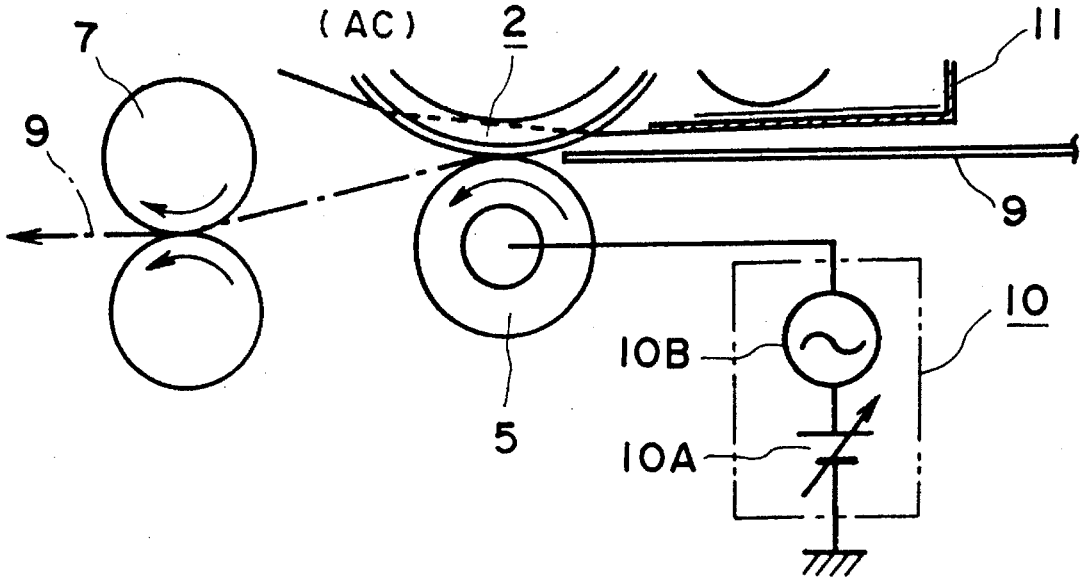
FIG. 25 is a schematic view of a printer according to a ninth embodiment of the present invention.

Ninth Embodiment (FIG. 25)

In this embodiment, the transfer bias application voltage source 10 in the printer of the eighth embodiment (FIG. 22) is modified to be a voltage source having a variable DC voltage source 10D and an AC voltage source 10B which are connected in series. In the other respect, it is the same as the apparatus of FIG. 22.

In this embodiment, during the transfer operation, an oscillating voltage provided by superposing a DC voltage of 3 KV and an AC voltage of 2000 Vpp is supplied from a voltage source to the transfer roller 5, so that the image transfer operation is carried out.

When the transfer operation is not effected, the variable DC voltage source 10D produce 0 V, by which the transfer roller 5 is supplied only with the AC voltage of 2000 Vpp from the AC voltage source 10B, so that the transfer roller 5 functions as a discharging member, so that the photosensitive layer 2*a* of the rotating photosensitive drum 2 is discharged to V1=0.

Thus, in this embodiment, similarly to the eighth embodiment, the transfer roller 5 is able to electrically discharge the surface of the photosensitive drum 2 to V1=0, and therefore, the photosensitive layer thickness detection operation as shown in FIG. 23 can be used.

Figure 12:
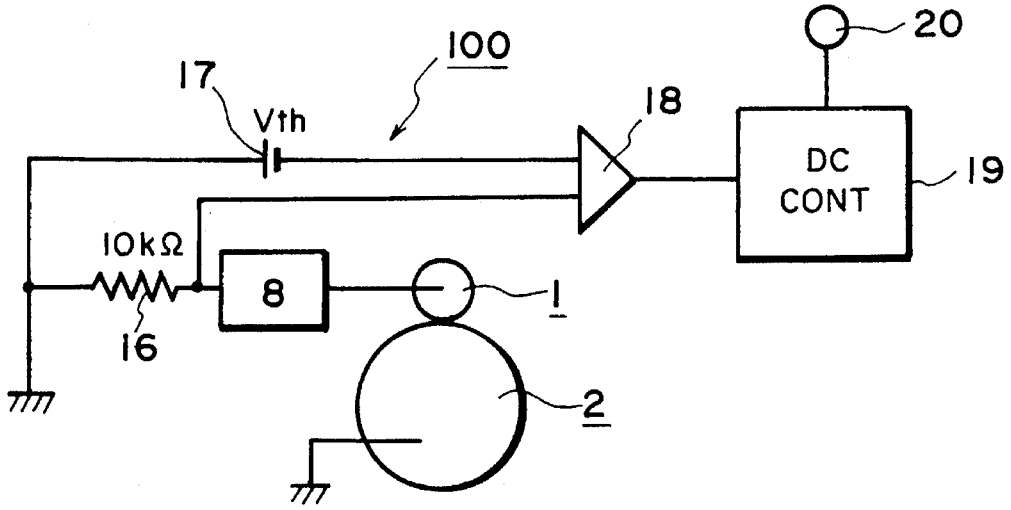
FIG. 12 schematically shows a DC current detecting circuit.

In this embodiment, the surface potential of the photosensitive member is charged to V2=−700 V by the charging roller 1, and the test run is executed using the detection circuit 100 shown in FIG. 12. The warning signal was produced after 10000 sheets were processed.

In the eighth and ninth embodiments, a combination of an AC contact charging device 1 and the transfer device 5 are used. The DC current flowing through the contact charging member is detected when the member to be charged is charged (or discharged) to the second potential by the contact charging device after the member to be charged is charged (or discharged) to the first potential by the transfer device 5. By this, the thickness of the member to be charged is detected, and if it decreases beyond a predetermined level, a warning signal is produced so as to avoid the improper image formation beforehand.

In all of the foregoing embodiments, the photosensitive drum 2 has the negative charging polarity. However, the photosensitive drum 2 may be of positively chargeable type, or chargeable to both polarities. In addition, the transfer device is in the form of a transfer roller 5, but it is not limited to the transfer roller 5 and may be a transfer belt or another transfer device.

The charging device was in the form of a charging roller 1, but it may be another charging member capable of performing the contact type DC process or contact type AC process.

The description will be made as to other embodiments.

(1) In the contact type charging system, the current flowing through the contact charging member, unlike the corona charger, is all supplied to the photosensitive member (the member to be charged), and therefore, on the basis of the electric current, it is possible to detect the state of the photosensitive member including a thickness of the photosensitive layer, the potential $V_L$ of the exposed portion of the photosensitive layer.

More particularly, the charging DC current $I_{DC}$ is measured when the surface potential of the photosensitive member is changed by Vcontrast by the contact charging member. Then, the film thickness of the photosensitive layer which is reversely proportional to the current is determined. As described hereinbefore, when the contact AC process is used, it is possible to converge the potential to a predetermined potential $V_D$, and therefore, the voltage Vcontrast can be maintained constant irrespective of the ambient conditions or the like, and therefore, it is advantageous, This will be described in more detail. The measuring principle for the state of the photosensitive member depends on the measurement of the DC current flowing through the contact charging member when the potential of the photosensitive member is changed by a predetermined level Vcontrast.

The DC current required for changing the surface potential Vcontrast of the photosensitive member is theoretically given as follows. When the surface potential is changed by Vcontrast, the following equations result, where C is an electrostatic capacity of the photosensitive member to be charged:

The charge quantity: $Q=\int I\times dt=C\times V\text{contrast}$

Charging current: $I=d/dt\ (V\text{contrast})$

Since, $dC/dt=\epsilon\times\epsilon O\times L\times Vp/d$,

Charging current: $I=\epsilon\times\epsilon O\times L\times Vp\times V\text{contrast}/d$ (5)

Therefore, the charging current I is reversely proportional to d and proportional to Vcontrast.

For example, when it is charged from a potential 0 V after the discharge to the charge potential $V_D$, the film thickness d can be detected on the basis of the DC current I if the charged potential $V_D$ is known.

When the film thickness d is known, the potential $V_L$ of the exposed portion can be determined on the basis of the DC current I flowing when photosensitive layer is charged from the exposed portion potential $V_L$ to the charged potential $V_D$.

(2) In the following embodiments, the uniformly charged photosensitive member is exposed to light to provide a light portion potential $V_L$. Then, the contact charging operation is carried out to change the potential to a known potential level V2, so that the potential of the photosensitive member is changed by a predetermined degree Vcontrast ($|V_L-V2|$). The DC current (charging DC current) $I_{DC}$ flowing through the contact charging member is measured. On the basis of this, the exposed port,on potential $V_L$ is detected. By doing so, it is possible to detect the condition of the photosensitive member, the using condition, the manufacturing variation of the sensitivity.

When the exposed portion potential $V_L$ is different from the predetermined level, the exposure means is controlled. As for the exposure means control, a feed back system is usable to provide a predetermined potential $V_L$, or it is possible to intentionally converge it to a different level.

Since the charging DC current $I_{DC}$ is not a function only of the Vcontrast, but is dependent on the thickness of the photosensitive member. Therefore, if the thickness d of the photosensitive layer is detected beforehand to increase the measurement accuracy.

In the following embodiments, the charging member is a contact type charging member, and therefore, the current flowing into the contact type charging member from the voltage source is the DC current which is actually contributable to the charging, and therefore, the measurement of the DC charging current $I_{DC}$ is possible at an upstream position of a load including the photosensitive member, which has been difficult in the conventional system.

With this structure, the erroneous current due to the developing device, the transfer means, the toner cleaning which has been a problem in a conventional device using the corona charger, can be easily removed, so-that the state of the photosensitive member such as the exposed portion potential $V_L$ or the photosensitive film thickness d or the like, can be accurately detected.

(3) In the following embodiments, the image forming process condition is controlled (changed) on the basis of the charging DC current $I_{DC}$ thus detected, by which the problem of the improper image formation or the like can be reduced or removed.

(4) In the following embodiments, in an image forming apparatus having a transfer means for transferring onto a transfer material an image formed on the photosensitive member, there is provided means for detecting the exposed portion potential $V_L$ from the charging DC current $I_{DC}$ detected during the DC current measurement, the transfer means is controlled such that the potential change at the exposed portion potential $V_L$ is substantially 0 before and after the passage through the transfer position. By doing so, it is possible to detect the ambient condition of the photosensitive member, the use condition, the manufacturing variation of the sensitivity.

When the exposed portion potential $V_L$ is different from the desired level, the exposure means is controlled. The control of the exposure means may be such that the feedback control is effected to provide the desired potential level $V_L$ or may be such that the potential is converged to a different level intentionally.

The current $I_{DC}$ is not a function only of the potential Vcontrast and is dependent on the thickness of the photosensitive layer. Therefore, the thickness d of the photosensitive member is detected beforehand, by which the measurement accuracy is further improved.

(5) In an image forming apparatus having transfer means for transferring onto a transfer material the image formed on the photosensitive member, the charging means for the photosensitive member is in the form of a contact type AC charging, and a means is provided for measuring a charging DC current $I_{DC}$ through the contact charging member when the photosensitive member is charged or discharged by a predetermined potential difference Vcontrast. At least during the current measurement, the voltage applied to the transfer means is so selected that the potential of the photosensitive member is not changed between before and after the passage through the transfer position, by which the thickness d of the photosensitive layer is accurately determined on the basis of the DC current $I_{DC}$ through the contact charging member, and therefore, the service life of the photosensitive member can be detected accurately.

(6) As described above, the measurement of the film thickness d and the exposed portion potential $V_L$ for a photosensitive member (the member to be charged) is accomplished using a contact type charging device without difficulty, without using particular device and at low cost. When, however, this is used with an electrophotography, there are some points to be improved because of the electrophotographic process.

In an electrophotographic machine, a density controller to permit an user to adjust the image density and/or image line width (a level of the image density will be called "F value). As for an example of such means in the case of a reverse development, a development contrast which is a difference between an exposed portion potential $V_L$ and a developing bias voltage $V_{DC}$, is changed. If the development contrast is large, the image density is high, and the line width is thick. If it is small, the image density is low, and the image line is thin.

In order to prevent reverse fog or non-uniform charging due to the change of the reverse contrast which is a difference between the development bias voltage $V_{DC}$ and the charge potential $V_D$, the charging potential $V_D$ is changed when the development bias voltage $V_{DC}$ is changed depending on the F value.

Figure 26:
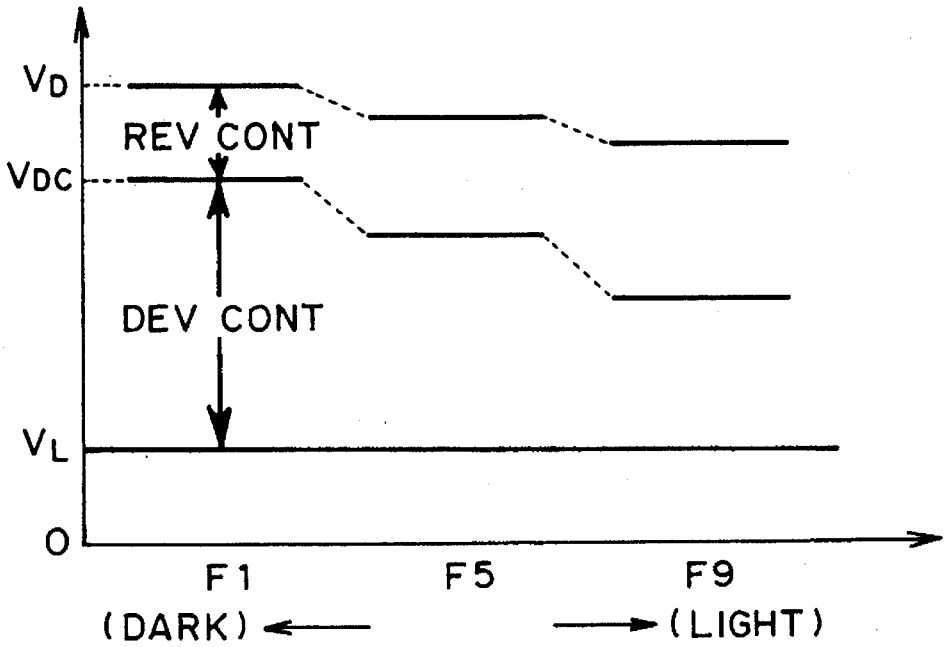
FIG. 26 illustrates control operation for the developing bias voltage and the charged potential when the image density setting is changed.

Generally, as shown in FIG. 26, the settings of the development bias voltage $D_{DC}$ and the charge potential $V_D$ are changed. As a typical example:

F1 (maximum image density):
$V_{DC1}$=−600 V
$V_{D1}$=−750 V

F1 (intermediate image density):
$V_{DC5}$=−500 V
$V_{D5}$=−700 V

F1 (minimum image density)):
$V_{DC9}$=−400 V
$V_{D9}$=−650 V

Corresponding to the F values:
$V_D$=−650—750 V
$V_{DC}$=−400—600 V

The settings are made within the above range.

When the state of the photosensitive member is detected by the contact type charging member, the V contrast in equation (1) in the above paragraph (1) since the charge potential $V_D$ changes corresponding to the F value. Therefore, the film thickness d and the exposed portion potential $V_L$ of the photosensitive member are not correctly calculated simply by measuring the charging current I.

Therefore, the state of the photosensitive member can be correctly detected using the contact type charging, by detecting the DC voltage applied to the contact type charging member during the charging current measurement, and therefore, the improvement is accomplished.

(7) On the other hand, with respect to (6), when the stare of the photosensitive member is to be detected by the contact type charging member, the Vcontrast in equation (1) in the above paragraph (1) since the charge potential $V_D$ changes corresponding to the F value. Therefore, it is desired to use a circuit for measuring the charge potential $V_D$ depending on the F value in addition to the circuit for measuring the charging current I. Therefore, the measuring device becomes more complicated, and the cost is high.

By switching the voltage applied to the contact charging member between a voltage applied during the image formation and a constant voltage $v_M$ applied to the DC charging current measurement, the state of the photosensitive member can be detected using the contact type charging, irrespectively of the various parameters of the electrophotographic process. Therefore, the above desired improvement is accomplished.

10th Embodiment

Figure 27:
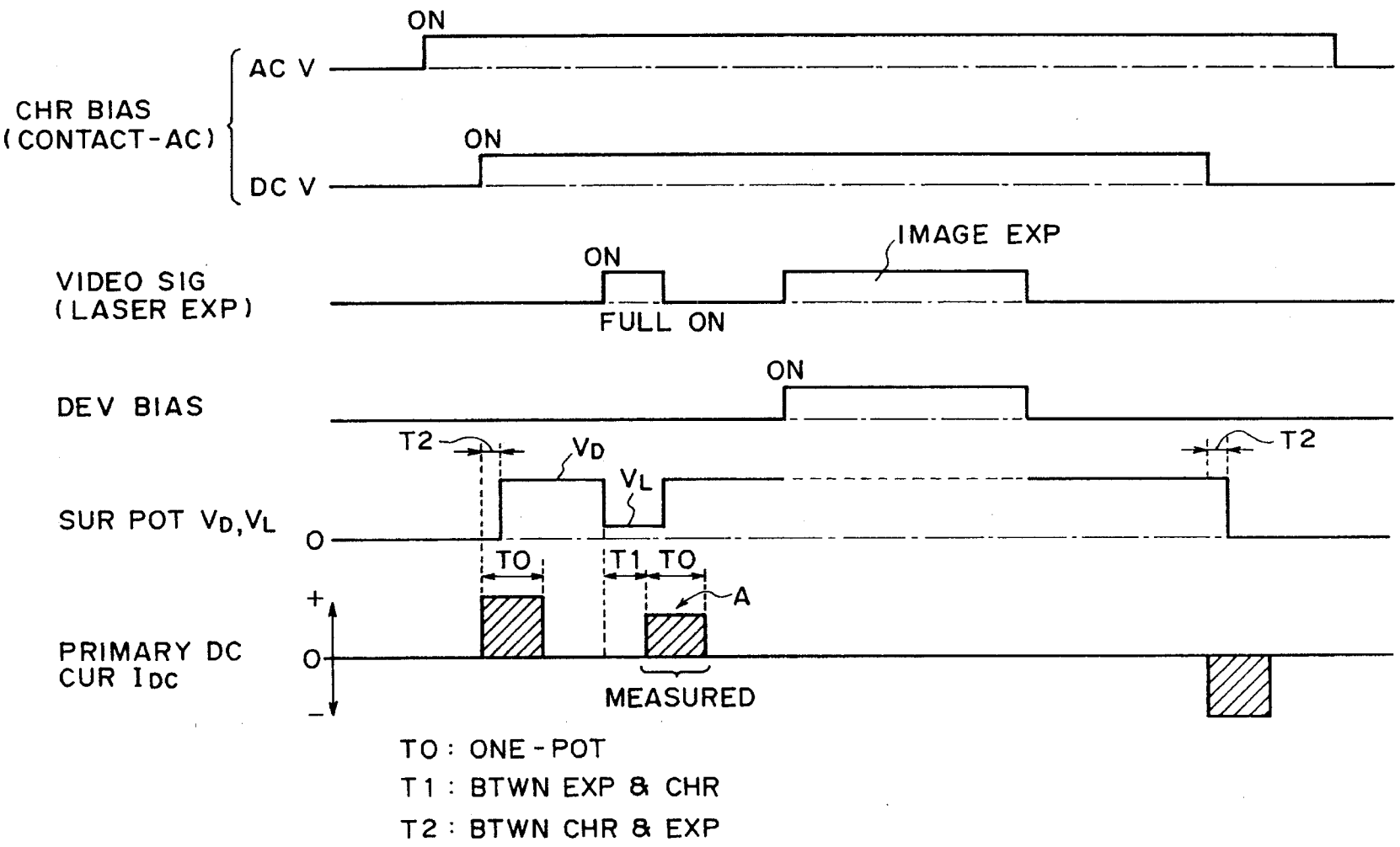
FIG. 27 illustrates sequential operations for charging DC current measurement and for detection of the potential of the exposed portion.
Figure 28:
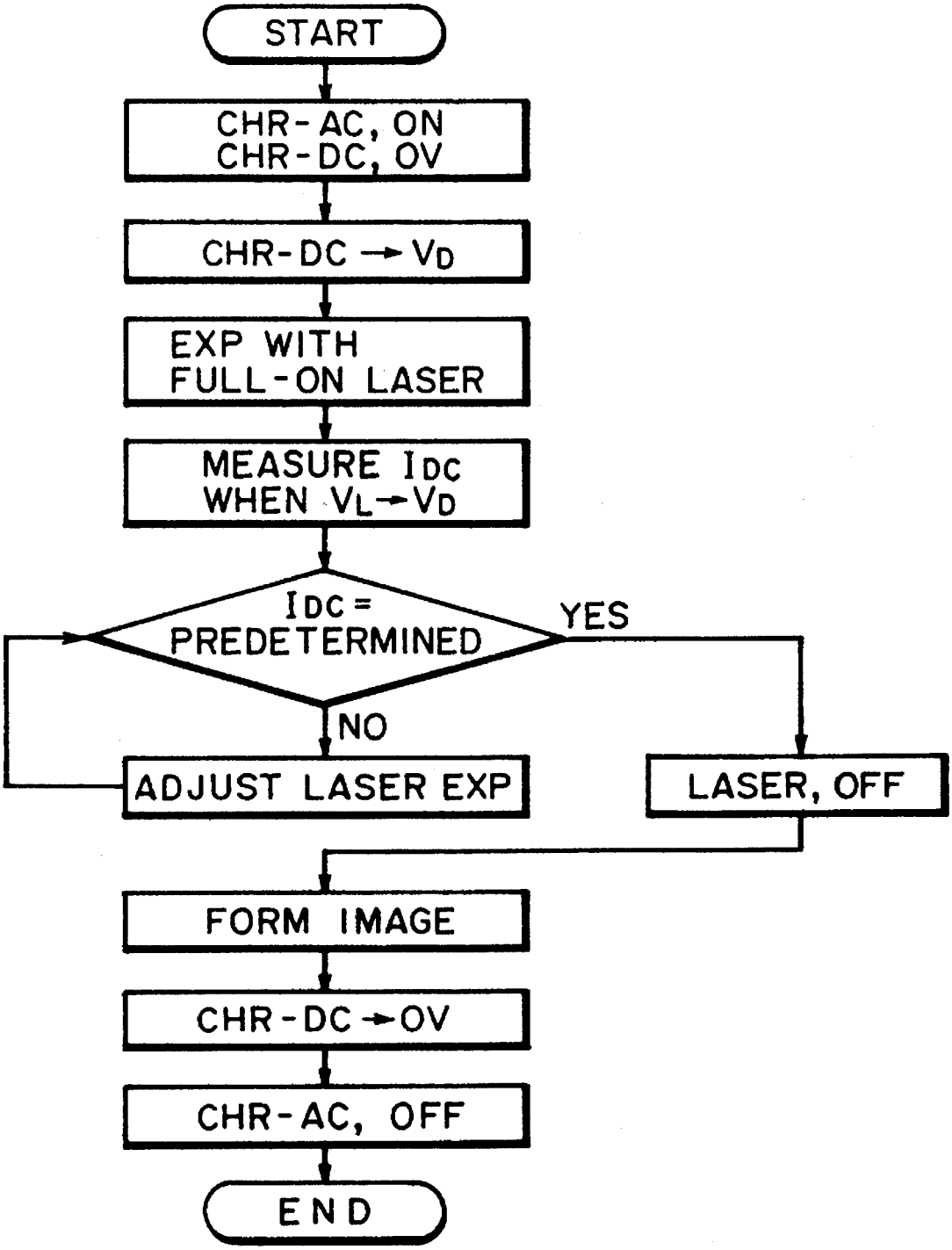
FIG. 28 is a flow chart of control operations.

Detecting method of the exposed portion potential $V_L$ of the photosensitive member 2 (FIGS. 27 and 28)

The theoretical calculation for the charging DC current (charging current) required for changing the surface potential of the photosensitive member by Vcontrast, is as indicated by equation (5).

In the equation (5), $\epsilon$, $\epsilon O$, L, Vp, d are deemed constant, and therefore, the charging current I is reversely proportional to d, and is proportional to Vcontrast.

In this embodiment, $\epsilon=3$, $\epsilon O=8.85\times10^{-2}$ (F/m), L=230 mm, Vp=95 mm/sec. For simplification, the following replacement is made:

$K=\epsilon\times\epsilon O\times L\times Vp$ $I=K\times Vcontrast/d$

In this embodiment, the surface potential of the photosensitive member is made $V_D$ by a contact type AC charging. This is exposed to image light, and the potential of the exposed portion becomes $V_L$ and, the potential $V_L$ portion is recharged to $V_D$ (here $V2=IV_D$) in other words:

$$Vcontrast=|V_L-V_D|$$

The charging DC current $I_{DC}$ is detected, and the exposed portion potential $V_L$ is detected.

By contact type AC charging, the potential $V_L$ Is instantaneously converged to potential $V_D$ with stability, and therefore, the measurement can be accomplished with small error.

In this embodiment, the exposure amount is feed-back-controlled using this measurement so as to maintain the Potential $V_L$ constant.

The actual image forming operations will be described. The electrophotographic type printer described above has the following initial potential setting:

$V_D=-700$ V $V_L=-150$ V

When the ambient condition is L/L (low temperature and low humidity condition (15°×10% RH)), the mobility in the CT layer decreases with the result of low sensitivity, so that $V_L$ increases to −190 V.

As a result, the line width (two dot line at 300 dpi) which is set at 190 microns, decreases to 170 microns. Therefore, the character is thinned to such an extent that it is of different font (reduction of the image quality).

Therefore, in this embodiment, during the pre-rotation period for the printing operation (non-printing-operation), the potential $V_L$ is defected, which is then corrected.

Specific sequential operations are illustrated in FIG. 27. First, the surface of the photosensitive member is charged to a potential $V_D$ in a usual manner, and it is exposed to image light of laser beam. The electric charge is removed in the exposed portion to a potential $V_L$. This portion is recharged to the potential $V_D$ by passing by the charging portion. At this time, the charging DC current $I_{DC}$ flowing through the charging roller 1 (contact charging member) is the current for charging the surface of the photosensitive member from $V_L$ to $V_D$ (A current in FIG. 27). It can be obtained if the thickness of the photosensitive film D is known, as will be understood from equation (5).

If the obtained value is different from the required potential $V_L$, the exposure amount is changed to be constant irrespective of the ambient condition, the manufacturing variation of the sensitivity, or the like, through the operation shown in the flow chart of FIG. 28.

More particularly, for the purpose of measurement of the charging DC current $I_{DC}$, a DC voltage across a protecting resistor (10 kΩ) of a high voltage circuit 8, is measured, and it is transmitted to a DC controller. In this embodiment, in order to reduce the error an average of the signals obtained through one full-rotation of the drum after the exposed portion potential $V_L$ of the photosensitive member is increased to a potential $V_D$ after the photosensitive member is exposed to a laser beam in synchronism with a sequential operation of the main assembly of the printer.

However, from the reason stated above, the measurement of the current $I_{DC}$ is effected upstream of the load. More particularly, the electric current is calculated on the basis of the voltage across the register in the high voltage circuit 8.

When the above control is carried out under normal ambient condition (25° C.×65% RH: "N/N condition"), the charging DC current $I_{DC}$ for increasing the potential from $V_L$ to $V_D$ was 12.8 μA. From the above equation (5), $I_{DC}=K\times$ Vcontrast. If d=25 microns, and $Vcontrast=|V_L-V_D|=|V_L-(-700)|$, then $V_L=-150$ V, and therefore, the exposure amount is not changed.

However, under the L/L condition, when the same measurements were carried out, $I_{DC}=11.8$ μA. The calculated $V_L$ is −190 V. Using the flow chart of FIG. 28, the feed-back-control is carried out for the exposure amount, and it is changed from the initial level 2.3 μJ/cm$^2$ by 0.2 μJ/cm$^2$. At the exposure amount of 2.6 μJ/cm$^2$, the level of −150 V ($V_L$) which is the same as in the N/N condition was provided. Therefore, the subsequent image forming operations were carried out with the exposure amount of 2.6 μJ/cm$^2$. Then, it was confirmed that the line width corresponded to the setting. Thus, the deterioration of the image quality without the control of this embodiment, could be prevented.

When there is manufacturing sensitivity variation exists in the photosensitive member 2, the potential $V_L$ can be maintained constant by the similar control. Therefore, if the present invention is used for an electrophotographic apparatus, maintenance free for the exposure amount can be accomplished. In the case of the cartridge type, the sensitivity index can be omitted. This is effective to stabilize the print quality, reduction of the manufacturing cost.

This invention is not limited to the method In which the exposed portion potential $V_L$ is continuously changed, and the feed-back-control is carried out. As an alternative, a plurality of stepwise levels are predetermined, and when the measured potential $V_L$ lower than the target value (lower by not less than 10 V, for example), the light quantity is increased by 10%, and when it is higher (by not less than 10 V, for example), on the other hand, the light quantity is reduced by 10%.

Figure 29A:
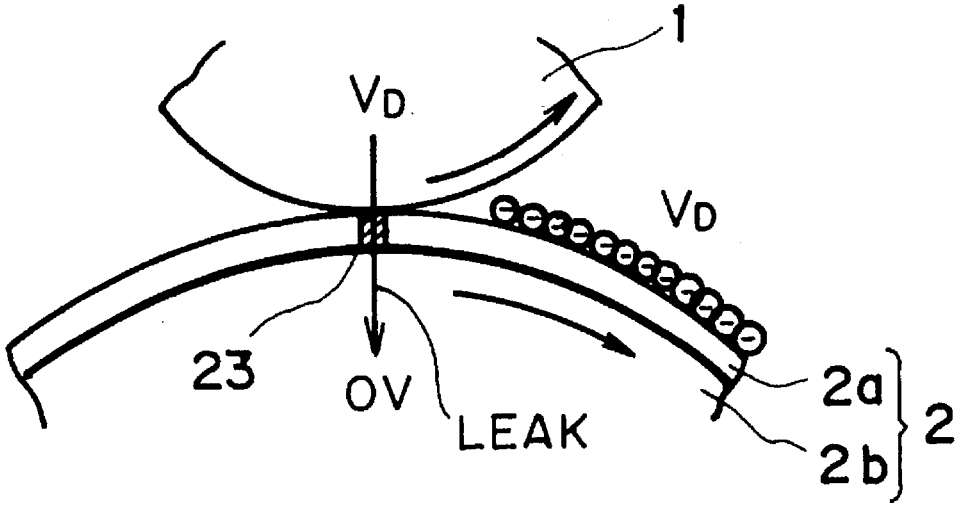
FIG. 29A illustrates current leakage through, the pin hole.
Figure 29B:
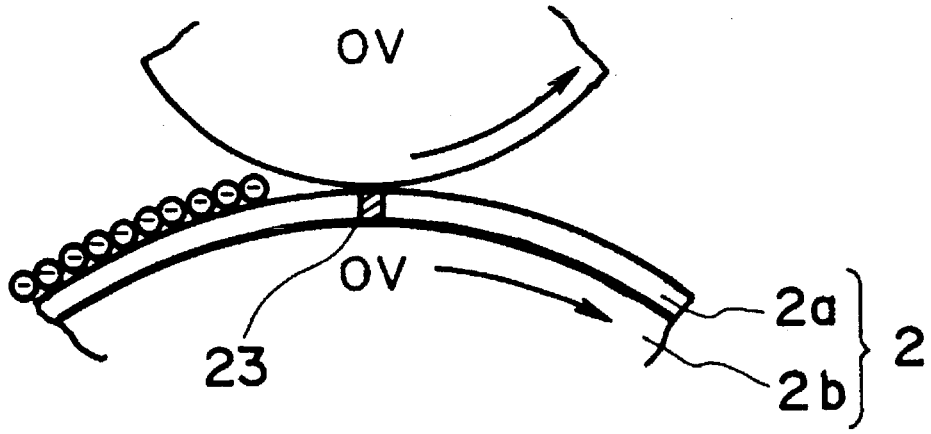
FIG. 29B illustrates the charging DC current measurement according to an 11th embodiment of the present invention.
Figure 30:
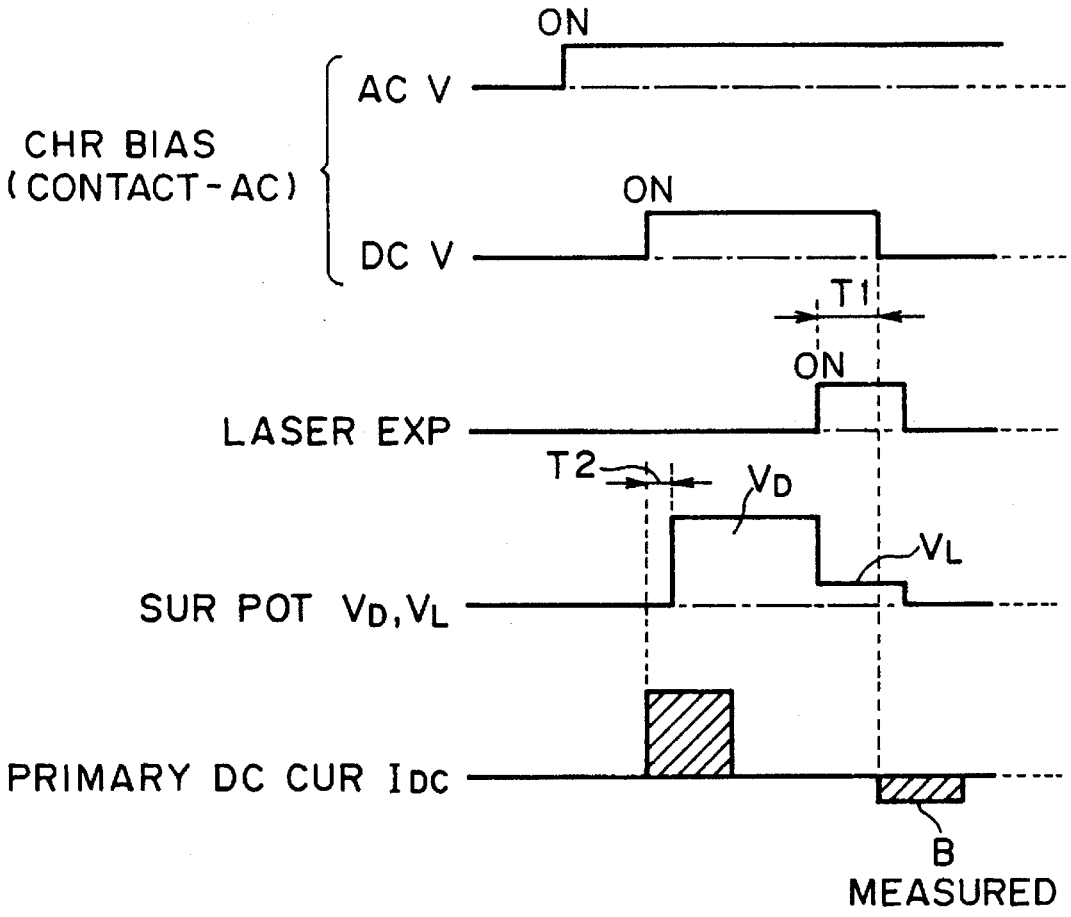
FIG. 30 shows sequential operations of the measurement.
Figure 31:
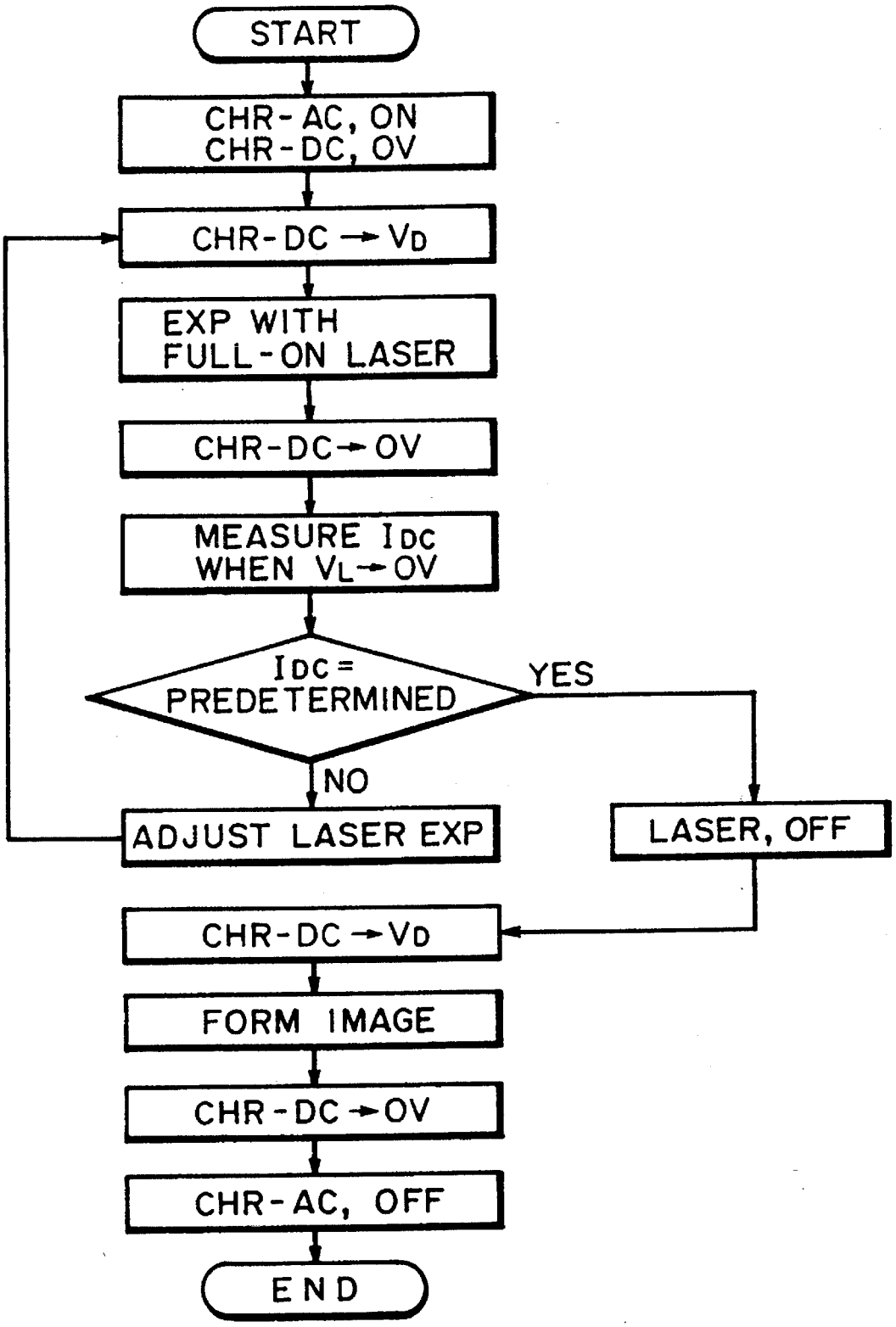
FIG. 31 is a flow chart of the measurement operation.

11th Embodiment (FIGS. 29–31)

In this embodiment, the similar control as in the 10th embodiment is effected. However, $V2=V_D$ is not used, and V2=0 V. An improvement in the measurement accuracy is intended.

In the structure of the 10th embodiment, it is possible to effect the measurement without problem under the normal using conditions. However, it should be noted that the photosensitive member 2 may have a pin hole during manufacturing or use. As described hereinbefore, by providing the contact type charging member I with a resistance, the influence of the pin hole to the image can be minimized. However, as shown in FIG. 29A, it is not avoidable for a leakage current to flow more or less through the pin hole 23.

It is difficult to separate the leak current from the charging DC current measured for the detection of the exposed portion potential $V_L$, and therefore, there is a possibility of measurement error.

Therefore, in this embodiment, the measurement is effected not to the current flowing during charging from surface potential $V_L$ to $V_D$ as in the 10th embodiment, but to the current when the charging roller 1 (contact type charging member) electrically discharges it from potential $V_L$ to 0 V (FIG. 29B). In this case, since the contact charging member 1 and the pin hole 23 have both the potential 0 V (DC), and therefore, the leakage current does not flow essentially.

The sequential operation of the measurement of this embodiment will be described. The structure of the apparatus and the conditions of the tests, are the same as in the 10th embodiment, but the sequential operation for the measurement and the flow chart therefor, are different, as shown in FIGS. 30 and 31.

First, the photosensitive member 2 is charged uniformly to a potential $V_D$ by the contact charging member I (contact AC charging). Thereafter, it is electrically discharged to a potential $V_L$ by being exposed to image light. However, the potential $V_L$ changes with the sensitivity of the photosensitive member and th ambient condition and the like. In order to correct this, the exposure amount is controlled.

In this control, the potential of the photosensitive member is rendered $V_L$, and thereafter, the DC voltage applied to the contact charging member 1 is set to 0 V so as to electrically discharge it to 0 V. At this time, a charging DC current for discharging the photosensitive member 2 from $V_L$ to 0 V flows through the contact charging member 1 during the time corresponding to one full rotation of the photosensitive drum (B in FIG. 30). The current is the current when Vcontrast=$|V_L-0\ V|$ in equation (5), and therefore, $V_L=I_{DC}/K$ can be obtained.

Actually, the measurements were carried out with a photosensitive member (having the sensitivity of $V_L$=−150 V) having a pin hole 23 under the N/N condition. Using the 10th embodiment, the charging DC current contained the leakage current flowing into the pin hole, and the measurement was erroneous ($V_L$=−75 V) ($I_{DC}$=14.5 μA through the measurement in the 10th embodiment). When the control of this embodiment is used, $I_{DC}$=3.5 μA ($V_L$=−150 V). As will be understood, the erroneous measurement attributable to the leakage current could be avoided. Therefore, the correct measurement is possible even if the photosensitive member has a pin hole 23.

The charging DC current actually measured is as small as several μA, and therefore, the influence of the leak current is significant. Using the method of this embodiment, the measurement accuracy is improved.

Figure 32:
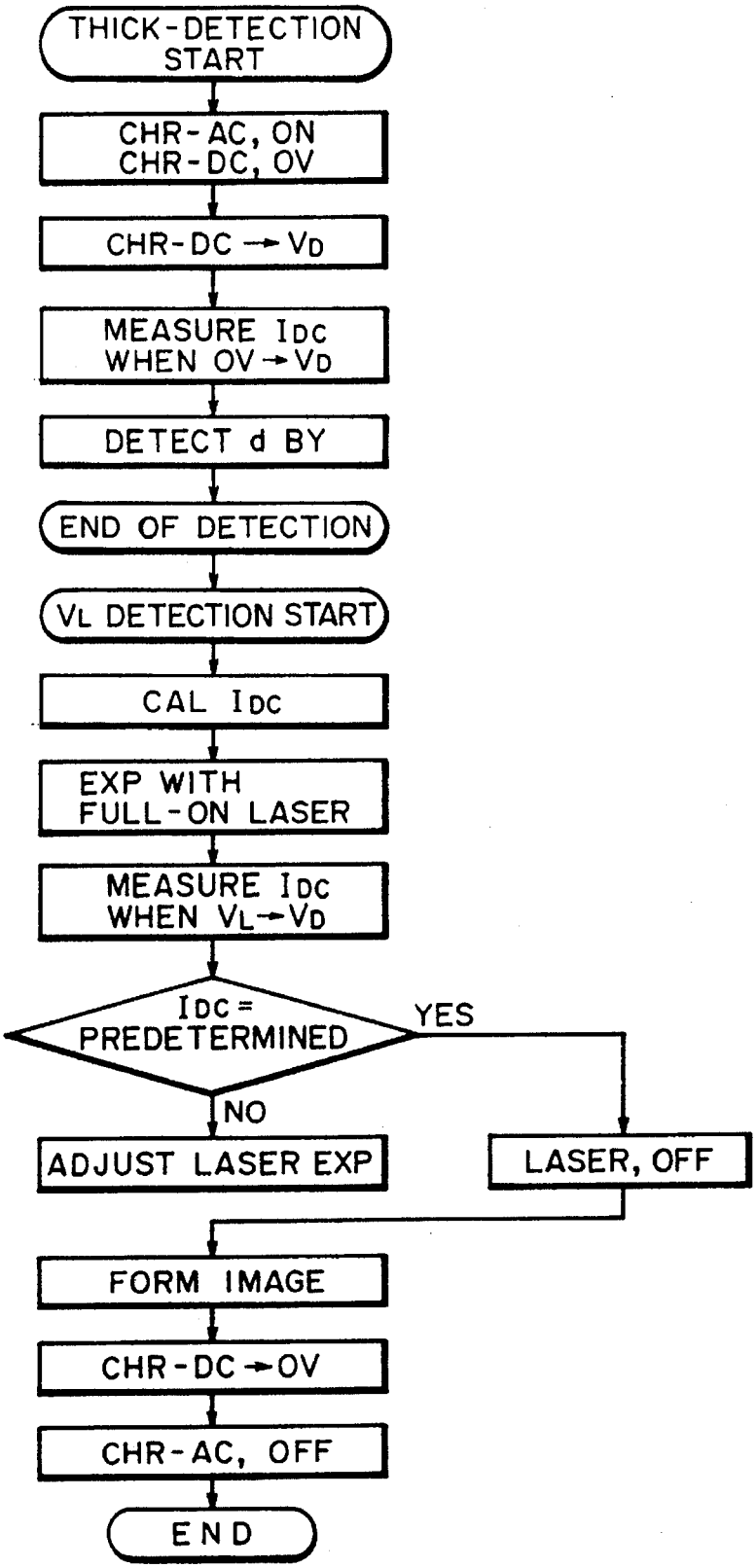
FIG. 32 is a flow chart of a photosensitive layer thickness detecting operation according to a 12th embodiment of the present invention.

12th Embodiment (FIG. 32)

In this embodiment, in order to prevent the factor for the error in the measurement when the photosensitive member 1 is scraped by long term use, the thickness of the photosensitive layer is detected beforehand, and the potential $V_L$ is corrected on the basis of the detection.

As in the 10th and 11th embodiment, it is possible to detect the exposed portion potential $V_L$ independently of the ambient condition, the sensitivity variation due to the manufacturing error, a pin hole of a photosensitive member, and the like. On the basis of the detection, the exposure amount is controlled so that a desired potential $V_L$ is provided. As will be understood from equation (5), the charging DC current used in the measurement in this embodiment is only for $I_{DC}$=K×Vcontrast, and therefore, it is not possible to separate the current $I_{DC}$ into the current corresponding to the Vcontrast and the current corresponding to the film thickness of the photosensitive layer d. In other words, in the foregoing embodiments, the measurement error occurs when the thickness of the photosensitive layer changed due to the long term use or the like.

In view of the above, the thickness d of the photosensitive member 1 is detected beforehand. As shown in FIG. 32 (flow chart), the contact type charging member 1 is supplied with a AC voltage and a DC voltage of V2, so that the potential of the surface of the photosensitive member is converged to V2. Then, the DC voltage is changed to V3, and the charging DC current $I_{DC}'$ at this time is detected. Generally, it is preferable to use V2=0 and V3=$V_D$ since then the measurement is simplified, but it is possible to use different values.

Therefore, from equation (5), the charging DC current is:

$$I_{DC}'=K\times Vcontrast/d\ (Vcontrast=V2-V3)$$

Therefore, it is possible to detect the film thickness d of the photosensitive member.

In order to remove the possibility of the measurement error by the pin hole 23 (FIG. 29) described in the 11th embodiment, it is possible to use the current when the potential is changed from $V_D$ to 0 V not during the potential change from 0 V to $V_D$. It is preferable from the standpoint of measurement accuracy, as described hereinbefore.

After the film thickness d of the photosensitive member is measured as described hereinbefore, the exposed potential $V_L$ is detected in the similar manner as in the 10th and 11th embodiment. When the potential $V_L$ is calculated from the charging DC current $I_{DC}$ at this time, the correction is effected on the basis of the film thickness d of the photosensitive member obtained in the film thickness detecting step. This is accomplished by using d in equation (5), that is, $I_{DC}$=K×Vcontrast/d.

The description will be made as to the actual operation using the control of this embodiment. After 8000 sheets were processed, the image was produced. First, the sequential operation for a thickness of the photosensitive member film, the current $I_{DC}'$=27.0 μA flows to charge from 0 V to $V_D$, this substitutes in equation (5), then d=15 microns is obtained (Vcontrast=−700 V). Thus, the correct film thickness was measured.

Then, the potential $V_L$ detect,on sequence in the 10th embodiment was carried out. The detected current was $I_{DC}$=19 μA. When the potential $V_L$ is calculated on the basis that the film thickness is 25 microns, $V_L$=+120 V, which is not plausible.

However, in this embodiment the film thickness d=15 microns was detected beforehand, and the potential $V_L$ was calculated using this film Thickness, then, the result was $V_L$=−200 V.

When the potential was measured using a potentiometer, $V_L$=−200 V, it proved that the correct measurement is accomplished through the method of this embodiment.

As described above, using the method of this embodiment, it is possible to accurately detect the exposed portion potential $V_L$ even if the thickness d of the photosensitive mender changes during long term As described in the 10th, 11th and 12th embodiments, the photosensitive member having the potential $V_L$ at the exposed portion is charged through the contact AC charging process, and the charging DC current flowing when it is charged or discharged, by which the potential $V_L$ can be detected. In order to prevent deterioration of the image quality attributable to the potential $V_L$ variation due to various factors, the exposure means is controlled to maintain the constant potential $V_L$ under any conditions.

This means that the present invention can be carried out only with measurement of the charging DC current without particular means for measuring the potential $V_L$ such as potential measuring device in the conventional apparatus, and therefore, the high reliability advantage can be provided at low cost. More particularly, the exposure amount control maintenance when the main assembly of the electrophotographic apparatus is installed, is not required. In the case of a process unit in the form of a cartridge, a photosensitivity index for transmitting the sensitivity of the photosensitive member to the main apparatus, can be omitted.

Figure 33:
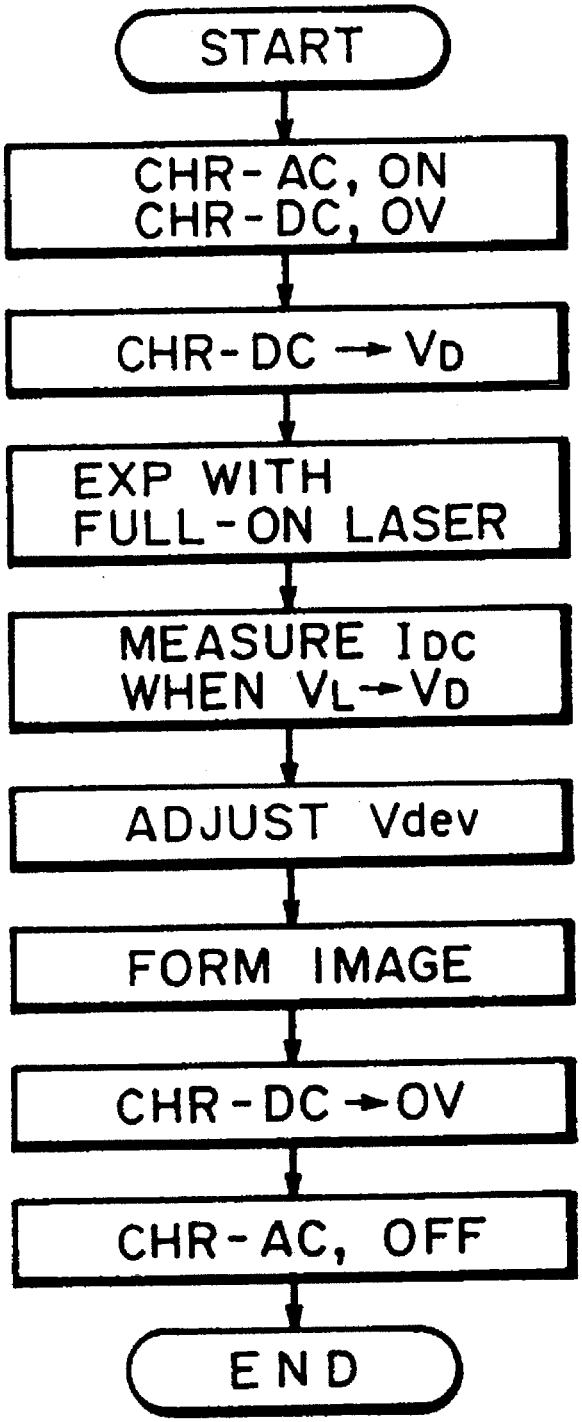
FIG. 33 is a flow chart of a control operation in an apparatus according to a 13th embodiment of the present invention.

13th Embodiment (FIG. 33)

The embodiment is similar in the 10th, 11th and 12th embodiments in the measurements and detections of the charging DC current $I_{DC}$ and the exposed portion potential $V_L$.

As described hereinbefore, it is possible to detect the exposed portion potential $V_L$ from the charging DC current $I_{DC}$. Particularly, using the contact AC charging, the potential instantaneously converges to the potential $V_D$ from the potential $V_L$, and therefore, this method is advantageous in that the measurement error is small.

Since the charging operation is of contact charging, all of the current from the contact type charging member corresponds to the charge amount effective to charge or discharge the photosensitive member. For this reason, it is possible to directly detect the charging current (discharging current) by simply detecting the current. Unlike the corona charger, it is not necessary to separate the shield current or to measure the current into the photosensitive member minus development or transfer currents, and therefore, the charging current can be easily detected.

In this embodiment, the DC component Vdev applied to the developing roller 41. The DC component Vdev is controlled so as to provide a constant development contrast.

The electrophotographic type printer described above uses a jumping developing system as described, and the developing bias contains the following:

AC component: peak-to-peak voltage of 1600 Vpp, frequency of 1800 Hz.

DC component: Vdev=−500 V

The initial potential settings are $V_D$=−700 V, and $V_L$=−150 V. Under the L/L conditions, the mobility in the CT layer decreases with the result of lowered sensitivity, so that The $V_L$ increases to −190 V. As a result, under the normal condition, the line width (two dot line at 300 dpi) set to 190 microns, is thinned to 170 microns. Therefore, the character is thinned to such an extent that the printed character is of different font, that is, the image quality is degraded.

Therefore, during the pre-rotation of the printing, the measurement of the charging DC current $I_{DC}$ is effected, and on the basis of the current $I_{DC}$ thus detected, the DC component Vdev of the developing bias is controlled.

The sequential operation for the measurement and detection of the charging DC current $V_D$ is the same as shown in FIG. 27 of the 10th embodiment.

On the basis of the charging DC current $I_{DC}$ detected, the exposed portion potential $V_L$ is obtained. The DC component Vdev of developing bias is changed in accordance with the detected current $I_{DC}$ so as to make the image formation contrast constant through the process shown in the flow chart of FIG. 33.

For the purpose of measuring the charging DC current $I_{DC}$, the DC voltage across the protection layer (10 kΩ) of The high voltage circuit 8 is detected as described hereinbefore, and the signal is transmitted to the controller. In this embodiment, in order to reduce the measurement error, the photosensitive member is exposed to a laser beam in synchronism with the sequential operation of the main assembly so as to raise the potential from $V_L$ to $V_D$, and the signal obtained during one full rotation of the drum is averaged.

When the above-described control operation is carried out under the N/N condition, the charging DC current $I_{DC}$ for charging the potential from $V_L$ to $V_D$ was 12.8 μA. From equation (5):

$$I_{DC}=K\times Vcontrast/d$$

where d is 25 microns, and Vcontrast is $V_L$−$V_D$ which is $V_L$−(−700). Then, $V_D$=−150 V. Therefore, the DC component Vdev of the developing bias is not changed.

When the same measurement is carried out under the L/L conditions, $I_{DC}$=11.8 μA was obtained, so that the exposed portion potential $V_L$=−190 V. The voltage Vdev is calculated through the flow chart of FIG. 33 and is set to −540 V so as to provide the image formation contrast of 350 V similarly to the N/N condition. In the image formation thereafter, the line width is as desired, and the deterioration of the image quality without the control of this embodiment, can be prevented.

When the sensitivity variation during the manufacturing of the photosensitive member occurs, the similar control is carried out, by which the contrast for the image formation can be maintained constant.

Figure 34:
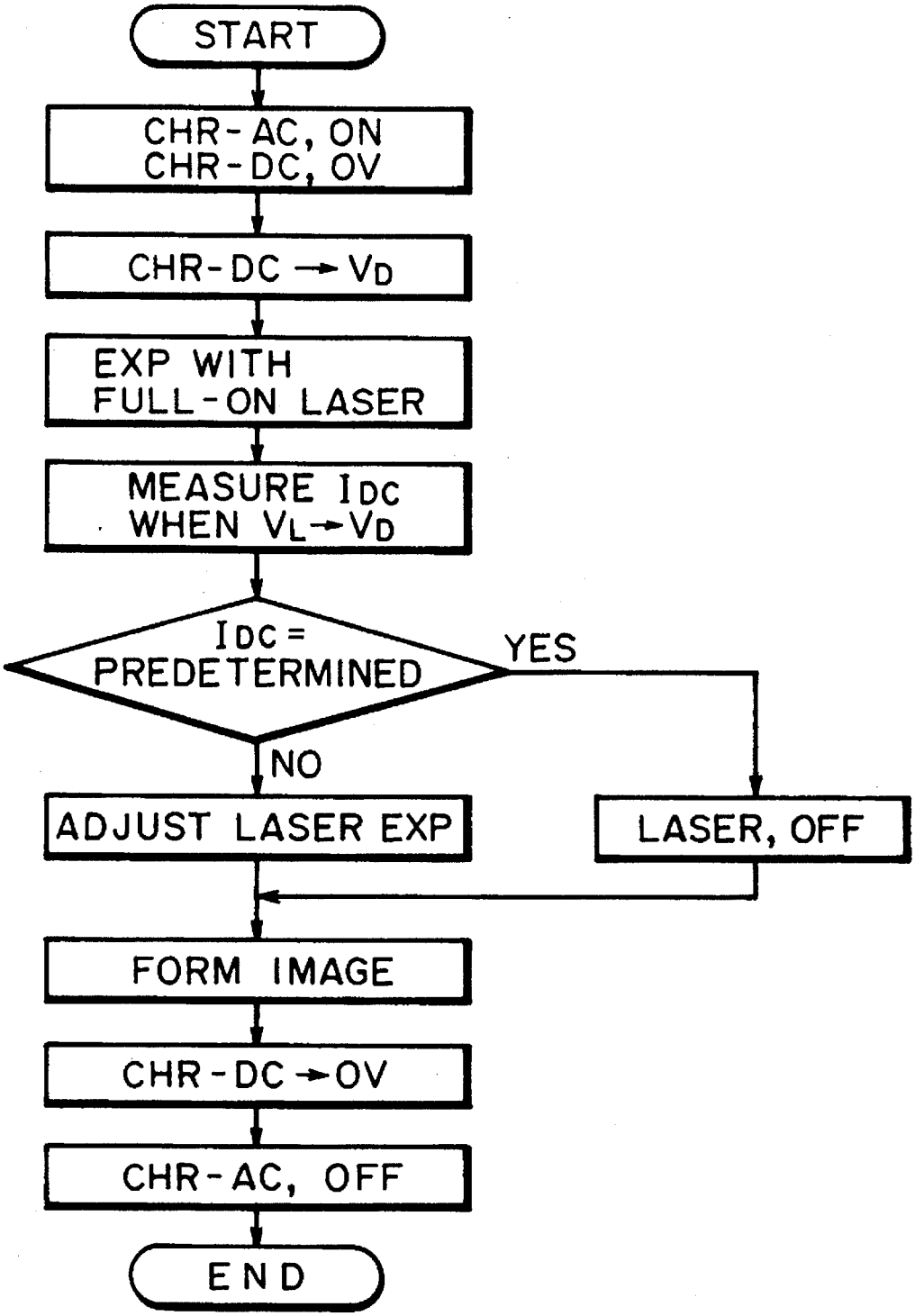
FIG. 34 is a flow chart of a control operation according to a 14th embodiment of the present invention.

14th Embodiment (FIG. 34)

In this embodiment, similarly to the 13th embodiment, the charging DC current $I_{DC}$ is measured. In accordance with the detected current $I_{DC}$, the frequency Vdev.f of the AC component of the developing bias in the jumping development, is changed. By this, the change of the charging DC current $I_{DC}$, that is, the line width change due to the change of the exposed portion potential $V_L$ is corrected by controlling the above-described frequency Vdev.f.

The printer as an exemplary image forming apparatus has a similar structure as in the 10th embodiment, and the initial potential settings under the N/N condition are $V_D$=−700 V, and $V_L$=−150 V, but it increases to $V_L$=−180 V under the L/L condition.

In this embodiment, the charging DC current $I_{DC}$ is detected during the pre-rotation in the printing operation. In accordance with detected $I_{DC}$, the frequency Vdev.f is controlled. The method of measuring the charging DC current $I_{DC}$ is the same as in the 13th embodiment.

More particularly, the control operation as shown in the flow chart of FIG. 34, is carried out. When the current $I_{DC}$ is detected actually under the N/N condition, the following results:

$$I_{DC}=12.8\ \mu A\ (V_L=-150\ V)$$

Then, no adjustment is effected to the AC component Vdev.f (=1800 Hz) of the development bias voltage.

However, under the L/L condition, $I_{DC}$=11.8 μA ($V_L$=−190 V) is obtained, and therefore, using the flow chart of FIG. 34, the frequency Vdev.f is controlled by which the frequency is changed from 1800 Hz to 1700 Hz. This has been obtained from a table indicating a relation between the $I_{DC}$ value and the Vdev.f value obtained through experiments beforehand.

Then, the image formation thereafter is carried out with the changed Vdev.f (1700 Hz). It has been confirmed that the line width was as intended, and the deterioration of the image quality was prevented.

Figure 35:
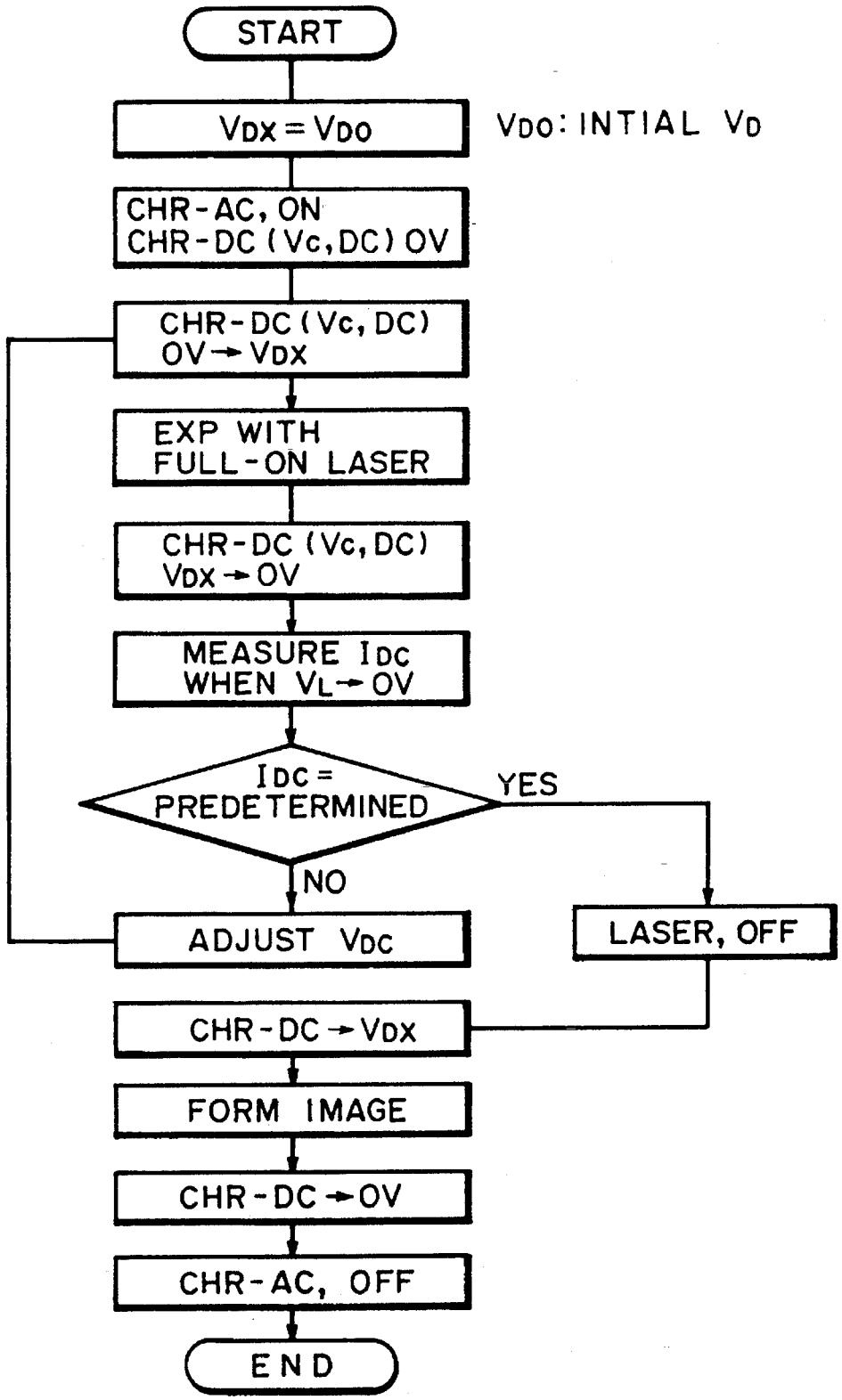
FIG. 35 is a flow chart of a control operation in an apparatus according to a 15th embodiment of the present invention.

15th Embodiment (FIG. 35)

In this embodiment, the DC voltage ($V_{C.DC}$) of the charging bias applied to the contact charging member 1 is controlled in accordance with the charging DC current $I_{DC}$ detected. In other words, in accordance with the current $I_{DC}$ detected, the voltage $V_{C.DC}$ is controlled, so that the voltage $V_D$ is changed to feed-back-control the current $I_{DC}$.

The printer used in this embodiment has the same structure as the printer used in the 10th embodiment, and the initial potential settings under the N/N condition are $V_D$=−700 V, $V_L$=−150 V, but under the L/L condition, the potential $V_L$ increases to −190 V.

In this embodiment, the current $I_{DC}$ is detected during the pre-rotation, and on the basis of the detected current $I_{DC}$, the voltage $V_{C.DC}$ is adjusted.

Unlike the 13th embodiment, the charging DC current $I_{DC}$ is measured when the potential is changed from $V_L$ to 0 V.

More particularly, similarly to the sequential operation of FIG. 30 described in the 11th embodiment, the B portion is detected in the sequence. Since the current is the value when Vcontrast=$|V_L-0\ V|$ is substituted in equation (5), and therefore, $V_L=d\times I_{DC}/K$.

When the current $I_{DC}$ thus detected is different from the desired $I_{DC}$, the voltage $V_{C.DC}$ is changed in accordance with the detected $I_{DC}$, and the voltage $V_D$ is changed so that the control operation shown in the flow chart of FIG. 35 is carried out so as to obtain the desired current $I_{DC}$.

When the current $I_{DC}$ is detected under the N/N condition, $I_{DC}$=3.5 μA ($V_L$=−150 V), and therefore, no particular adjustment is effected to the voltage $V_{C.DC}$(=−700 V).

However, under the L/L condition, $I_{DC}$ becomes 4.5 μA ($V_L$=−190 V), and therefore, the feed-back-control is carried out for the voltage $V_{C.DC}$ on the basis of the flow chart of FIG. 34. When the voltage is changed from the initial level of −700 V (=$V_D$) by the increment of 10 V, it has been found that $I_{DC}$=3.5 μA ($V_L$=−150 V) is obtained (the same as under the normal condition), when the voltage is −600 V.

Therefore, the subsequent image forming operations are carried out with $V_{C.DC}$=−600 V, and then, the line width became the intended level, so that the deterioration of the image quality could be prevented.

In the13th, 14th and 15th embodiments, the electrophotographic process parameter which is changed in accordance with the detected current $I_{DC}$, has been the DC voltage of the developing bias, the frequency of the AC component of the developing bias or the charging bias. However, it may be a peak-to-peak voltage vpp of the AC component of the development bias. Also, a combination of the above is possible. As for other conditions, there are a relative speed between the developing roller and the photosensitive drum, a gap between the photosensitive drum and the developing roller or sleeve and the setting of a developing blade.

As described in the 13th, 14th and 15th embodiments, the photosensitive member having the exposed portion potential $V_L$ is charged through contact charging, and the charging or discharging DC current $I_{DC}$ is detected when the photosensitive member is charged or discharged. In accordance with the charging or discharging DC current, some image forming process condition (electrophotographic process parameter) is changed, so that the deterioration of the image quality arising from variation of the exposed portion potential $V_L$ due to various factors, can be prevented at low cost.

Figure 36:
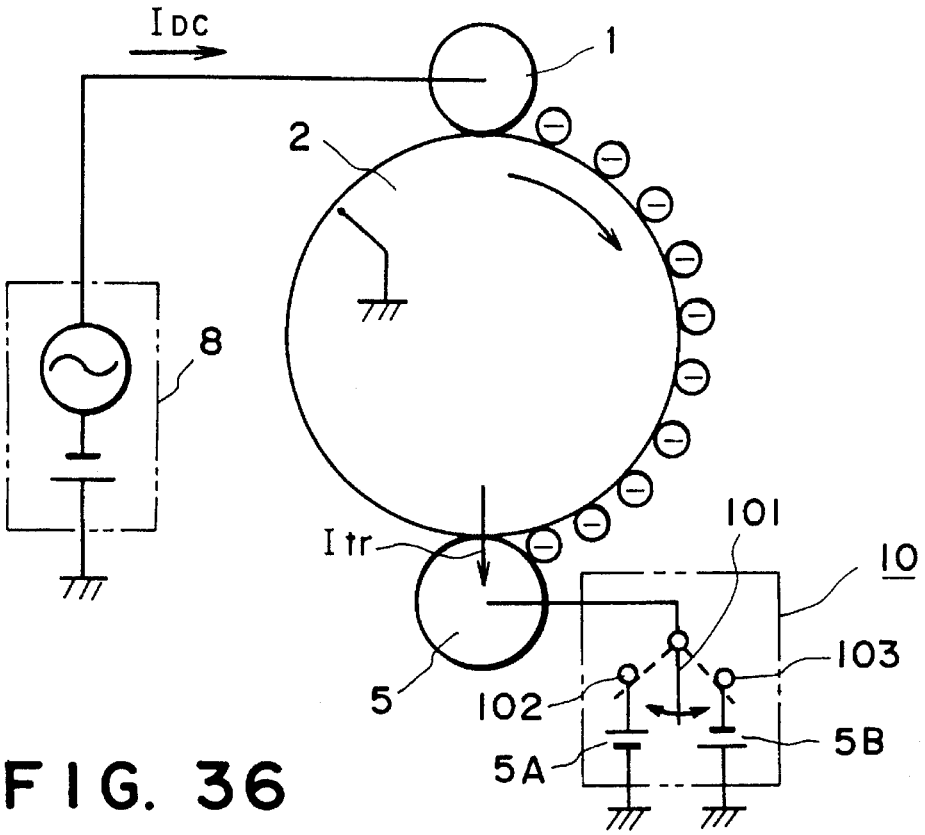
FIG. 36 shows a major part of an apparatus according to a 16th embodiment of the present invention.

16th Embodiment (FIG. 36)

The structure of the printer (image forming apparatus) of this embodiment is the same as in the tenth embodiment (FIG. 1). However, in this embodiment, a thickness d of the charge transfer layer (CT layer) of the photosensitive layer 2*a* of the photosensitive member 2 is 23 microns, and the process speed is 47.7 mm/sec. The transfer bias to the transfer roller 5 is 2 KV.

The detection method for the exposed portion potential $V_L$ of the photosensitive member is similar to that of the tenth embodiment. However, in this embodiment, an effective charging width L of the contact charging member (charging roller) 1 is 270 mm, and the process speed Vp is 47.7 mm/sec as described above.

In this embodiment, the DC voltage −600 V is applied to the surface of the photosensitive member through the contact AC charging process to provide the photosensitive member surface potential V1 of −600 V. Subsequently, the image exposure is carried out, so that the surface potential of the photosensitive member (exposed potential) $V_L$ is changed to −120 V. Furthermore, the surface of the photosensitive member is applied with a DC voltage of −600 V so that the surface potential of the photosensitive member is changed from $V_L$ to V1. The charging DC current $I_{DC}$ at this time is measured, so that the potential $V_L$ is detected.

At this time, it is desirable to prevent the influence of the transfer roller 5 (transfer member) to the surface potential $V_L$ of the photosensitive member.

The description will be made as to the influence of the transfer roller 5 to the potential $V_L$, referring to FIG. 36.

The transfer roller 5 is supplied with a transfer bias of 2 KV from a first transfer bias voltage source 5*a* through a first contact 102 of a switch 101. If the transfer bias of 2 KV for the image formation is also applied during the detection period for the potential $V_L$, the surface of the photosensitive member is charged (or discharged) to such an extent that the influence to the exposed potential $V_L$ is not negligible.

Actually, the investigation has been made as to the variation of the exposed portion potential $V_L$ by the existence of the transfer roller 5. The exposed portion potential $V_L$ before the transfer roller is substantially predetermined voltage, that is, −120.2 V, but the exposed portion potential, $V_L$ after the transfer roller is −102.6. This means that there is a measurement error of 17.6 V.

Therefore, in this embodiment, in order to avoid the influence of the transfer roller 5 to the exposed portion potential $V_L$, the switch 101 in FIG. 36 is switched to e second contact 103 when the charging DC current $I_{DC}$ is to be detected, the transfer bias equivalent to the exposed portion potential $V_L$ (120 V in this embodiment) from the second voltage source 5B.

In order to distinguish the transfer bias from the second voltage source 5*b* to the transfer roller 5 during the potential $V_L$ measurement, from the transfer bias from the first voltage source 5*a* applied to the transfer roller 5 during the image formation, the former is called "$V_L$ detection transfer bias".

As a result, it has been confirmed that when the $V_L$ detection transfer bias is set to be the exposed portion potential $V_L$ (−120 V), the transfer current Itr is substantially 0 (μA).

Preferably, the $I_{DC}$ measurement transfer bias is set to be the same as the exposed portion potential $V_L$ as in this embodiment. However, when the $V_L$ detection transfer bias is 0 V, hardly any measurement error in the photosensitive film thickness d detection or the exposed portion potential $V_L$ detection is exhibited, since the measured transfer current Itr is substantially 0 μA.

Actually, in the method in which the $I_{DC}$ measuring transfer bias is made equal to the exposed portion potential $V_L$, the charging DC current $I_{DC}$ is measured, and the potential $V_L$ is determined. After 6000 sheets durability test, the charging DC current $I_{DC}$ has been measured with Vcontrast (=$|V_L-V1|$), and the Vcontrast calculated in accordance with equation (1) is used, and the voltage V1 is calculated.

It was −140.9 V. Surface potentiometer is used, and the surface potential of the photosensitive member was −139.9 V when the voltage is $V_L$.

Then, the exposure amount is gradually changed from 2.0 μJ/cm$^2$, and the same measurements are carried out when the exposure amount is 2.2 μJ/cm$^2$. The potential $V_L$ from Vcontrast obtained from equation (1) was −120.3 V. The voltage $V_L$ measured by a surface potentiometer was 120.6 V. Therefore, it has been confirmed that they are substantially the same.

In a simpler method, as in the case of sensitivity index for the exposure amount control, when an error from the set exposed portion potential $V_L$ is within ±15 V, the initial exposure amount setting (2.0 μJ/cm$^2$) is not changed, and when the error is −15—30 V, the exposure amount is changed to 2.2 μJ/cm$^2$, and when the error is +15—+30 V, the exposure amount is changed to 1.8 μJ/cm$^2$, by which the image quality can be maintained satisfactory with simpler method.

By measuring the charging DC current $I_{DC}$ while $I_{DC}$ measuring transfer bias is made equal to the exposed portion potential $V_L$, the exposed portion potential $V_L$ can be accurately obtained. By doing so, a stabilized potential $V_L$ can be maintained without necessity for a large device for controlling the exposure amount, because the surface potential is sufficiently stabilized.

As a result, the intended line width can also be provided, and therefore, the deterioration of the image quality without the control of this embodiment can be prevented.

When the manufacturing variation of the sensitivity of the photosensitive member occurs, the exposed potential $V_L$ can be maintained constant through the similar control. Therefore, if this embodiment is used with an electrophotographic apparatus, the exposure amount control maintenance free can be accomplished. In the case of cartridge type, the sensitivity index can be omitted, thus advantageous effects can be provided in the stabilization of the print quality and the manufacturing cost reduction.

Figure 37:
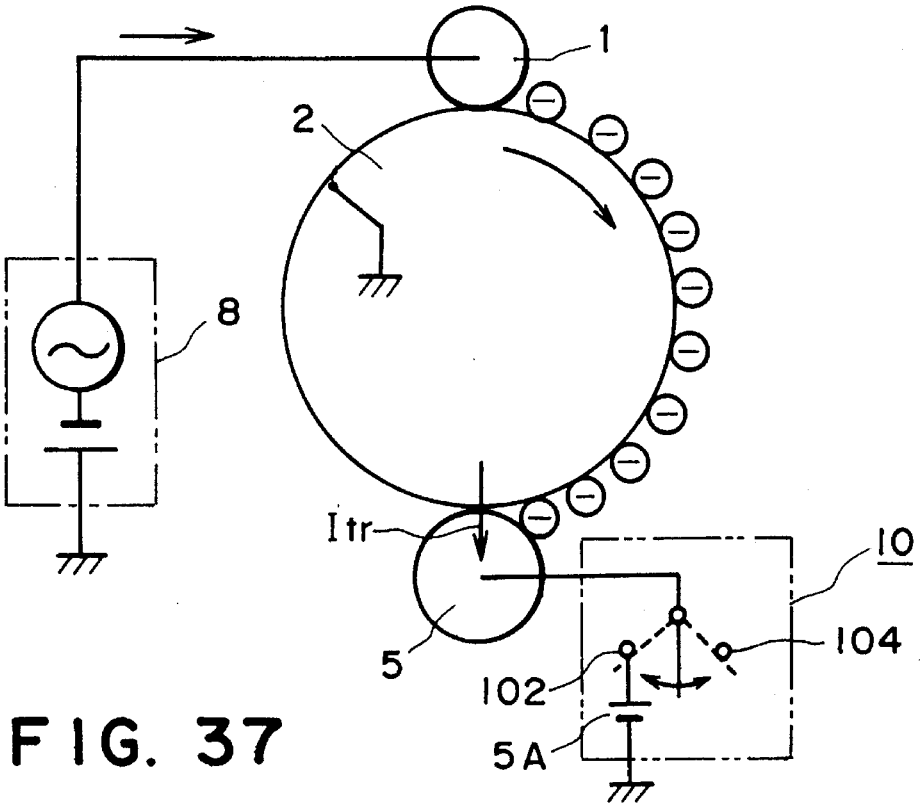
FIG. 37 illustrates a major part of an apparatus according to a 17th embodiment of the present invention.

17th Embodiment (FIG. 37)

In this embodiment, the similar control operation as in the 16th embodiment is carried out, but in this embodiment, the measurement is taken in an electric circuit to prevent flow of the transfer current Itr.

More particularly, only upon measurement of the charging DC current $I_{DC}$, the switch 101 in FIG. 37 is connected to a floating contact 104, thus stopping the flow of the charge, by which the same potential is established between the transfer roller 5 and the surface of the photosensitive member 2, so that the transfer current Itr is prevented from flowing.

In this system, the structure is simple because only the switching in the circuit is required. Unlike the 16th embodiment, the $I_{DC}$ measuring transfer bias is not required, the structure is simple.

In this system, 6000 sheets were actually processed, and thereafter the charging DC current $I_{DC}$ was measured, and the exposed portion potential $V_L$ is calculated on the basis of Vcontrast and equation (5). Under the exposure amount of 2.0 μJ/cm$^2$, it was −141.2 V, which involves not more than 1% measurement error relative to the surface potential of −139.9 V with $V_L$ using the surface potentiometer.

Thereafter, the exposure amount is controlled through the similar sequence as in the 16th embodiment. It was confirmed that the results are the same. Therefore, using the system of this embodiment, the exposed portion potential $V_L$ can be accurately detected, so that the stabilized exposed portion potential $V_L$ can be maintained.

18th Embodiment (FIG. 38)

In this embodiment, the charging DC current is measured when the transfer roller 5 is away from the photosensitive member.

Figure 38A:
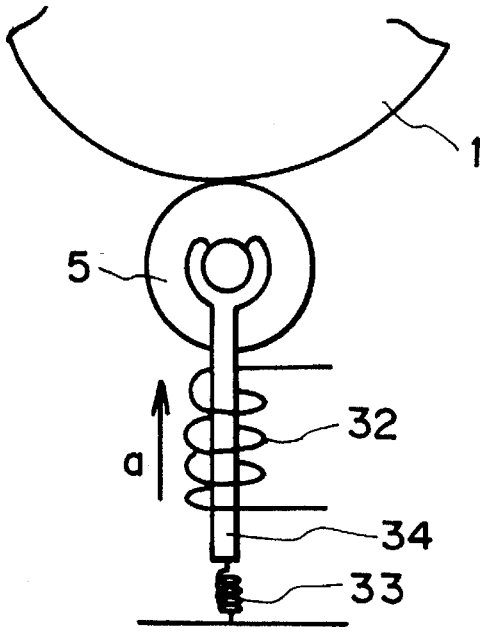
FIGS. 38A and 38B show a major part of an apparatus according to an 18th embodiment of the present invention.
Figure 38B:
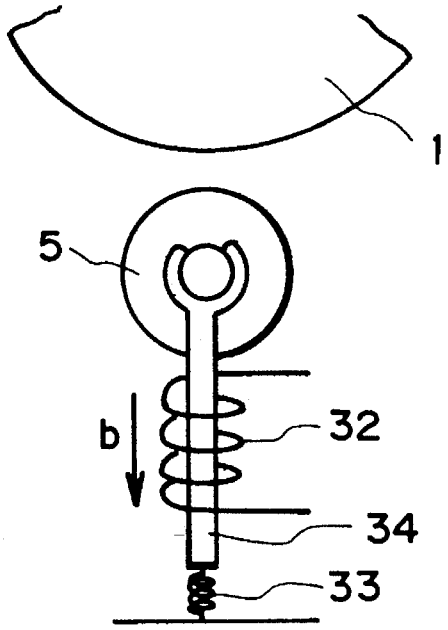

The structure of this embodiment is shown in FIGS. 38A and 38B. During the transfer operation, a bearing member 34 for the transfer roller 5 is urged in the direction a by electric field effect by a solenoid 32, as shown in FIG. 38A and the transfer roller 5 is contacted to the surface of the photosensitive member 2 to effect the transfer operation. However, at least during the measurement of the exposed portion potential $V_L$, the electric field due to the solenoid is shut-off, as shown in FIG. 38B. The transfer roller 5 is attracted by a spring 33 in the direction of an arrow b to be away from the photosensitive drum 2.

The charging DC current is measured when the transfer roller 5 is away from the surface of the photosensitive drum 2, so that the surface potential change of the photosensitive drum 2 due to the transfer roller 5 can be completedly avoided. It is easy to incorporate the system in the existing apparatus.

The potential $V_L$ is detected on the basis of the charging DC current flowing in accordance with the Vcontrast (=|$V_L$−V1|), and the $V_L$ is controlled to provide the optimum exposure amount. In order to satisfy the sequential operations, the time period corresponding to the sheet interval is not sufficient, and in addition, the time period during the post-rotation, the exposure amount can not be controlled, and therefore, the charging DC current is measured during the pre-rotation.

During the pre-rotation, the exposed portion potential $V_L$ was actually detected, and the charging DC current was measured while the transfer roller 5 is away from the photosensitive drum 2. Using equation (5), the potential $V_L$ was calculated, similarly to the 17th embodiment, the measurement was carried out after 6000 sheets were processed by a cartridge, the potential $V_L$ calculated at the exposure amount of 2.0 μJ/cm$^2$, was −140.3 V, and only a slight deviation is recognized from −139.9 V which is the surface potential of the photosensitive member measured by a surface potentiometer. The exposure amount was controlled in the similar manner To the 16th and 10th embodiments, the exposed portion potential $V_L$ was the same as the setting.

By measuring the charging DC current while the transfer roller is away from the surface of the transfer roller 5, the accurate control is possible without being influenced by the transfer roller 5. It becomes possible to detect and maintain the exposed portion potential $V_L$.

19th Embodiment

According to this embodiment, even when the transfer means includes a transfer means 5 in the form of a corona charger, in order to measure the charging DC current with high accuracy, the transfer bias is always stopped upon measurement of the DC current. Although the transfer roller is preferred, the corona transfer charger is still preferred in some respects such as high speed or the like.

In the case corona transfer, the surface potential of the photosensitive member changes due to the electric discharge for the transfer action, thus causing an error in the measurement of the Vcontrast ($V_L$) in order to avoid the error, when the exposed portion potential $V_L$ is detected, the transfer bias is so stopped, to that the influence of the positive corona charge to the negative charge on the surface of the photosensitive member, is prevented. Actually, upon detection of the potential $V_L$, the Vcontrast (=|$V_L$−V1|) when the transfer bias is supplied and not supplied, is detected from equation (5), and the potential $V_L$ is calculated. When a new cartridge is used, the potential $V_L$ was −101.7 V when the transfer bias voltage is supplied under the exposure amount of 2.0 μJ/cm$^2$, whereas when the transfer bias is not supplied, the potential was −120.2 V which corresponds to the setting level.

If the potential $V_L$ is detected with the transfer bias supplied, it is detected that the exposure amount is too large with the result that the exposure amount is changed to 1.84 μJ/cm$^2$ to provide the set −120 V. However, under this exposure amount, the true $V_L$ is −143.2 V with the result of thinned lines.

However, if the transfer bias voltage is not supplied, the true exposed portion potential $V_L$ can also be detected with stability, and therefore, the image deterioration such as line thinning does not appear, and the present embodiment is very effective in the detection of the potential $V_L$.

As described in the 17th–19th embodiments, the photosensitive member having the exposed portion potential $V_L$ is charged through contact AC charging process, and the influence of the erroneous measurement attributable to the provision of the transfer member can be prevented upon measurement of the DC current flowing at the time of charging the photosensitive member. Then, the exposure means is controlled to prevent deterioration of the image quality resulting from variation of the potential $V_L$ because of various factors, so that the potential $V_L$ can be maintained with higher accuracy.

It is possible to provide a highly reliable effects only by the measurement of the charging DC current without provision of any particular means for measuring the potential $V_L$ such as conventional potential measuring device or the like. More particularly, the maintenance for the exposure amount which has been carried out at the time of installing the main assembly of an electrophotographic apparatus, can be eliminated. In the case of a process unit of a cartridge type, the conventional sensitivity index for transmitting the sensitivity of the photosensitive member to the main assembly of the image forming apparatus, can be omitted.

20th Embodiment (FIGS. 39–43)

The structure of the printer as the image forming apparatus is the same as in FIG. 1 of the tenth embodiment. The method of detecting the thickness of the photosensitive film will be described. In order to effect a contact AC charging of the photosensitive member 2, the DC roller 1 is supplied with a DC biased AC voltage. The DC voltage V3 is −700 V which corresponds to the dark portion potential of the photosensitive member.

As an AC voltage, a peak-to-peak voltage which is not less than twice as high as the charge starting voltage Vth from the standpoint of converging the potential, and therefore, a constant voltage of 1800 V is used as the peak-to-peak voltage in this embodiment. It is possible to carry out an AC constant current control to remove the influence of an impedance change of the charging member 1. In an electrophotographic process, as a pre-process for image formation, electric discharge is carried out during the pro-rotation in usual case in order to remove the electrical potential hysteresis of the photosensitive member 2. As for the discharging means, pro-exposure is usable. Alternatively, it is possible when a contact type AC charging is used that the photosensitive member potential is rendered 0 by setting the DC voltage V2 to 0 to be biased to the AC voltage, utilizing the converging property of the potential.

Figure 39:
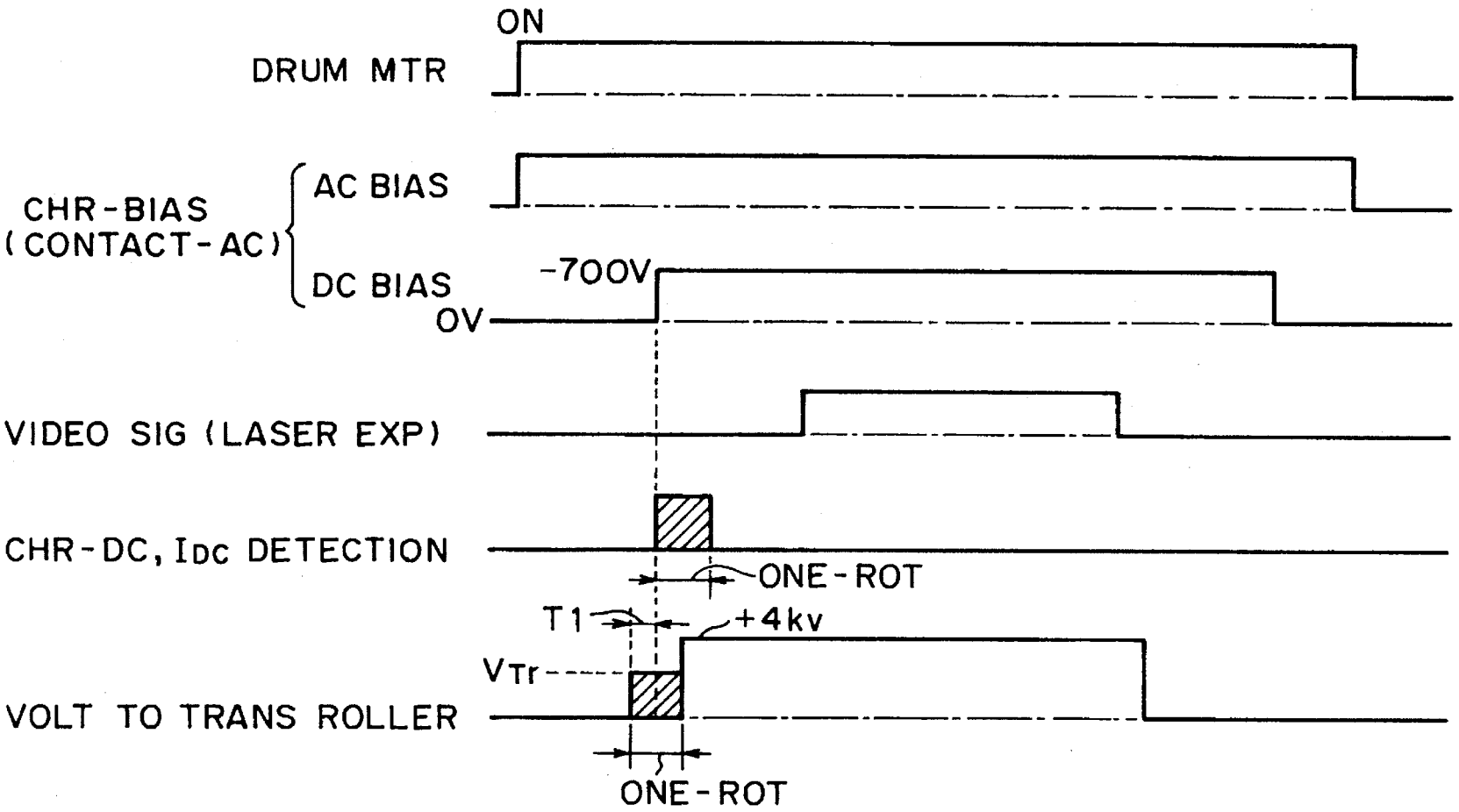
FIG. 39 shows sequential operations for control of an apparatus according to a 20th embodiment of the present invention.
Figure 40:
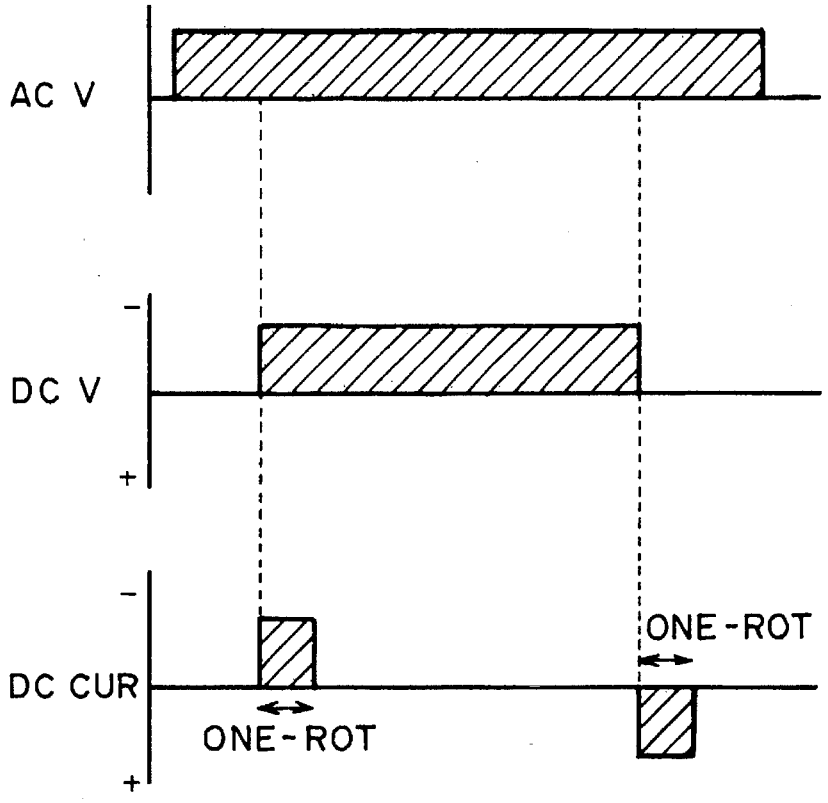
FIG. 40 shows a primary DC current waveform used in the layer thickness detection.
Figure 41:
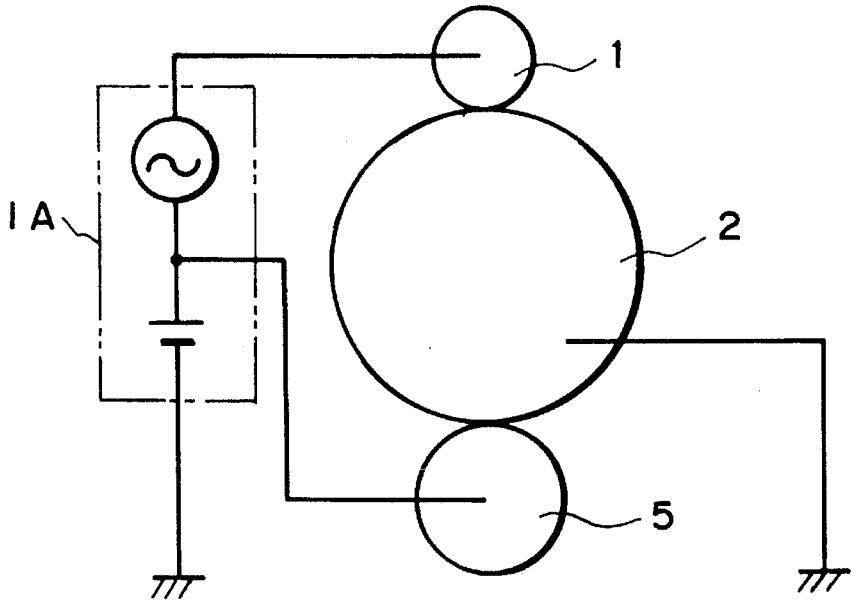
FIG. 41 illustrates a manner of voltage application.

Next, for the image formation, as shown in the sequential operation shown in FIG. 39, DC bias voltage is set to be V3=−700 in the charging operation. At this time, the DC charging current required for increasing the potential of the surface of the photosensitive member by Vcontrast, flows during one rotation of the photosensitive member, as shown in FIG. 40. After it is charged to −700 V, the charging DC current does not flow unless the surface potential of the photosensitive member changes, if the image exposure is not carried out, and if the dark decay or the like is neglected.

However, since the transfer roller 5 is contacted to the photosensitive member 2, the photosensitive drum 2 is charged or discharged by the voltage applied to the transfer roller, and therefore, the surface potential of the photosensitive member is changed.

In consideration, the voltage applied to the transfer roller is controlled during the DC charging current detection for one rotation of the photosensitive member. For the purpose of preventing charging or discharging of the photosensitive member 2 by the transfer roller 5, the difference between the voltage Vtr applied to the transfer roller and the surface potential V2 of the photosensitive member 2 is made not more than a charge starting voltage Va at which the transfer roller 5 starts to charge the photosensitive member 2.

When the transfer roller 5 is made of an intermediate resistance material having a specific resistivity of $10^8$–$10^{10}$ ohm.cm, the voltage Va is approx. 800 V, and therefore, $|Vtr-V1| \leqq 800$. Since V2 is 0 V, $-800 \leqq Vtr \leqq +800$.

In the foregoing, the case is taken in which a DC current flowing at the time of charging from V2 is 0 V to V3=−800 V. However, the same applies to the case in which the discharging is carried out from V2=−700 V to V3=0 V. In that case, $-1500 \leqq Vtr < +100$ results.

Any of the above values of Vtr is quite different from the actual transfer voltage (approx. +4 KV), and therefore, another voltage is set for the purpose of detection in this embodiment. Particularly if Vtr=0 V, it is not required to set another applied voltage level, and it will suffice if the output is simply stopped or put into floated state. Referring to the sequence shown in FIG. 39, the above will be described further in detail. When the charging operation is carried out with V2=0 and V3=−700, the transfer roller 5 is supplied with Vtr T1 earlier than the start of the DC current detection, for one rotation of the photosensitive member. Here, the time period T1 is the time required for a certain position of the drum to move from the transfer position to the charging position. The same applies to the case of discharging from V2=−700 V to V3=0.

In the above, only the transfer roller 5 has been described. When a separation charger for separating a transfer material from the photosensitive member is provided, it is subjected to the same operation.

As regards equation (5), $\epsilon=3$, $\epsilon O=8.85\times10^{-12}$ (F/m), L=230 mm, Vp=95 mm/sec. $V_D$=−700 V, and therefore, I=16 μA if d is 25 microns, in this embodiment.

Figure 42:
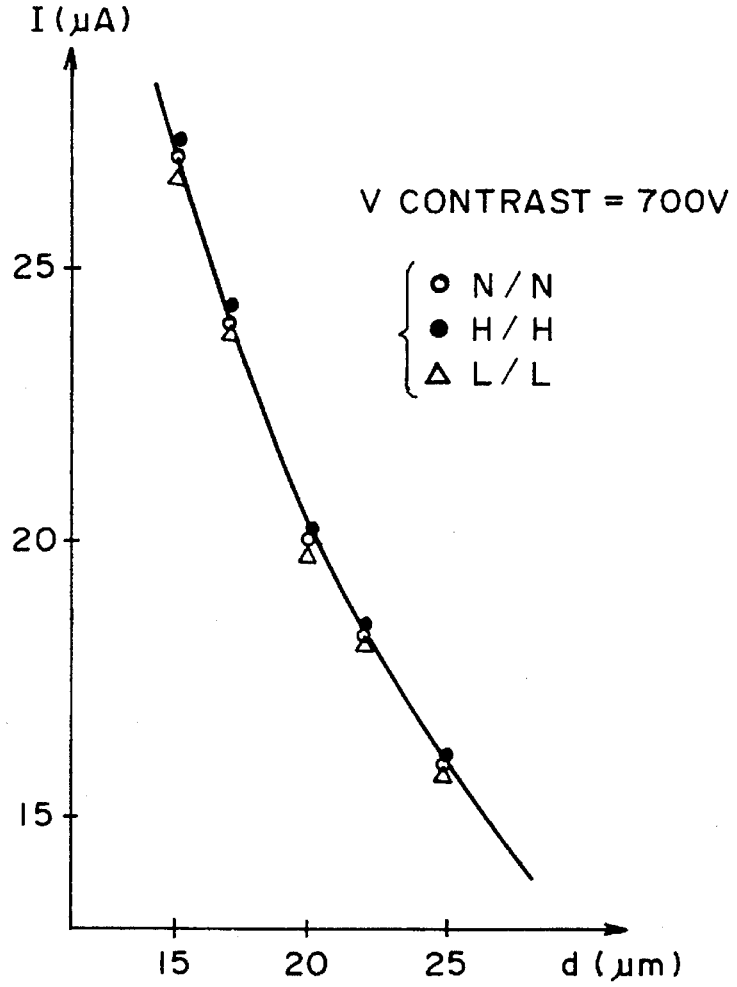
FIG. 42 is a graph of a relation between a photosensitive layer thickness d and a charging DC current I.
Figure 43:
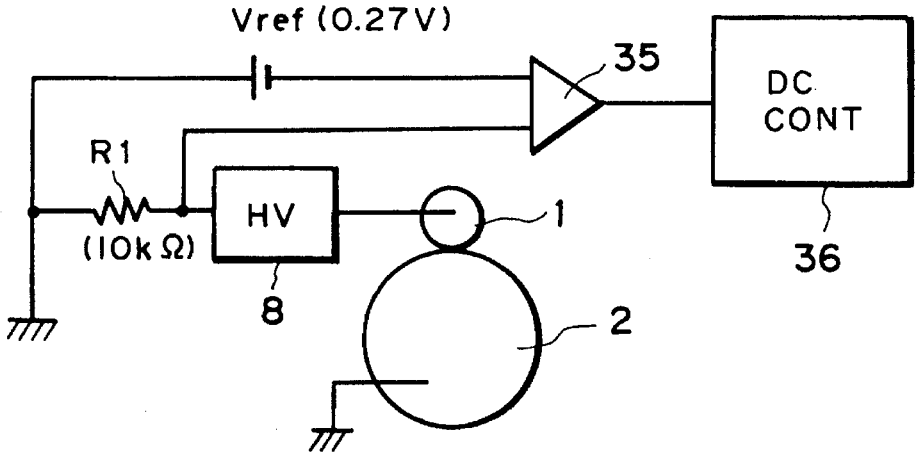
FIG. 43 schematically shows a primary DC current detecting circuit.

Using photosensitive members 2 having different film thicknesses, the relations of d/I have been measured under H/H condition, N/N condition and L/L condition. The results are shown in FIG. 42. As will be understood, the relation d/I does not depend on the ambience, as expected from the theoretical analysis.

On the basis of these results, means is provided to worn the end of the service life when the current exceeds the one corresponding to 15 microns of the CT film thickness which is considered as the end of the service life of the photosensitive member 2.

Referring to FIG. 42, the current I required for charging the 15 μ-thickness film is 27 μA under all conditions, and therefore, when a voltage V across a resistor R1 having a resistance of 10 kΩ exceeds 0.27 V corresponding to 27 μA, a warning lamp on the front of the main assembly of the printer is actuated.

More particularly, the voltage across the protection resistor (10 kΩ) R1 in the high voltage circuit is compared with a reference voltage Vref=0.27 V, and when a comparator 15 produces an output, the service life end signal is transmitted to the DC controller 36.

In this embodiment, the voltage V is an average of signals obtained during one rotation of the photosensitive member after the DC bias voltage is increased from 0 V to $V_D$ in synchronism with the sequential operation of the main assembly.

In an actual durability test, the voltage increases with time of run, and the warning is produced after 10000 sheets are processed (the CT layer is scraped by 10 microns) and the rest is 15 microns, under all of the above conditions. Thus, the improper image formation due to the scraping can be prevented beforehand.

Since the contact type charging is used in this embodiment, all of the current flowing through the charging member corresponds to the charge amount for charging or discharging the photosensitive member 2, and therefore, the charging current or discharging current can be directly detected only by detecting this current. This is very simple as compared with the case of corona charger in which the shield current is required to be separated, or the electric current flowing into the photosensitive member without the developing or transfer current is required to be measured.

In this embodiment, the transfer device is in the form of a transfer roller, however, as the transfer apparatus, a transfer belt or block are usable.

Figure 44:
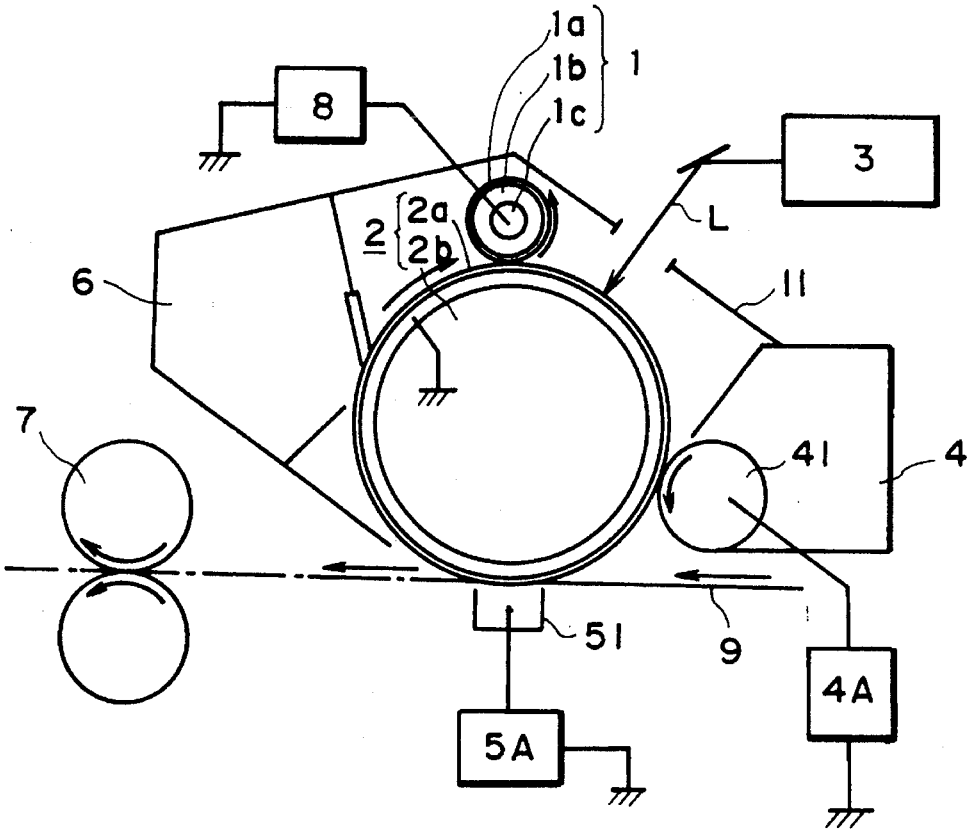
FIG. 44 schematically illustrates an apparatus according to a 21st embodiment of the present invention.
Figure 45:
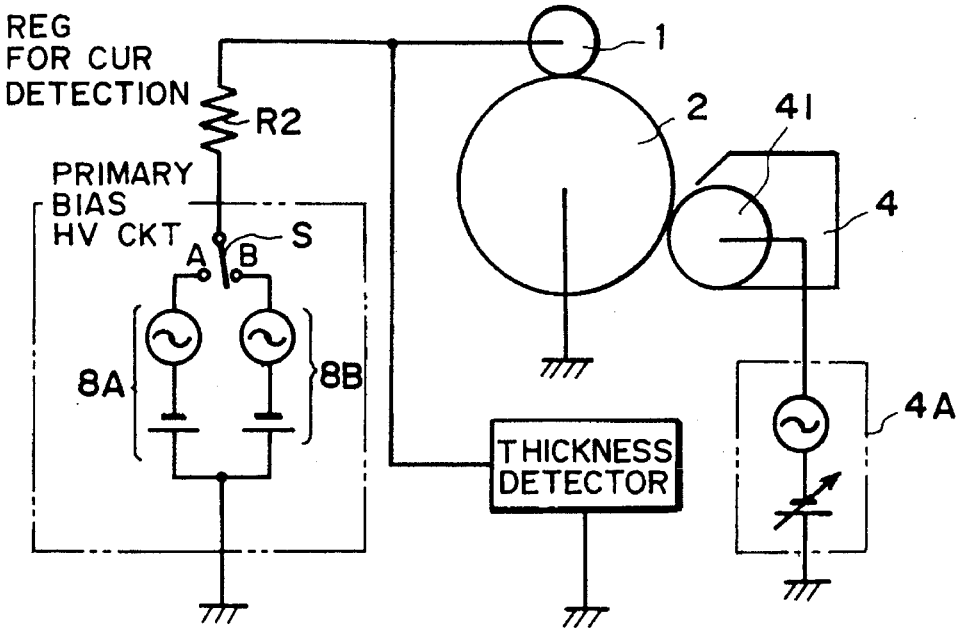
FIG. 45 shows a major part of an apparatus according to a 22nd embodiment of the present invention.

21st Embodiment (FIG. 44)

In the 20th embodiment, the contact type transfer has been described. In this embodiment, as shown in FIG. 44, the transfer device is in the form of a corona transfer charger 51. The method of detecting the thickness of the photosensitive film of the photosensitive member in this embodiment is substantially the same as in the 20th embodiment. What is different is that, the voltage Vtr applied to the corona transfer charger 51 is made not more than corona charge starting voltage Vb only during the charging DC current detection. The sequential operations are as shown in FIG. 39. Similarly to the 20th embodiment, the current detection may be effected during the charging or discharging operation.

The voltage Vtr may be 0 V, and in that case, it is not necessary to set another voltage for the detection, but it will suffice if the applied voltage is stopped.

In this embodiment, only the corona charger 51 has been described as an element for changing the surface potential of the photosensitive member. However, if there is provided a separation charger for separating a transfer sheet from the photosensitive member 2, the same control operation is carried out. In that case, the voltage VSP applied to the separation charger is made not more than the corona discharging start voltage Vb, or if a grid is provided, the grid voltage Va is desirably equal to the surface potential V2 of the photosensitive member 2.

In the 20th and 21st embodiments, in an image forming apparatus in which a contact type AC charging is carried out, and there is provided a transfer device supplied with a voltage, a DC current flowing through the contact charging member when the photosensitive member is charged or discharged by a predetermined degree Vcontrast, and the transfer voltage during the DC current measurement is controlled, by which the charge potential of the photosensitive member is not changed, so that the film thickness of the member to be charged can be correctly measured. When the thickness reduces beyond a predetermined degree, a warning signal is produced, so that the improper image formation in an electrophotography can be prevented beforehand.

Unlike the method of detecting a DC current flowing at the ground side of the photosensitive member, the DC current flowing through the charging member is detected, so that only the electric current contributable to the charging can be correctly detected. There is no need of using any particular means for measuring the film thickness, and therefore, the low cost and reliable apparatus can be provided.

22nd Embodiment (FIG. 35)

FIG. 40 shows a structure of a major part of a printer according to this embodiment, in which there are provided a high voltage source 8A operated during image formation and a voltage source 8B operated during current detecting operation, in a primary bias high voltage circuit 8 for the charging roller 1.

During the image formation, a switch S in a high voltage circuit 8 for the primary bias is at A side, and the high voltage circuit 8A at A side is interrelated with a developing bias voltage to change the charging voltage $V_D$ in the range of −650—750 V in response to the image density dial.

On the other hand, during the current measurement, the switch S in the primary bias high voltage circuit 8 is switched to B side, so that the voltage applied to the charging roller 1 is made a constant DC voltage $V_M$, by which the charging DC current $I_{DC}$ can be detected irrespective of the setting of the image density dial.

More particularly, for the purpose of charging DC current $I_{DC}$, a DC current through a protection resistor R2 of the primary bias high voltage circuit 8. In this embodiment, in order to reduce the measurement error, the signals obtained during rotation of the photosensitive member when the exposed portion potential $V_L$ after the laser exposure is increased to a DC current constant voltage $V_M$ application in synchronism with the sequential operation of the main assembly, are averaged for the measurement.

When the DC current was actually detected, the DC charging current which changed between 11.6–13.9 μA due to image density dial setting change when the measurement is carried out with the applied voltage during the image formation, could be detected irrespective of F value by switching to the DC constant voltage ($I_{DC}$=12.8 μA).

According to the control of this embodiment, a simple measuring device can be accomplished without influence of the F value, the complication or cost increase in the measuring device correctly operable irrespective of the density dial change.

Figure 46:
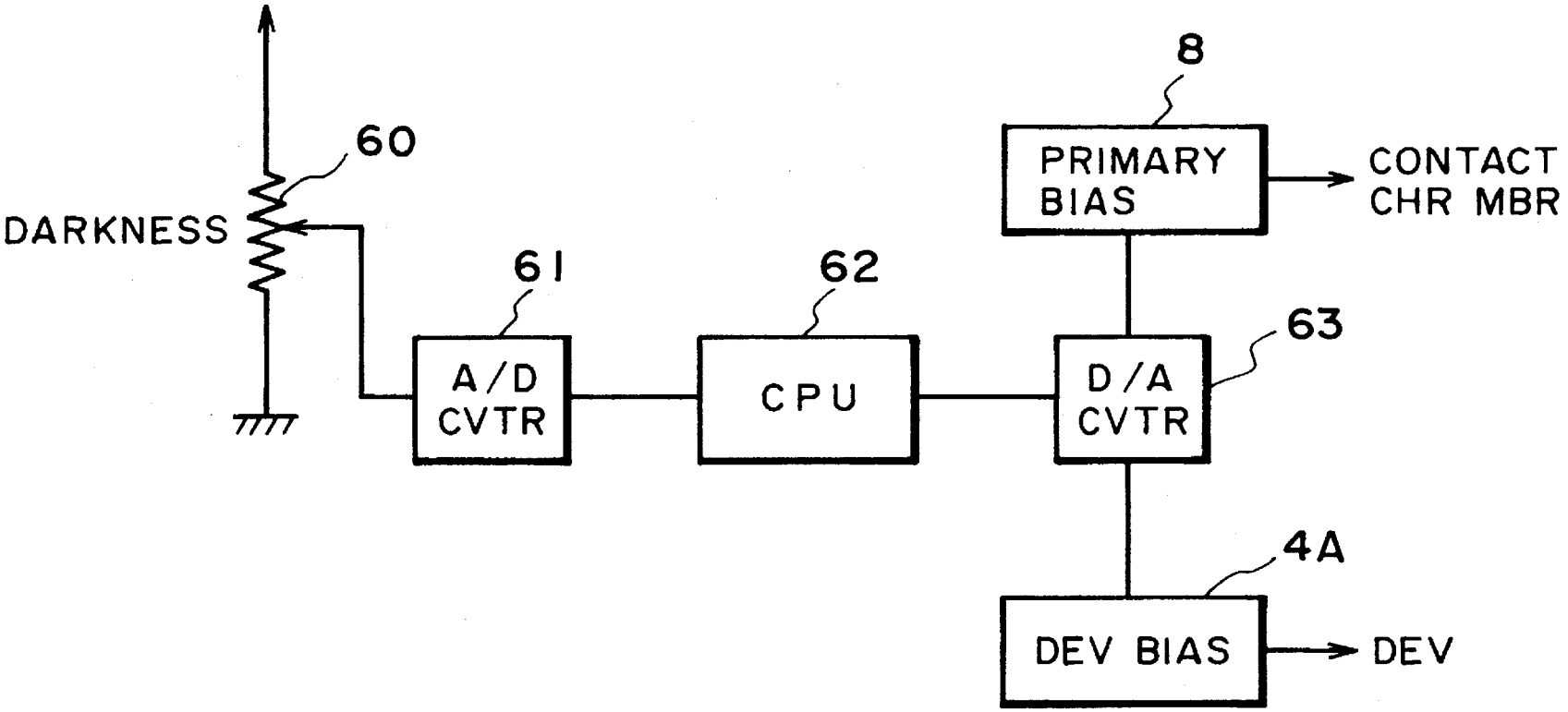
FIG. 46 is a block diagram of a control system for an apparatus according to a 23rd embodiment.
Figure 47:
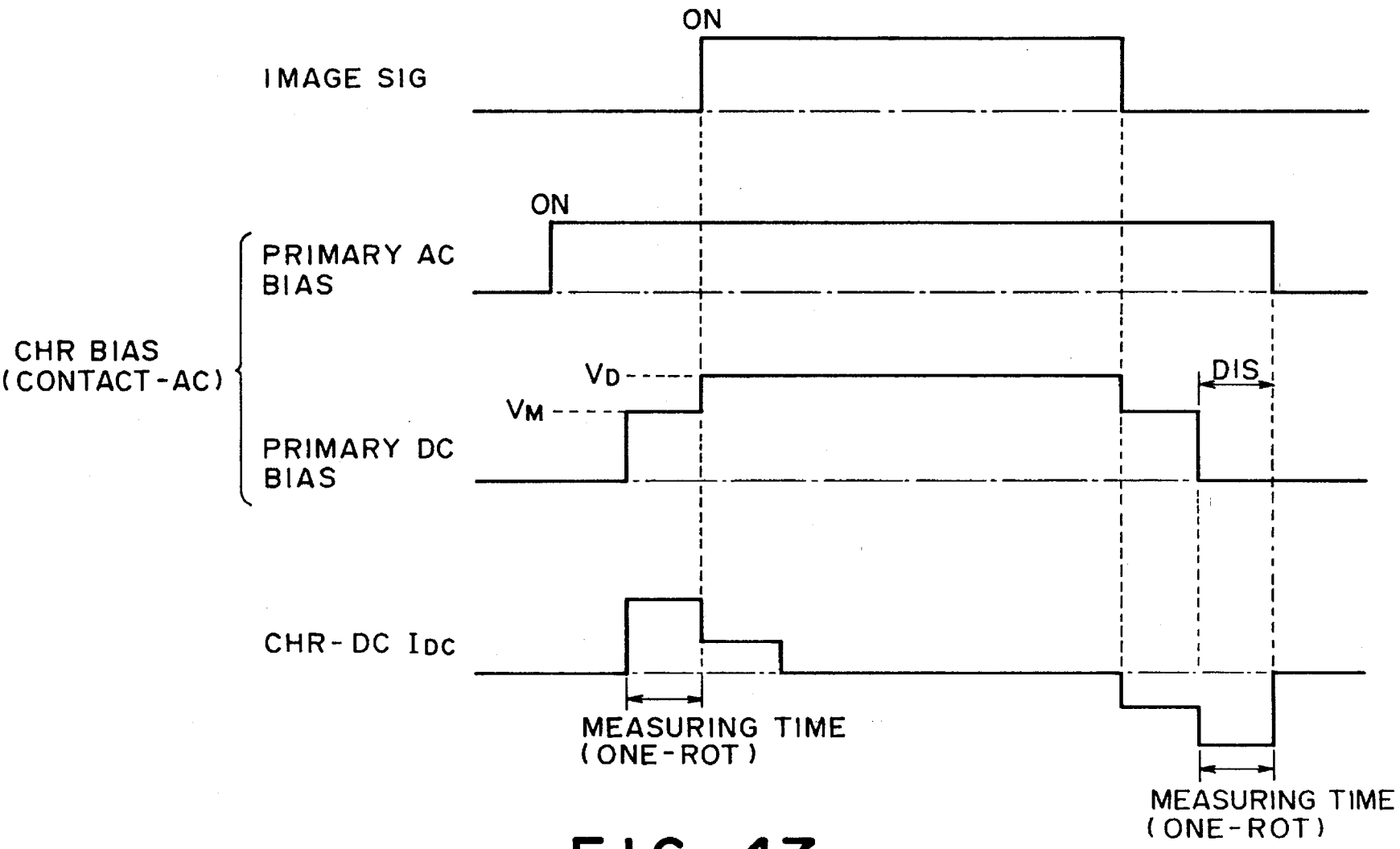
FIG. 47 shows a sequential operation for the control.

23rd Embodiment (FIGS. 46, 47 and 26)

FIG. 46 shows a density dial in a printer according to an embodiment of the present invention. FIG. 26 shows control of developing bias voltage $V_{DC}$ and charge potential $V_D$ when the density dial is changed.

When the user changes the density setting by operating a dial 60, the setting change is converged by an A/D converter 61. Then, the developing bias voltage and the charge voltage are calculated by a CPU 62 in accordance with the change degree. A control signal is transmitted to high voltage sources 8 and 4*a* through a D/A converter 63. And voltages for adjusting the development contrast and a reverse contrast are applied, thus accomplishing the image density and image line width desired by the user.

On the other hand, in order to measure the charge current, the voltage applied during the image formation or the measurement is switched in response to a control signal supplied from the CPU 62.

More particularly, the CPU controls in accordance with the users setting during the image formation and controls to provide a constant voltage $V_M$ for the charging voltage of the primary bias source 1*a* during the charging DC current measurement.

FIG. 47 shows a sequential operation of the current measurement. As shown in the Figure, when the image signal is produced, the primary DC bias voltage is set to $V_D$ response to a density volume, and during non-image forming operation, a constant charging voltage $V_M$ is provided. The detecting period for the charging DC current, corresponds to one full rotation of the photosensitive member after start of the application of the charging voltage $V_M$ to the photosensitive member 1 after being discharged to the potential 0 V. The measurements are averaged to increase the measurement accuracy.

Actually, the charging current was measured. When the measurement was carried out with the applied voltage during the image formation, the current $I_{DC}$ varies in the range of 15.1–17.4 μA by operating the density dial. However, when it is switched to a DC constant voltage, $I_{DC}$=16.2 μA was detected irrespectively of the F value.

According to the control operation of this embodiment, the measuring device is not influenced by the change of the F value, and in addition, the complication or cost increase of the measuring device permitting the density setting change, can be prevented.

Figure 48:
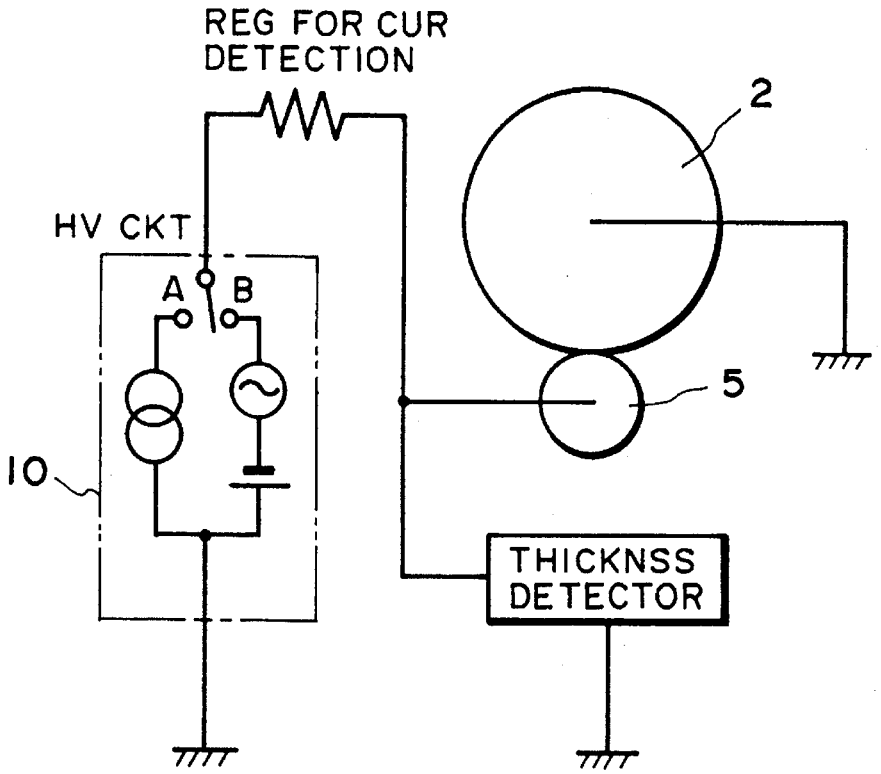
FIG. 48 schematically shows a major part of an apparatus according to a 24th embodiment of the present invention.

24th Embodiment (FIG. 48)

in this embodiment, the film thickness of the photosensitive layer is detected using a contact transfer member (transfer roller) 5. FIG. 48 shows a general structure of a major part thereof.

In this printer, a bias voltage is applied to a conductive contact transfer member 5 in the form of a roller, it is press-contacted to the transfer material to accomplish transfer of the toner image, When there is no transfer material between the transfer roller 5 and the photosensitive member 2 the transfer roller 5 is contacted to the photosensitive member 2. Therefore, it is possible to detect the film thickness d of the photosensitive layer of the photosensitive member 2.

In this embodiment, in order to accomplish good toner image transfer irrespective of the material of the transfer sheet, a certain degree of electric charge is applied to the backside of the transfer sheet. As a method for this, a bias condition supplied to the transfer roller 5 is controlled to be a constant current control. The transfer voltage is of the positive polarity because a reverse development is used in this embodiment. The OPC photosensitive member 2 is used in this embodiment has a negative charging property, and therefore, has positive carriers. Accordingly, the photosensitive member 2 is charged to the positive polarity, and the resistor thereof decreases.

Therefore, the applied voltage changes depending on the resistance of the transfer material and the resistance of the transfer roller 5, and therefore, the Vcontrast in equation (5) is not determined. In addition, in the case of the positive bias voltage, the relation I=K×Vcontrast/d does not apply, and therefore, the film thickness detection is not possible with the present transfer bias.

In consideration of the above, in this embodiment, during the current measurement for the detection of the thickness of the photosensitive layer, the voltage applied to the transfer roller is switched from the positive current control during the image formation to a negative constant voltage, thus enabling the measurement to be executed. More particularly, during the measurement of the transfer current, the bias voltage of the transfer roller in the non-image-forming operation is electrically switched to the constant voltage side (switch B side in the high voltage circuit 10 in FIG. 48). The bias voltage of the transfer roller 5, similarly to the primary charging, is fixed (AC=1800 Vpp, 500 Hz, DC=–700 V), and the DC current flowing through the protection resistor R1 of the high voltage circuit 10.

The actual measurement operation was performed. The DC current which could not be measured when the control of this embodiment was not carried out (FIG. 48, switch A side), was measured as $I_{DC}$= 16.2 μA by the constant voltage application described above. Using equation (5), the film thickness d was calculated as 25 microns. The film thickness of the photosensitive layer was measured as 25 microns, and therefore, the correctness of the control of this embodiment was proved.

As described above, the film thickness measurement using the transfer roller 5 can be accomplished using the control of this embodiment.

As described in the above 22nd, 23rd and 24th embodiments, a charge potential of the member to be charged is charged or discharged by a predetermined degree Vcontrast using a contact type charging member. The DC current flowing at this time is measured. At that time, a constant voltage is applied irrespective of various parameters of the electrophotographic process operation. By doing so, the complication of the measuring device resulting from difference of the process parameters, can be reduced, and the exposed portion potential $V_L$ of the member to be charged or the film thickness d thereof can be measured at low cost.

Figure 49:
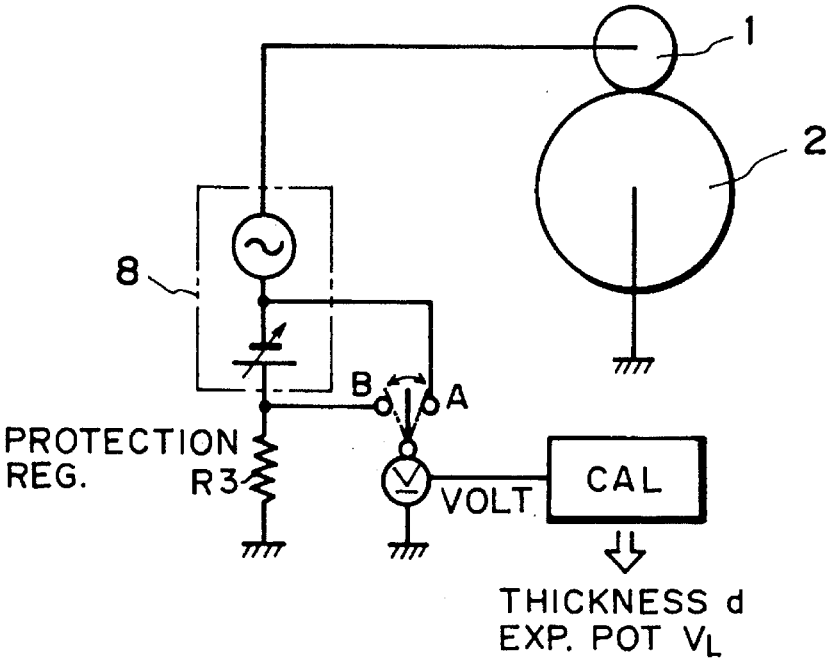
FIG. 49 schematically shows a major part of an apparatus according to a 25th embodiment of the present invention.

25th Embodiment (FIG. 49)

FIG. 49 is a schematic view of a major part of a printer according to this embodiment. The printer of this embodiment comprises a circuit for measuring a DC voltage $V_D$ (charge potential) in a primary bias high voltage circuit 8 for the charging roller 1, and a circuit for measuring the charging DC current $I_{DC}$.

The voltage $V_D$ which is a DC component of the primary bias is interrelated with a developing bias. In accordance with the image density setting, it changes in the range of –650–750 V (=$V_D$). Therefore, Vcontrast is not fixed in the equation (5). Therefore, the film thickness d and the exposed portion potential $V_L$ of the photosensitive member are not correctly detected only by measuring the charging DC current $I_{DC}$.

Therefore, in this embodiment, a switch in the primary high voltage circuit is switched to A side, and the DC voltage $V_D$ As measured during the image forming operation, but during the current measurement, the switch is actuated to the B side, so that the DC voltage across the protection resistor R3 of the primary baas high voltage circuit is measured to calculate the charging DC current $I_{DC}$. Using the measured $V_D$ and the charge DC current $I_{DC}$, the film thickness d and the exposed portion potential $V_L$ of the photosensitive member are determined using equation (5).

An example of film thickness determination will be described. A photosensitive member having a known film thickness (d=25 microns) is prepared. It is discharged and then charged from 0 V to $V_D$, and the charging DC current $I_{DC}$ at this time is measured. Depending on the image density setting, $I_{DC}$ is measured as 15.1–17.4 μA. If the calculation is tried without detection of the voltage $V_D$, a voltage of –700 V is used as the voltage $V_D$ since it is not known, and then, the film thickness d of 23.3–26.9 microns are obtained. Then, the control of this embodiment is carried in which the switch is changed after measurement of the voltage $V_D$, and the charging current $I_{DC}$ was measured and calculated. The, the obtained film thickness d was 25 microns.

Thus, it has been proved that the state of the photosensitive member can be correctly detected in accordance with the difference of the process parameters in the electrophotographic process due to the image density setting difference.

Figure 50:
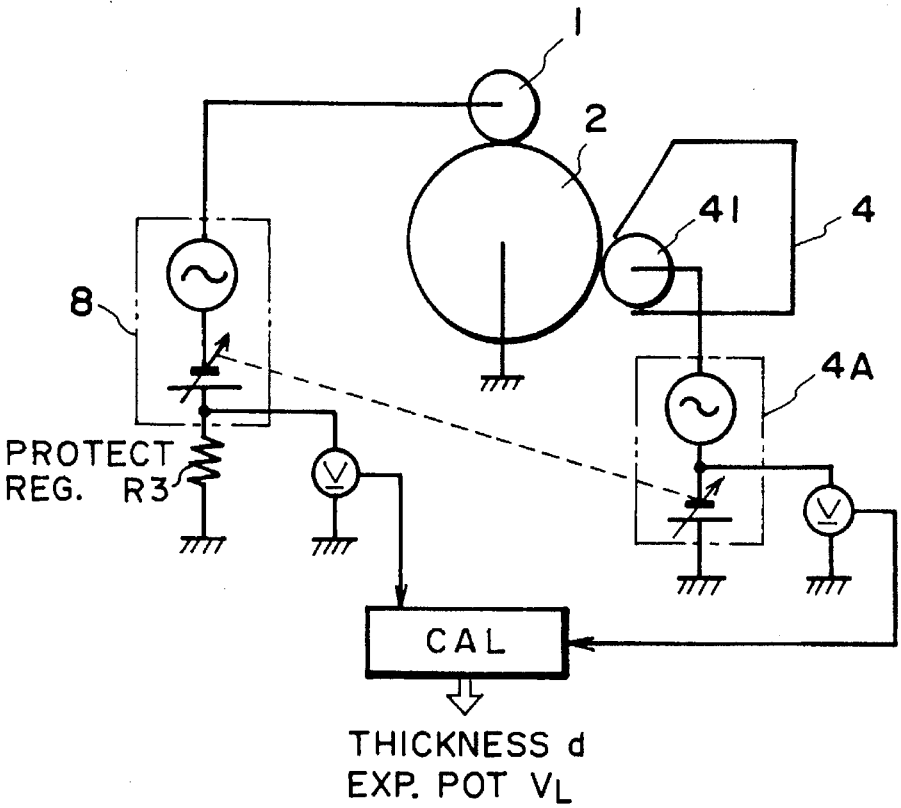
FIG. 50 schematically shows a major part of an apparatus according to a 25th embodiment of the present invention.
Figure 51:
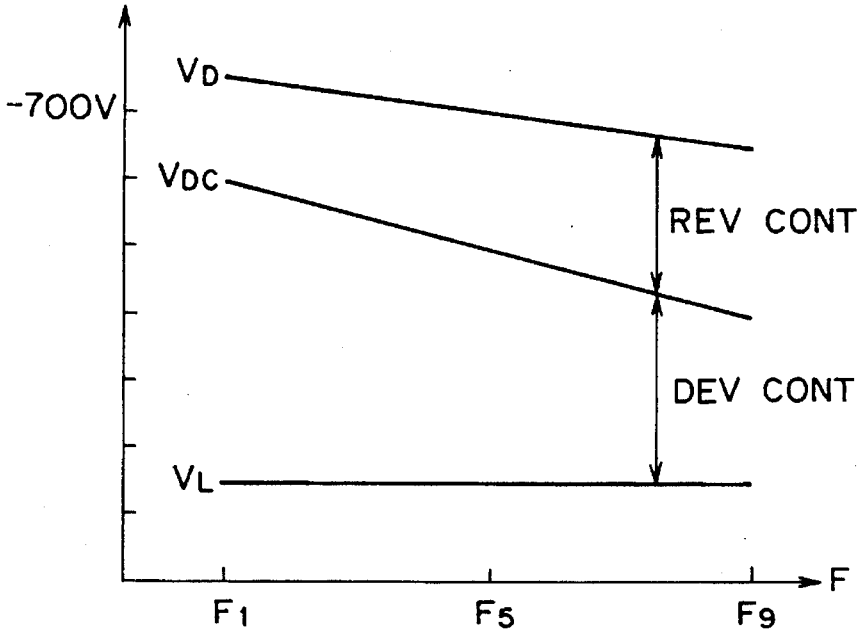
FIG. 51 schematically shows control operations for the developing bias and charging voltage when the image density setting is changed.

26th Embodiment (FIGS. 50 and 51)

FIG. 50 shows a major part of a printer according to this embodiment. In this embodiment, the printer uses a contact AC charging. In addition, a developing bias high voltage circuit 4A is provided with a circuit for measuring a DC voltage.

During image formation, the DC voltage $V_{DC}$ of the developing bias is interrelated with a DC current $V_D$ for the primary bias high voltage circuit B, and changes in response to the density setting dial, as follows:

Developing bias voltage $V_{DC}$=−400—600 V

Primary bias DC voltage $V_D$=−650—750 V as shown in FIG. 51.

On the other hand, during the current measurement, a DC voltage $V_{DC}$ of the developing bias applied to the developing roller 41 during the current measurement is detected by a voltmeter (1), and from the relation of the developing voltage $V_{DC}$ measurement and FIG. 51, the voltage $V_D$ is determined. Simultaneously, from the voltage across the protection resistor R3 for the primary bias measured by a voltmeter (2), the charging DC current $I_{DC}$ is calculated. Using the current $I_{DC}$ and the voltage $V_D$, the film thickness d and the exposed portion potential $V_L$ of the photosensitive member are determined using equation (5).

More particularly, for the measurement of the charging DC current $I_{DC}$, as shown in FIG. 50, the DC voltage across the protection resistor R3 of the primary bias high voltage circuit is measured, and the calculation is made. In this embodiment, in order to reduce the measurement error, an average of the signals produced during one rotation of the photosensitive member when the potential of the surface thereof is increased from the exposed portion potential $V_L$ after the laser beam exposure or 0 V after the discharging operation to the potential when the voltage $V_D$ is applied, in synchronism with the sequential operation of the main assembly of the printer.

An example of actual measurement will be described in which the exposed portion potential $V_L$ is measured. When the density setting is changed, the charging DC current $I_{DC}$=11.6–13.9 μA is measured in accordance with the density setting. Using −700 V as the voltage $V_D$, $V_L$=−100—200 V result, which means that the voltage $V_L$ changes depending on the F value.

Then, the control operation according to this embodiment is carried out, and the developing bias voltage $V_{DC}$ was measured simultaneously with the charging current measurement. Then, calculation is made using the voltage $V_D$ calculated, $V_L$=−150 V is measured irrespective of the F value.

According to the control operation of this embodiment, the state of the photosensitive member can be correctly detected irrespectively of the difference of the electrophotographic process parameters resulting from change of the image density setting.

Figure 52:
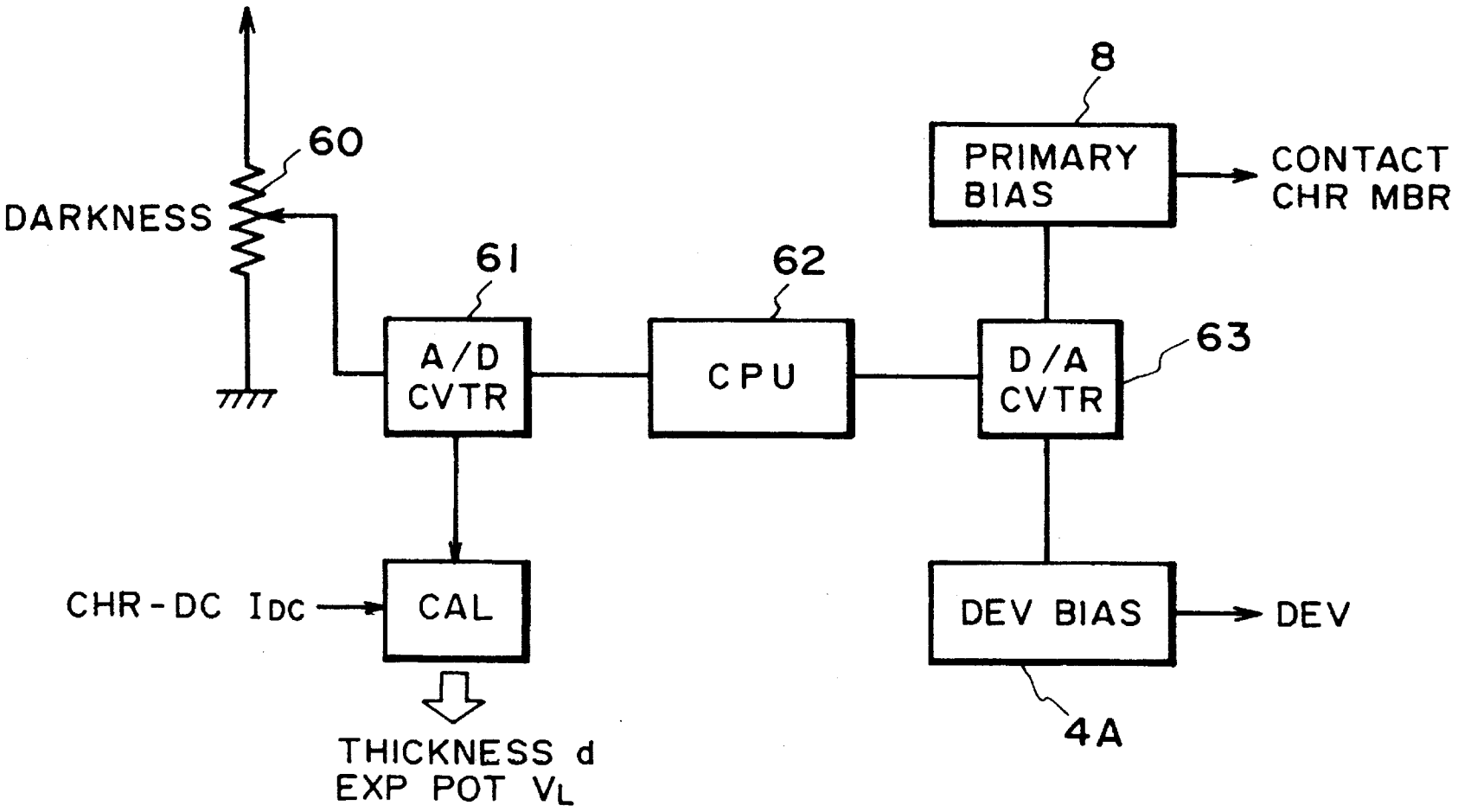
FIG. 52 is a block diagram of a control system in an apparatus according to a 27th embodiment of the present invention.

27th Embodiment (FIG. 52)

FIG. 28 shows a density setting dial in a printer according to this embodiment.

When the user changes the image density setting by operating a dial 60, the amount of change is converted by an A/D converter 61. The CPU 62 calculates the developing bias voltage and the charge voltage in accordance with the change amount, and a control signal is supplied to high voltage sources 1A and 4A through a D/A converter 63. Then, voltages for development contrast control and the reverse contrast control are applied to provide the image density and the line width desired by the user.

In this embodiment, the signal for transmitting the change amount through the A/D converter 61 to the CPU 62, or a control signal supplied from the CPU 62 to the D/A converter 63, is read, and from the read, the DC voltage $V_D$ applied during the charging operation can be determined.

Shown in FIG. 52 is a signal transmitted from the A/D converter 61 to the CPU 62. Using the DC voltage $V_D$, and the simultaneously detected charging DC current $I_{DC}$, the film thickness d and the exposed portion potential $V_L$ of the photosensitive member are detected.

Similarly to 25th and 26th embodiments, the above-described control is effective to permit correct detection of the state of the photosensitive member despite the change in the electrophotographic process parameters resulting from the change of the desired image density setting.

According to the 25th and 26th embodiments, when the DC current flowing upon charging or discharging the member to be charged or discharged by a predetermined degree Vcontrast using a contact charging member, a DC voltage applied to the contact charging device and corresponding to the charge potential is detected beforehand. Using the voltage, the film thickness and the exposed potential $V_L$ of the photosensitive member is calculated by the provided means. By doing so, even if the electrophotographic process parameter is changed, the thickness and the potential $V_L$ can be correctly detected.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member having an image bearing layer for bearing an image;

a charging member, contactable to said image bearing member, for charging said image bearing member; and detecting means for detecting an electric current flowing through said charging member at a time when a predetermined area of said image bearing member, which has been charged to a potential V1 by said charging member supplied with a first voltage, is charged to a potential V2 by said charging member supplied with a second voltage different from said first voltage;

wherein, in the case an increase of electric current is detected, a decrease of a thickness of said image bearing layer can be determined.

2. An apparatus according to claim 1, further comprising display means for making a display when the current exceeds a predetermined range.

3. An apparatus according to claim 1, wherein said image bearing member is rotatable, and wherein said area of said image bearing member corresponds to one full-rotation of said image bearing member.

4. An apparatus according to claim 1, wherein when the potential V1 is provided, said charging member is provided with a first oscillating voltage, and when the potential V2 is provided, said charging member is supplied with a second oscillating voltage.

5. An apparatus according to claim 1, wherein the potential V1 is substantially 0.

6. An apparatus according to claim 4, wherein the potential V1 is substantially 0, and an oscillation center of the first oscillating voltage is substantially 0.

7. An apparatus according to claim 1, wherein the potential V2 is substantially 0.

8. An apparatus according to claim 4, wherein the potential V2 is substantially 0, and an oscillation center of the second oscillating voltage is substantially 0.

9. An apparatus according to claim 1, wherein said detecting means is provided with a frequency filter for filtering out frequencies outside a predetermined range.

10. An apparatus according to claim 1, wherein said image bearing member is provided with a photosensitive layer, and said apparatus comprising exposure means for said image bearing member.

11. An apparatus according to claim 10, wherein an image forming condition for said image bearing member is determined in accordance with a second electric current flowing through said charging member when said charging member changes the potential of a predetermined area of said image bearing member from $V_L$ which is provided by exposure means after detection by said detecting means, to a potential V3 which is different from the potential $V_L$.

12. An apparatus according to claim 1, further comprising transfer means for electrostatically transferring an image from said image bearing member onto a transfer material.

13. An apparatus according to claim 12, wherein said transfer means does not charge said image bearing member when said charging member changes the potential of said image bearing member from V1 to V2.

14. An apparatus according to claim 11, further comprising transfer means for electrostatically transferring an image from said image bearing member onto a transfer material.

15. An apparatus according to claim 14, wherein said transfer means does not charge said image bearing member when the potential of said image bearing member is changed from $V_L$ to V3.

16. An apparats according to claim 1, wherein an image forming condition for said image bearing member is determined in accordance with the current detected by said detecting means.

17. An image forming apparatus, comprising:

an image bearing member having an image bearing layer for bearing an image;

a first charging member, contactable to said image bearing member, for receiving a first oscillating voltage to charge said image bearing member;

a second charging member, contactable to said image bearing member, for being supplied with a second oscillating voltage to charge said image bearing member, wherein an oscillation center of said second oscillating voltage is different from that of the first oscillating voltage; and detecting means for detecting an electric current flowing through said second charging member when said second charging member changes a potential of a predetermined area of said image bearing member from a potential V1, which is provided by said first charging member, to a potential V2 which is different from the potential V1, wherein, in the case said detected electric current increases, a decrease of a thickness of said image bearing layer can be determined.

18. An apparatus according to claim 17, further comprising display means for making a display when the current exceeds a predetermined range.

19. An apparatus according to claim 17, wherein the potential V1 is substantially 0.

20. An apparatus according to claim 19, wherein an oscillation center of said first oscillating voltage is substantially 0.

21. An apparatus according to claim 17, wherein the potential V2 is substantially 0.

22. An apparatus according to claim 21, wherein an oscillation center of the second oscillating voltage is substantially 0.

23. An apparatus according to claim 17, wherein said detecting means is provided with a frequency filter for filtering out frequencies outside a predetermined range.

24. An apparatus according to claim 17, wherein said first charging member transfers an image from said image bearing member to a transfer material.

25. An apparatus according to claim 17, wherein said image bearing member is provided with a photosensitive layer, and said apparatus comprising exposure means for said image bearing member.

26. An apparatus according to claim 25, wherein an image forming condition for said image bearing member is determined in accordance with a second electric current flowing through said first charging member when said first charging member changes the potential of a predetermined area of said image bearing member from $V_L$ which is provided by exposure means after detection by said detecting means, to a potential V3 which is different from the potential $V_L$.

27. An apparatus according to claim 17, wherein an image forming condition for said image bearing member is determined in accordance with the current detected by said detecting means.

28. An image forming apparatus, comprising:

an image bearing member having a photosensitive layer;

a charging member, contactable to said image bearing member, for receiving an oscillating voltage to charge said image bearing member;

exposure means for exposing said image bearing member to light; and detecting means for detecting an electric current flowing through said charging member when said charging member changes a potential of a predetermined area of said image bearing member from a potential V1 which is discharged by said exposure means, to a potential V2 which is different from the potential V1, wherein, in the case said detected electric current increases, a decrease of a thickness of the photosensitive layer can be determined.

29. An apparatus according to claim 28, further comprising display means for making a display when the current exceeds a predetermined range.

30. An apparatus according to claim 28, wherein said image bearing member is rotatable, and the area corresponds to one full-rotation of said image bearing member.

31. An apparatus according to claim 28, wherein the potential V1 is substantially 0.

32. An apparatus according to claim 28, wherein said detecting means is provided with a frequency filter for filtering out frequencies outside a predetermined range.

33. An apparatus according to claim 28, further comprising transfer means for electrostatically transferring an image from said image bearing member onto a transfer material.

34. An apparatus according to claim 33, wherein said transfer means does not charge said image bearing member when said charging member changes the potential of said image bearing member from V1 to V2.

35. An apparatus according to claim 28, wherein an image forming condition for said image bearing member is determined in accordance with the current detected by said detecting means.

36. An apparatus according to claim 28, wherein the potential V2 is substantially 0, and an oscillation center of said oscillating voltage is substantially 0.

37. An image forming apparatus, comprising:

an image bearing member having an image bearing layer for bearing an image;

a charging member, contactable to said image bearing member, for receiving an oscillating voltage to charge said image bearing member;

potential applying means for providing substantially 0 potential with said image bearing member; and detecting means for detecting an electric current flowing through said charging member when said charging member changes a potential of a predetermined area of said image bearing member from 0 V which is provided by said potential applying means to a potential V2 which is different from 0 V, wherein, in the case said detected electric current increases, a decrease of a thickness of said image bearing layer can be determined.

38. An image forming apparatus, comprising:

an image bearing member having an image bearing layer for bearing an image;

a charging member, contactable to said image bearing member, for charging said image bearing member; and detecting means for detecting an electric current flowing through said charging member at a time when an area of said image bearing member, which has been charged to a potential V1 by said charging member supplied with a first voltage, is charged to a potential V2 by said charging member supplied with a second voltage different from said first voltage;

wherein said electric current changes with a thickness of said image bearing member.

39. An apparatus according to claim 38, further comprising display means for making a display when the current exceeds a predetermined range.

40. An apparatus according to claim 38, wherein said image bearing member is rotatable, and wherein said area of said image bearing member corresponds to one full-rotation of said image bearing member.

41. An apparatus according to claim 38, wherein when the potential V1 is provided, said charging member is provided with a first oscillating voltage, and when the potential V2 is provided, said charging member is supplied with a second oscillating voltage.

42. An apparatus according to claim 38, wherein the potential V1 is substantially 0.

43. An apparatus according to claim 41, wherein the potential V1 is substantially 0, and an oscillation center of the first oscillating voltage is substantially 0.

44. An apparatus according to claim 38, wherein the potential V2 is substantially 0.

45. An apparatus according to claim 41, wherein the potential V2 is substantially 0, and an oscillation center of the second oscillating voltage is substantially 0.

46. An apparatus according to claim 38, wherein said image bearing member is provided with a photosensitive layer, and said apparatus comprising exposure means for said image bearing member.

47. An apparatus according to claim 46, wherein an image forming condition for said image bearing member is determined in accordance with a second electric current flowing through said charging member when said charging member changes the potential of a predetermined area of said image bearing member from $V_L$ which is provided by exposure means after detection by said detecting means, to a potential V3 which is different from the potential $V_L$.

48. An apparatus according to claim 38, further comprising transfer means for electrostatically transferring an image from said image bearing member onto a transfer material.

49. An apparatus according to claim 48, wherein said transfer means does not charge said image bearing member when said charging member changes the potential of said image bearing member from V1 to V2.

50. An apparatus according to claim 38, wherein an image forming condition for said image bearing member is determined in accordance with the current detected by said detecting means.

51. An image forming apparatus, comprising:

an image bearing member having an image bearing layer for bearing an image;

a charging member, contactable to said image bearing member, for charging said image bearing member;

detecting means for detecting an electric current flowing through said charging member, which has been charged to a potential V1 by said charging member supplied with a first voltage, is charged to a potential V2 by said charging member supplied with a second voltage different from said first voltage; and comparing means for comparing the electric current with a predetermined current.

52. An apparatus according to claim 51, further comprising display means for making a display when the current exceeds a predetermined range.

53. An apparatus according to claim 51, wherein said image bearing member is rotatable, and wherein said area of said image bearing member corresponds to one full-rotation of said image bearing member.

54. An apparatus according to claim 51, wherein when the potential V1 is provided, said charging member is provided with a first oscillating voltage, and when the potential V2 is provided, said charging member is supplied with a second oscillating voltage.

55. An apparatus according to claim 51, wherein the potential V1 is substantially 0.

56. An apparatus according to claim 54, wherein the potential V1 is substantially 0, and an oscillation center of the first oscillating voltage is substantially 0.

57. An apparatus according to claim 51, wherein the potential V2 is substantially 0.

58. An apparatus according to claim 54, wherein the potential V2 is substantially 0, and an oscillation center of the second oscillating voltage is substantially 0.

59. An apparatus according to claim 51, wherein said image bearing member is provided with a photosensitive layer, and said apparatus comprising exposure means for said image bearing member.

60. An apparatus according to claim 59, wherein an image forming condition for said image bearing member is determined in accordance with a second electric current flowing through said charging member when said charging member changes the potential of a predetermined area of said image bearing member from $V_L$ which is provided by exposure means after detection by said detecting means, to a potential V3 which is different from the potential $V_L$.

61. An apparatus according to claim 51, further comprising transfer means for electrostatically transferring an image from said image bearing member onto a transfer material.

62. An apparatus according to claim 61, wherein said transfer means does not charge said image bearing member when said charging member changes the potential of said image bearing member from V1 to V2.

63. An apparatus according to claim 51, wherein an image forming condition for said image bearing member is determined in accordance with the current detected by said detecting means.

64. An image forming apparatus, comprising:

an image bearing member having an image bearing layer for bearing an image;

a charging member, contactable to said image bearing member, for charging said image bearing member; and detecting means for detecting an electric current flowing through said charging member at a time when an area of said image bearing member, which has been charged to a potential V1 by said charging member supplied with a first voltage, is charged to a potential V2 by said charging member supplied with a second voltage different from said first voltage;

wherein a life of said image bearing member is discriminated on the basis of said electric current.

65. An apparatus according to claim 64, further comprising display means for making a display when the current exceeds a predetermined range.

66. An apparatus according to claim 64, wherein said image bearing member is rotatable, and wherein said area of said image bearing member corresponds to one full-rotation of said image bearing member.

67. An apparatus according to claim 64, wherein when the potential V1 is provided, said charging member is provided with a first oscillating voltage, and when the potential V2 is provided, said charging member is supplied with a second oscillating voltage.

68. An apparatus according to claim 64, wherein the potential V1 is substantially 0.

69. An apparatus according to claim 67, wherein the potential V1 is substantially 0, and an oscillation center of the first oscillating voltage is substantially 0.

70. An apparatus according to claim 64, wherein the potential V2 is substantially 0.

71. An apparatus according to claim 67, wherein the potential V2 is substantially 0, and an oscillation center of the second oscillating voltage is substantially 0.

72. An apparatus according to claim 64, wherein said image bearing member is provided with a photosensitive layer, and said apparatus comprising exposure means for said image bearing member.

73. An apparatus according to claim 72, wherein an image forming condition for said image bearing member is determined in accordance with a second electric current flowing through said charging member when said charging member changes the potential of a predetermined area of said image bearing member from $V_L$ which is provided by exposure means after detection by said detecting means, to a potential V3 which is different from the potential $V_L$.

74. An apparatus according to claim 64, further comprising transfer means for electrostatically transferring an image from said image bearing member onto a transfer material.

75. An apparatus according to claim 74, wherein said transfer means does not charge said image bearing member when said charging member changes the potential of said image bearing member from V1 to V2.

76. An apparatus according to claim 64, wherein an image forming condition for said image bearing member is determined in accordance with the current detected by said detecting means.

* * * * *

UNITED STATES PATENT AND TRADEMARK OFFICE

CERTIFICATE OF CORRECTION

PATENT NO. : 5,485,248

DATED : January 16, 1996

INVENTOR(S) : Hideyuki Yano, et al.

It is certified that error appears in the above-indentified patent and that said Letters Patent is hereby corrected as shown below:

IN THE DRAWINGS

Sheet 6, Figure 9, "IMAGEING" should read --IMAGING--.

COLUMN 1

Line 8, "Feb. 8, 1983," should read --Feb. 8, 1993--.

COLUMN 3

Line 28, "term" should read --term use.--.

COLUMN 9

Line 27, "dition);" should read --dition):--.

COLUMN 10

Line 67, "dry" should read --drum--.

COLUMN 11

Line 20, "voltages were applied:" should read --voltages--; and

Line 47, "M/M" should read --H/H--.

UNITED STATES PATENT AND TRADEMARK OFFICE

CERTIFICATE OF CORRECTION

PATENT NO. : 5,485,248

DATED : January 16, 1996

INVENTOR(S) : Hideyuki Yano, et al.

It is certified that error appears in the above-indentified patent and that said Letters Patent is hereby corrected as shown below:

COLUMN 12

Line 5, "converging" should read --converting-- and "level," should read --level.--; and
Line 52, "n=230" should read --L=230--.

COLUMN 15

Line 34, "as" should read --is--; and
Line 37, "In" should read --in--.

COLUMN 16

Line 36, "lead," should read --load,--; and
Line 50, "In this" should read --This--.

COLUMN 17

Line 20, "approx," should read --approx.--; and
Line 21, "11A," should read --μA,--.

COLUMN 18

Line 1, "the" (first occurrence) should be deleted.

COLUMN 20

Line 64, "port,on" should read --portion--.

UNITED STATES PATENT AND TRADEMARK OFFICE

CERTIFICATE OF CORRECTION

PATENT NO. : 5,485,248

DATED : January 16, 1996

INVENTOR(S) : Hideyuki Yano, et al.

It is certified that error appears in the above-indentified patent and that said Letters Patent is hereby corrected as shown below:

COLUMN 21

Line 36, "measurement," should read --measurement, and--; and

Line 41, "condition," should read --condition, and--.

COLUMN 22

Line 56, "stare" should read --state--; and

Line 67, "$v_M$" should read --$V_M$--.

COLUMN 23

Line 25, "$V2=IV_D)$" should read --$V2=V_D$--;

Line 30, "Is" should read --is--; and

Line 36, "Potential" should read --potential--.

COLUMN 24

Line 64, "I" should read --1--.

COLUMN 25

Line 21, "I" should read --1--.

UNITED STATES PATENT AND TRADEMARK OFFICE

CERTIFICATE OF CORRECTION

PATENT NO. : 5,485,248

DATED : January 16, 1996

INVENTOR(S) : Hideyuki Yano, et al.

It is certified that error appears in the above-indentified patent and that said Letters Patent is hereby corrected as shown below:

COLUMN 26

Line 50, "Thickness," should read --thickness,--; and
Line 58, "mender" should read --member-- and "term" should read --term use--.

COLUMN 31

Line 18, "satisfactory" should read --satisfactorily--.

COLUMN 32

Line 62, "to" should read --so--.

COLUMN 33

Line 28, "effects" should read --effect--.

COLUMN 34

Line 57, "worn" should read --warn--.

COLUMN 36

Line 21, "-650-750V" should read -- -650 - -750V--.

UNITED STATES PATENT AND TRADEMARK OFFICE

CERTIFICATE OF CORRECTION

PATENT NO. : 5,485,248

DATED : January 16, 1996

INVENTOR(S) : Hideyuki Yano, et al.

It is certified that error appears in the above-indentified patent and that said Letters Patent is hereby corrected as shown below:

COLUMN 37

Line 34, "image," should read --image.--.

COLUMN 38

Line 39, "-650-750V(=$V_D$)." should read -- -650 - 750 V (= $V_D$).--; and
Line 66, "The, the" should read --Then the--.

COLUMN 39

Line 13, "B," should read --8,--;
Line 15, $V_{DC}$ = -400-600V" should read --$V_{DC}$ = -400 - -600V--;
Line 16, "$V_D$ = -650--750V" should read --$V_D$ = -650 - -750V--; and
Line 47, "100--200V" should read --100 - -200V--.

Signed and Sealed this

Sixteenth Day of July, 1996

*Attest:*

Bruce Lehman

BRUCE LEHMAN

*Attesting Officer*

*Commissioner of Patents and Trademarks*